US009447569B2

(12) United States Patent
Shinohara et al.

(10) Patent No.: US 9,447,569 B2
(45) Date of Patent: Sep. 20, 2016

(54) OPERATING DEVICE FOR FLUSH WATER TANK ASSEMBLY

(71) Applicant: TOTO LTD., Fukuoka (JP)

(72) Inventors: Koki Shinohara, Kitakyushu (JP); Hideki Tanimoto, Kitakyushu (JP); Yukinori Kubozono, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 56 days.

(21) Appl. No.: 14/660,911

(22) Filed: Mar. 17, 2015

(65) Prior Publication Data

US 2015/0275491 A1 Oct. 1, 2015

(30) Foreign Application Priority Data

Mar. 28, 2014 (JP) ..... 2014-069459

(51) Int. Cl.
*E03D 3/12* (2006.01)
*E03D 5/094* (2006.01)

(52) U.S. Cl.
CPC ..... *E03D 3/12* (2013.01); *E03D 5/094* (2013.01)

(58) Field of Classification Search
CPC ..... E03D 3/12; E03D 5/094
USPC ..... 4/325, 412
See application file for complete search history.

(56) References Cited

U.S. PATENT DOCUMENTS 5,960,482 A * 10/1999 Chang ..... E03D 1/308 4/412
8,201,283 B2 * 6/2012 Ciski ..... E03D 5/094 4/325
2011/0167549 A1 * 7/2011 Schuster ..... E03D 5/09 4/324

FOREIGN PATENT DOCUMENTS

CN 2641156 Y 9/2004

* cited by examiner

*Primary Examiner* — Tuan N Nguyen
(74) *Attorney, Agent, or Firm* — Studebaker & Brackett PC

(57) ABSTRACT

The present invention relates to an operating device for a flush water tank assembly in a flush toilet as the user can operate operating part toward the one and opposite direction, the rotary direction changing mechanism can change the direction of rotation which is transmitted from the rotating shaft to a rotary wind-up mechanism so that the direction of rotation of the rotary wind-up mechanism can be maintain in a predetermined same direction of rotation. The operating device for the flush water tank assembly includes a drive unit including a rotary wind-up mechanism, a rotary direction changing mechanism for changing the direction of rotation transmitted from the rotating shaft to the rotational wind-up mechanism so that the transmitted direction of rotation can be maintain in accord with a predetermined and fixed direction of rotation, and a limiting mechanism for limiting an angle of rotation of the rotary wind-up mechanism.

16 Claims, 38 Drawing Sheets

OPERATING DEVICE FOR FLUSH WATER TANK ASSEMBLY

TECHNICAL FIELD

The present invention relates to an operating device, and more particularly, to an operating device for use with a flush water tank assembly adapted to actuate a discharge valve disposed in a flush water reservoir tank or flush water reservoir tank so as to initiate delivery of flush water to a toilet main unit.

BACKGROUND ART

It is known in the prior art to provide a flush toilet in which a user operates an operating lever operably connected to a flush water reservoir tank to move a wire associated with the lever in an interlocking manner, thereby providing an actuation of a discharge valve of the flush water reservoir tank for opening or closing thereof.

As disclosed, for example, in Patent Document 1 (CN-U 2641156A), a conventional operating device for use with the flush water tank assembly comprises a linkage mechanism including a plurality of links as shown in FIGS. 41 and 42. As can be seen, rotation of a lever of a toggle type 1201 by the user for flushing causes a pivotal movement of a transmission rod 1202, which may provide a rotation of a rotating disc 1204 operably connected to the transmission rod 1202. Then, the rotation of the disc 1204 causes a connecting rod 1206 to be pulled upwardly to thereby pull up a guide block 1208 vertically upwardly while being guided on a guide rail dispose in casing 1209 and 1211 whereby a transmission rope 1210 passing round the guide block 1208 is pulled to actuate a valve opening mechanism for controlling the flushing.

According to the teachings of the Patent Document 1, the linkage mechanism including the links (the rotating disc 1204, the connecting rod 1206, the guide block 1208) is employed to pull up the wire element (the transmission rope 1210) vertically upwardly such that the wire element can be moved to a distance which is necessary to actuate the valve opening mechanism for flushing.

SUMMARY OF INVENTION

Technical Problem

In the operating device having the operating lever mechanism of this type, however, a relatively bulky equipment is required which can provide a relatively long linear pull-up distance of movement range to the linkage mechanism since the linkage mechanism should pull up the wire element vertically upwardly in a linear manner. Thus, it is difficult to utilize such operating device in a toilet flushing flush water reservoir tank system of a so-called "low-silhouette" type becoming popular. In view of the shortcomings as described, the inventors have set themselves the mission of providing a new operating device utilizing a relatively compact operating means including a rotating mechanism which can be incorporated into the operating device to provide the efficient pull-up of the wire in order to make the operating device compact.

It, however, has been observed that in case which the rotating mechanism is used to pull up the wire, the user by himself has to adjust a pull-up amount of the wire movement in order to switch between a large-scale flushing mode in which a relatively large amount of flush water is delivered and a small-scale mode in which a relatively less amount of flush water is delivered and then such adjustment is very difficult to attain.

Apart from the problem as mentioned above, it also has been observed that the use of a switching mechanism wherein the user may operate the operating device in a directional mode opposite to a forward directional mode (one directional mode) in order to switch between the large-scale flushing mode and the small-scale flushing mode can require reversal of the direction of rotation in which the rotating mechanism pull up the wire, depending on the selection between the large-scale and small-scale flushing mode as desired by the user. As a result, some difficulties may arise. For example, the rotating mechanism may erroneously return to a direction of rotation opposite to the direction of rotation in which it has been rotating appropriately, the rotating mechanism may not return to a predetermined stand-by position, but to an improper position and so on. In addition, it is difficult to maintain the amount of rotation provided by the rotating mechanism in a stable manner, which can be apt to produce variation in the predefined rotational amount of the rotating mechanism, thus resulting in variation of the pull-up amount of the wire for pulling up the valve body and also fluctuation in the amount of the flush water used to flush the toilet in an effective manner.

The present invention seeks to eliminate the problems in the prior art as described above and to propose an arrangement wherein the user can merely operate operating part which is configured to select either one of the forward direction (one direction) and reverse direction (opposite direction) of rotation to select either one of the large-scale and small-scale flushing modes such that the rotating mechanism can change the direction of rotation which is transmitted to a rotary wind-up mechanism so that the direction of rotation of the rotary wind-up mechanism can be maintained in accord with a predetermined and fixed direction of rotation thereof and the rotary wind-up mechanism can reduce variation in the wind-up amount in which the rotary wind-up mechanism can wind up the connecting member operatively associated with the discharge valve in coincidence with its own direction of rotation, the discharge valve can be properly actuated, and the toilet main unit can be cleaned in an efficient manner by an appropriate amount of the flush water.

Solution to Problem

In order to achieve the above object, according to a first aspect of the present invention, there is provided an operating device for use with a flush water tank assembly adapted to actuate a discharge valve disposed in a flush water reservoir tank so as to initiate delivery of flush water to a toilet main unit, the operating device comprising: an operating part for allowing user to select one of forward and reverse direction of rotation modes, thereby selecting corresponding one of large-scale and small-scale modes; a rotating shaft adapted to rotate either one of the forward and reverse direction of rotation in response to the selected one of the forward and reverse direction of rotation of the operating part; a connecting member connected to the discharge valve and adapted to open or close the discharge valve depending on movement of the connecting member in such a manner to switch an amount of the flush water delivered to the toilet main unit between a first amount of the flush water in the large-scale mode and a second amount of the flush water in the small-scale mode; and a drive unit for pulling up the connecting member in response to the rotation of the rotating shaft; the drive unit comprising: a rotary wind-up mechanism having a radius of rotation greater than that of the rotating shaft and adapted to wind up the connecting member in coincidence with the direction of rotation thereof; a rotary direction changing mechanism for changing the direction of rotation transmitted from the rotating shaft to the rotational wind-up mechanism so that the transmitted direction of rotation can be maintained in accord with a predetermined and fixed direction of rotation even though the direction of rotation of the rotating shaft is in either one of the forward and reverse directions; and a limiting mechanism for limiting an angle of rotation of the rotary wind-up mechanism such that the angle of rotation of the rotary wind-up mechanism when the direction of rotation of the rotating shaft is one of the forward and reverse directions is smaller than that of the rotary wind-up mechanism when the direction of rotation of the rotating shaft is the other of the reverse and forward directions.

With such arrangement of the present invention, the user can selectively rotates the operating part in the forward or reverse direction of rotation to select either one of the large-scale or small-scale flushing modes. The rotary direction changing mechanism can change the direction of rotation transmitted from the rotating shaft to the rotary wind-up mechanism into the same direction of rotation even if the rotating shaft is rotated in either one of the forward and reverse directions of rotation. Therefore, the rotary wind-up mechanism can reduce variation in the wind-up amount in which the rotary wind-up mechanism can wind up the connecting member operatively associated with the discharge valve in coincidence with its own direction of rotation, the discharge valve can be properly actuated, and the toilet main unit can be cleaned in an efficient manner by an appropriate amount of the flush water.

Also, it is only necessary for the user to selectively actuate the operating part in the forward or reverse direction of rotation, in order that the limiting mechanism can control the angle of rotation of the rotary wind-up mechanism such that the angle of rotation in the rotary wind-up mechanism when the direction of rotation of the rotating shaft is one of the forward or reverse direction of rotation is smaller than the angle of rotation of the rotary wind-up mechanism when the direction of rotation of the rotating shaft is the other of the reverse or forward direction of rotation. Thus, the amount of wind up and wind down (travel distance) of the connecting member around the rotary wind-up mechanism can be changed appropriately. Accordingly, the user can simply choose the direction of rotation of the operating part to easily choose the large-scale or small-scale flushing modes such that the discharge valve can be properly actuated, and the toilet main unit can be cleaned in an efficient manner by an appropriate amount of the flush water. Consequently, the ease-to-use can be improved.

In accordance with the present invention, preferably, the drive unit also comprises: a first rotary gear member incorporated into the rotary direction changing mechanism and connected to the rotating shaft such that the first rotary gear member rotates together with the rotating shaft when the direction of rotation of the rotating shaft is either one of the forward and reverse directions, the first rotary gear member including first toothed part having external teeth thereon; a rotary wind-up member incorporated into the rotary wind-up mechanism, the rotary direction changing mechanism, and the limiting mechanism, the rotary wind-up member including a wind-up member gear portion rotatable about a wind-up member shaft and having external teeth on a part of the circumference thereof to engage the first toothed part, a mounting part for mounting the connecting member around the outer periphery thereof; and a receiving part provided outwardly of the wind-up member shaft for receive a force rotating the receiving part, the rotary wind-up member being adapted to wind up the connecting member in coincidence with its own direction of rotation; a second rotary gear member incorporated into the rotary direction changing mechanism and connected to the rotating shaft such that the second rotary gear member rotates together with the rotating shaft when the direction of rotation of the rotating shaft is rotated in the other of the reverse and forward directions, the second rotary gear member including second toothed part having external teeth thereon; a third rotary gear member incorporated into the rotary direction changing mechanism and adapted to be rotated about a third rotary gear member shaft, the third rotary gear member including a third toothed part having external teeth formed thereon to engage the second toothed part; and a rotary abutment member incorporated into the rotary wind-up mechanism, the rotary direction changing mechanism, and the limiting mechanism and adapted to be rotated about the rotary wind-up member shaft, the rotary abutment member including a first abutment part adapted to engage the receiving part of the rotary wind-up member in such a manner to rotate the rotary wind-up member in the same direction of rotation as the direction of rotation thereof and an abutment member gear portion having external teeth formed thereon to engage the third toothed part of the third rotary gear member.

With such arrangement of the present invention, the use can operate the operating part to rotate it in the forward or inverse direction of rotation and to select the large-scale or small-scale flushing mode. The rotary direction changing mechanism of the drive unit can change the direction of rotation transmitted from the rotating shaft to the rotary wind-up mechanism into the same direction of rotation even if the rotating shaft is rotated in either one of the forward and reverse direction of rotation.

In other words, when the direction of rotation of the rotating shaft is either one of the forward and reverse directions of rotation, the first rotary gear member is rotated together with the rotating shaft in the same direction. The first toothed part of the first rotary gear member is engaged with the wind-up member gear portion which is in turn rotated by the rotating shaft in the direction opposite to that of the rotating shaft. In this manner, the rotary wind-up member can wind up the operating wire by rotating in the direction opposite to that of the rotating shaft.

On the other hand, when the direction of rotation of the rotating shaft is the other of the forward and reverse directions of rotation, the second rotary gear member is rotated together with the rotating shaft in the same direction. The second toothed part of the second rotary gear member is engaged and rotated by the third toothed part of the third rotary gear member which is rotated by the second rotary gear member in the direction opposite to that of the second rotary gear member. Further, the third toothed part of the third rotary gear member is engaged and rotated by the abutment member gear portion of the rotary abutment member which is rotated by the third rotary gear member in the direction opposite to that of the third rotary gear member. The first abutment part of the rotary abutment member is engaged by the rotary wind-up member receiving portion of the rotary wind-up member to rotate the rotary wind-up member receiving portion in the same direction as the direction of rotation of the rotary abutment member. Consequently, the rotary wind-up member will be rotated in the same direction as the direction of rotation of the rotating shaft. In this manner, the rotary wind-up member can wind up the connecting member as the rotary wind-up member is rotated in the same direction as the direction of rotation of the rotating shaft.

Accordingly, the rotary direction changing mechanism can change the direction of rotation transmitted from the rotating shaft to the rotary wind-up member so that the rotary wind-up member can be rotated always in the same direction of rotation, even when the rotating shaft is rotated in either one of the forward and reverse directions of rotation. By using such a relatively simple structure, the direction of rotation of the rotary wind-up member can remain unchanged.

Accordingly, even though the user operates the operating part in either one of the forward and reverse directions, the rotary wind-up member can wind up appropriately the connecting member in coincidence with its own direction of rotation, which can appropriately actuate the discharge valve.

In accordance with the present invention, preferably, the drive unit also comprises: a rotary wind-up member incorporated into the rotary wind-up mechanism, the rotary direction changing mechanism, and the limiting mechanism and connected to the rotating shaft such that the rotary wind-up member rotates together with the rotating shaft when the direction of rotation of the rotating shaft is either one of the forward and reverse directions, the rotary wind-up member including a mounting part for mounting the connecting member around the outer periphery thereof and a receiving part provided outwardly of the wind-up member shaft for receive a force rotating the receiving part, the rotary wind-up member being adapted to wind up the connecting member in coincidence with its own direction of rotation; a second rotary gear member incorporated into the rotary direction changing mechanism and connected to the rotating shaft such that the second rotary gear member rotates together with the rotating shaft when the direction of rotation of the rotating shaft is the other of the reverse and forward directions, the second rotary gear member including second toothed part having external teeth thereon; a third rotary gear member incorporated into the rotary direction changing mechanism and adapted to be rotated about a third rotary gear member shaft, the third rotary gear member including a third toothed part having external teeth formed thereon and a fourth toothed part arranged to rotate together with the third toothed part and having external teeth formed thereon which are axially offset the external teeth of the third toothed part, the third toothed part meshing with the second toothed part of the second rotary gear member, and the third and fourth toothed parts adapted to be rotated about a shaft of the third rotary gear member; a fifth rotary gear member incorporated into the rotary direction changing mechanism and adapted to be rotated about a fifth rotary gear member shaft, the fifth rotary gear member including a fifth toothed part having external teeth formed thereon to engage the fourth toothed part; and a rotary abutment member incorporated into the rotary direction changing mechanism and the limiting mechanism and arranged to be rotated independently of the rotation of the rotating shaft, the rotary abutment member including a first abutment part adapted to engage the receiving part of the rotary wind-up member in such a manner to rotate the rotary wind-up member in the same direction of rotation as the direction of rotation thereof and an abutment member gear portion having external teeth formed thereon to engage the fifth toothed part of the fifth rotary gear member.

With such arrangement of the present invention, the user can operate the operating part to rotate it in the forward or inverse direction of rotation and to select the large-scale or small-scale flushing mode. The rotary direction changing mechanism of the drive unit can change the direction of rotation transmitted from the rotating shaft to the rotary wind-up mechanism into the same direction of rotation even if the rotating shaft is rotated in either the forward or reverse direction of rotation.

In other words, when the direction of rotation of the rotating shaft is either one of the forward and reverse directions of rotation, the rotary wind-up member rotates together with the rotating shaft in the same direction of rotation as that of the rotating shaft. Thus, the rotary wind-up member can wind up the connecting wire in the same direction of rotation as that of the rotating shaft.

On the other hand, when the direction of rotation of the rotating shaft is the other of the forward and reverse directions of rotation, the second rotary gear member rotates together with the rotating shaft in the same direction of rotation as that of the rotating shaft. The second toothed part of the second rotary gear member is engaged and rotated by the third toothed part of the third rotary gear member which is rotated by the second rotary gear member in the direction opposite to that of the second rotary gear member. The third and fourth toothed parts cooperate to rotate in the same direction. Further, the fourth toothed part of the third rotary gear member is engaged and rotated by the fifth toothed part of the fifth rotary gear member which rotates in a direction opposite to the direction of rotation of the third rotary gear member. Then, the fifth toothed part of the fifth rotary gear member is engaged by, and rotates, the abutment member gear portion of the rotary abutment member which rotates in the direction opposite to that of the fifth rotary gear member independently of the rotation of the rotating shaft. The first abutment part of the rotary abutment member is engaged by the rotary wind-up member receiving portion of the rotary wind-up member to rotate the rotary wind-up member receiving portion in the same direction as the direction of rotation of the rotary abutment member. Consequently, the rotary wind-up member will be rotated in the same direction as the direction of rotation of the rotating shaft. In this manner, the rotary wind-up member can wind up the connecting member as the rotary wind-up member rotates in a direction opposite to the direction of rotation of the rotating shaft.

Accordingly, the rotary direction changing mechanism can change the direction of rotation transmitted from the rotating shaft to the rotary wind-up member so that the rotary wind-up member can be rotated in the predetermined same direction of rotation, even when the rotating shaft is rotated in either one of the forward and reverse directions of rotation. By using such a relatively simple structure, the direction of rotation of the rotary wind-up member can be fixed.

Accordingly, even though the user operates the operating part in either one of the forward and reverse directions, the rotary wind-up member can wind up appropriately the connecting member in coincidence with its own direction of rotation, which can appropriately actuate the discharge valve.

In accordance with the present invention, the drive unit also comprises: a case member incorporated into the limiting mechanism and provided with a stop; the rotary wind-up member including a first limiting part adapted to engage the stop of the case member when the first limiting part rotates to a first angle of rotation thereof, the engagement of the first limiting part with the stop being adapted to limit a range of rotation within which the rotary wind-up member can wind up the connecting member in coincidence with its own direction of rotation to a first range of rotation; the rotary abutment member including a second limiting part adapted to engage the stop of the case member when the rotary abutment member rotates to a second angle of rotation thereof which is smaller than the first angle of rotation of the rotary wind-up member, the engagement of the second limiting part with the stop causing a range of rotation within which the rotary wind-up member can be rotated to be limited to a second range of rotation which is narrower than the first range of rotation.

With such arrangement of the present invention, the first rotary gear member rotates together with the rotating shaft when the direction of rotation of the rotating shaft is either one of the forward and reverse directions of rotation. The first toothed part of the first rotary gear member is engaged by the wind-up member gear portion to rotate the rotary wind-up member. When the rotary wind-up member rotates to the first angle of rotation, the wind-up mechanism abutment portion is engaged by the stop of the case member to limit the range of rotation in which the rotary wind-up member winds up the connecting member to the first range of rotation.

If the rotating shaft is rotated in the other of the forward and reverse directions of rotation, the second rotary gear member rotates together with the rotating shaft. The second toothed part of the second rotary gear member is engaged by the third toothed part of the third rotary gear member to rotate the third rotary gear member. Furthermore, the third toothed part of the third rotary gear member is engaged by the abutment member gear portion of the rotary abutment member to rotate the rotary abutment member. Then, the first abutment portion of the rotary abutment member is engaged by the rotary wind-up member receiving portion of the rotary wind-up member to rotate the rotary wind-up member in the same direction as that of the rotary abutment member. When the rotary abutment member and rotary wind-up member rotate to the second angle of rotation, the second abutment portion of the rotary abutment member is engaged by the stop of the case member to limit the range of rotation in which the rotary wind-up member winds up the connecting member to the second range of rotation which is smaller than the first range of rotation.

Accordingly, it is only necessary for the user to selectively actuate the operating part in the forward or reverse direction of rotation, in order that the limiting mechanism of the drive unit can control the range of rotation of the rotary wind-up member such that the angle of rotation of the rotary wind-up member when the direction of rotation of the rotating shaft is either one of the forward and reverse directions of rotation becomes larger than the angle of rotation of the rotary wind-up member when the direction of rotation of the rotating shaft is the other of the forward and reverse directions of rotation Thus, the amount of wind-up of the connecting member around the rotary wind-up member can be changed appropriately. Accordingly, in order to select either one of the large-scale and small-scale flushing modes, it is only necessary for the user to perform one of the forward and reverse directions of rotation for the operating part. This improves the usability for the user.

In accordance with the present invention, preferably the drive unit also comprises a speed increasing mechanism for increasing the angle of rotation of the rotary wind-up mechanism relative to the angle of rotation of the rotating shaft.

With such arrangement of the present invention, the angle of rotation of the rotating shaft required to rotate the rotary wind-up mechanism to a predetermined angle of rotation can be reduced. This can reduce the angle of rotation of the operating part required to rotate the rotating shaft. Accordingly, the usability of the operating device can be improved since the user is not required to provide a further still rotation of the operating part.

In accordance with the present invention, preferably the drive unit also comprises a speed decreasing mechanism for decreasing the angle of rotation of the rotary wind-up mechanism relative to the angle of rotation of the rotating shaft.

With such arrangement of the present invention, an operating force for rotation of the rotating shaft required to rotate the rotary wind-up member to a predetermined angle of rotation can be reduced, thus resulting in the reduction of the operating force required to rotate the operating part. Since the user can rotate the operating part with a relatively small operating force, accordingly, the user can operate the operating part with little effort.

In accordance with the present invention, preferably the drive unit also comprises a spring mechanism for returning the rotary wind-up mechanism to a predetermined stand-by position.

With such arrangement of the present invention, the rotary wind-up member is returned to its preset stand-by position by the spring mechanism after it has been operated by the user. Consequently, the discharge valve is not left at its open state. Also, Together with the rotary direction changing mechanism for changing the direction of rotation of the rotary wind-up member to the predetermined same direction of rotation, the spring mechanism can return the rotary wind-up member to its preset stand-by position in a relatively exact manner. Therefore, an appropriate flushing operation can be performed when the flush toilet is next used.

In accordance with the present invention, preferably, the shaft on which the rotary wind-up mechanism rotates is separate from the rotating shaft of the operating device.

With such arrangement of the present invention, either one of the speed increasing and reducing mechanisms can be provided even if the operating part is rotated in either one of the forward and reverse directions of rotation, thereby providing an improved ease-to-use.

In accordance with the present invention, preferably, the shaft on which the rotary wind-up mechanism rotates is common with the rotating shaft of the operating device.

With such arrangement of the present invention, the whole drive unit can be made compact since the shaft on which the rotary wind-up mechanism rotates is identical with the rotating shaft.

Also, the present invention provides a flush water tank assembly including an operating device as defined above.

With such arrangement of the present invention, the flush water tank assembly can include the operating device providing a stable operation.

Additionally, the present invention provides the flush toilet equipped with the flush water tank assembly as defined above.

With such arrangement of the present invention, the flush toilet can be equipped with the flush water tank assembly providing a stable operation.

Advantageous Effects of Invention

In the present invention, the rotary wind-up mechanism can reduce variation in the wind-up amount in which the rotary wind-up mechanism can wind up the connecting member operatively associated with the discharge valve in coincidence with its own direction of rotation, the discharge valve can be properly actuated, and the toilet main unit can be cleaned in an efficient manner by an appropriate amount of the flush water.

BRIEF DESCRIPTION OF DRAWINGS

FIG. 9 (*b*) is a front view, as viewed in the axial direction, of the rotating shaft of the operating device for use with the flush water tank assembly according to the first embodiment of the present invention;

FIG. 10 (*b*) is a front view, as viewed in the axial direction, of the first rotary gear member in the operating device for use with the flush water tank assembly according to the first embodiment of the present invention;

FIG. 11 (*b*) is a perspective view of the rotary wind-up member in the operating device for use with the flush water tank assembly according to the first embodiment of the present invention;

FIG. 12 (*b*) is a front view, as viewed in the axial direction, of the second rotary gear member in the operating device for use with the flush water tank assembly according to the first embodiment of the present invention;

FIG. 14 (*b*) is a front view, as viewed in the axial direction, of the rotating abutment member in the operating device for use with the flush water tank assembly according to the first embodiment of the present invention;

FIG. 14 (*c*) is a side view of a rotating abutment member in the operating device for use with the flush water tank assembly according to the first embodiment of the present invention;

FIG. 15 (*b*) is a front view of the details of the internal structure of the drive unit in the operating device for use with the flush water tank assembly according to the first embodiment of the present invention when the cover cap has been removed and when the operating handle is forwardly rotated to its large-scale flushing position to rotate the rotary wind-up member to a first angle of rotation;

FIG. 16 (*b*) is a cross-sectional view, taken along line A-A in FIG. 6, of the details of the internal structure of the drive unit in the operating device for use with the flush water tank assembly according to the first embodiment of the present invention when the operating handle is forwardly rotated to its large-scale flushing position and the rotary wind-up member has been rotated to a first angle of rotation;

FIG. 17 (*b*) is a cross-sectional view, taken along line B-B in FIG. 6, of the details of the internal structure of the drive unit in the operating device for use with the flush water tank assembly according to the first embodiment of the present invention when the operating handle is forwardly rotated to its large-scale flushing position and the rotary wind-up member has been rotated to a first angle of rotation;

FIG. 18 (*b*) is a cross-sectional view, taken along line C-C in FIG. 6, of the details of the internal structure of the drive unit in the operating device for use with the flush water tank assembly according to the first embodiment of the present invention when the operating handle is forwardly rotated to its large-scale flushing position and the rotary wind-up member has been rotated to a first angle of rotation;

FIG. 19 (*b*) is a front view of the details of the internal structure of the drive unit in the operating device for use with the flush water tank assembly according to the first embodiment of the present invention when the cover cap has been removed and when the operating handle is forwardly rotated to its small-scale flushing position when the rotary wind-up member has been rotated to a first angle of rotation;

FIG. 20 (*b*) is a cross-sectional view, taken along line A-A in FIG. 6, of the details of the internal structure of the drive unit in the operating device for use with the flush water tank assembly according to the first embodiment of the present invention when the operating handle is reversely rotated to its small-scale flushing position and the rotary wind-up member has been rotated to a second angle of rotation;

FIG. 21 (*b*) is a cross-sectional view, taken along line B-B in FIG. 6, of the details of the internal structure of the drive unit in the operating device for use with the flush water tank assembly according to the first embodiment of the present invention when the operating handle is reversely rotated to its small-scale flushing position and the rotary wind-up member has been rotated to a second angle of rotation;

FIG. 22 (*b*) is a cross-sectional view, taken along line C-C in FIG. 6, of the details of the internal structure of the drive unit in the operating device for use with the flush water tank assembly according to the first embodiment of the present invention when the operating handle is reversely rotated to its small-scale flushing position and the rotary wind-up member has been rotated to a second angle of rotation;

FIG. 27 (*b*) is a front view of the rotating shaft in the operating device for use with the flush water tank assembly by the second embodiment of the present invention as viewed from the interior of a flush water reservoir tank in the axial direction;

FIG. 28 (*b*) is a front view of the rotary wind-up member in the operating device for use with the flush water tank assembly according to the second embodiment of the present invention as viewed from the interior of the flush water reservoir tank in the axial direction;

FIG. 29 (*b*) is a front view of the second rotary gear member in the operating device for use with the flush water tank assembly according to the second embodiment of the present invention as viewed from the exterior of the flush water reservoir tank in the axial direction;

FIG. 30 (*b*) is a front view of the third rotary gear member in the operating device for use with the flush water tank assembly according to the second embodiment of the present invention as viewed from the interior of the flush water reservoir tank in the axial direction;

FIG. 32 (*b*) is a front view of the rotary abutment member in the operating device for use with the flush water tank assembly according to the second embodiment of the present invention as viewed from the exterior of the flush water reservoir tank in the axial direction;

FIG. 33 (*b*) is a front view of the details of the internal structure of the drive unit in the operating device for use with the flush water tank assembly according to the second embodiment of the present invention when the cover cap has been removed and when the operating handle is forwardly rotated to its large-scale flushing position when the rotary wind-up member is rotated to a first angle of rotation;

FIG. 34 (*b*) is a cross-sectional view, taken along line D-D in FIG. 25, of the details of the internal structure of the drive unit in the operating device for use with the flush water tank assembly according to the second embodiment of the present invention when the operating handle is forwardly rotated to its large-scale flushing position and the rotary wind-up member has been rotated to a first angle of rotation;

FIG. 35 (*b*) is a cross-sectional view, taken along line E-E in FIG. 25, of the details of the internal structure of the drive unit in the operating device for use with the flush water tank assembly according to the second embodiment of the present invention when the operating handle is forwardly rotated to its large-scale flushing position and the rotary wind-up member has been rotated to a first angle of rotation;

FIG. 36 (*b*) is a cross-sectional view, taken along line F-F in FIG. 25, of the details of the internal structure of the drive unit in the operating device for use with the flush water tank assembly according to the second embodiment of the present invention when the operating handle is forwardly rotated to its large-scale flushing position and the rotary wind-up member has been rotated to a first angle of rotation;

FIG. 37 (*b*) is a front view of the details of the internal structure of the drive unit in the operating device for use with the flush water tank assembly according to the second embodiment of the present invention when the cover cap has been removed and when the operating handle is reversely rotated to its small-scale flushing position and when the rotary wind-up member has been rotated to a second angle of rotation;

FIG. 38 (*b*) is a cross-sectional view, taken along line D-D in FIG. 25, of the details of the internal structure of the drive unit in the operating device for use with the flush water tank assembly according to the second embodiment of the present invention when the operating handle is reversely rotated to its small-scale flushing position and the rotary wind-up member has been rotated to a second angle of rotation;

FIG. 39 (*b*) is a cross-sectional view, taken along line E-E in FIG. 25, of the details of the internal structure of the drive unit in the operating device for use with the flush water tank assembly according to the second embodiment of the present invention when the operating handle is reversely rotated to its small-scale flushing position and the rotary wind-up member has been rotated to a second angle of rotation;

FIG. 40 (*b*) is a cross-sectional view, taken along line F-F in FIG. 25, of the details of the internal structure of the drive unit in the operating device for use with the flush water tank assembly according to the second embodiment of the present invention when the operating handle is reversely rotated to its small-scale flushing position and the rotary wind-up member has been rotated to a second angle of rotation;

DESCRIPTION OF EMBODIMENTS

With reference to the accompanying drawings, an operating device for use with of a flush water tank assembly according to the first embodiment of the present invention will be described hereinafter.

First of all, with reference to FIG. 1, a flush toilet comprising a flush water tank assembly including an operating device according to the first embodiment of the present invention will be described.

Figure 1:
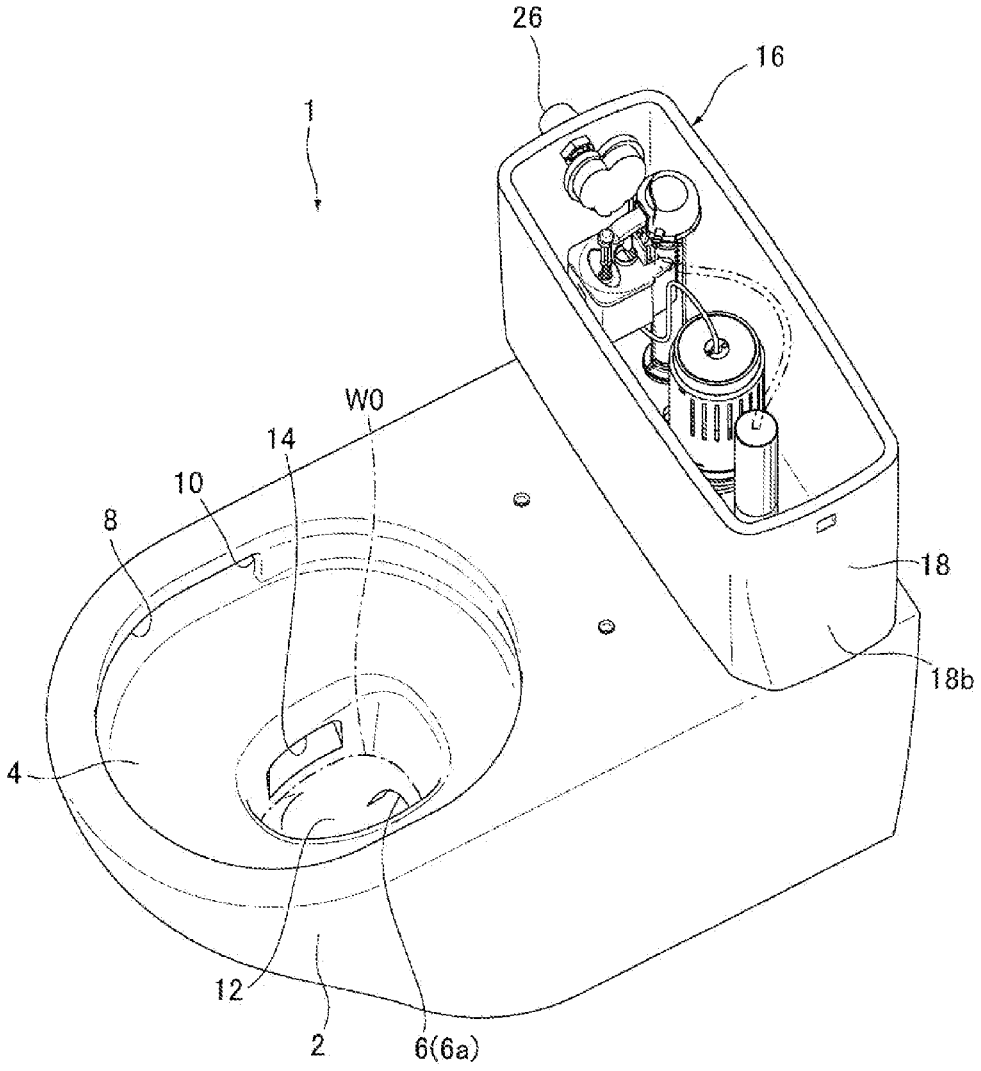
FIG. 1 is a top perspective view of a flush toilet equipped with a flush water tank assembly including an operating device according to the first embodiment of the present invention with its toilet seat and lid removed.

FIG. 1 is a perspective view illustrating a flush toilet comprising a flush water tank assembly including an operating device according to the first embodiment of the present invention with a toilet seat, a toilet lid and a closure of the flush water tank assembly being removed.

As can be seen from FIG. 1, reference numeral 1 denotes a so-called siphon-type flush toilet wherein the human waste in the bowl can be sucked and at once expelled outwardly through a trap conduit or trapway under siphon action. This flush toilet 1 comprises a toilet main unittoilet main unit 2 made of porcelain. The toilet main unittoilet main unit 2 is provided with a bowl 4 and a trap conduit 6 placed in fluid communication with the lower part of the bowl 4.

The bowl 4 of the toilet main unittoilet main unit 2 is provided at its top peripheral edge with an inwardly overhanging rim 8 and a first flush water discharge port 10 discharging a flush water supplied from a water conduit (not shown) which is formed in the interior of the backward potion of the toilet main unittoilet main unit 2. The flush water discharged from the first flush water discharge port 10 cleans the surface of the bowl 4 while flowing spirally and downwardly thereover.

The bowl 4 is provided at its bottom with a water pooling region 12, its pooled water level being shown by a dash-single dot line W0. The trap conduit 6 has an inlet 6*a* fluidly connected to the bottom of the water pooling region 12. The opposite end of the trap conduit 6 to the inlet 6*a* is connected to an underfloor exhaust pipe (not shown) through a waste-water exhaust socket (not shown).

The bowl 4 is also provided at a position above the pooled water level W0 with a second flush water discharge port 14 which discharges a flush water supplied from a water conduit (not shown) which is formed in the interior of the backward portion of the toilet main unit 2 and the flush water discharged from the second flush water discharge port 14 is adapted to create a swirl flow which can swirl the pool of water in the water pooling region 12 in the vertical direction.

On upper part of the backward part of the toilet main unittoilet main unit 2 is provided a flush water tank assembly 16 which stores the flush water supplied to the toilet main unit 2.

Although the first embodiment has been described in connection with the flush water tank assembly 16 applied to the siphon-type flush toilet, the first embodiment may be equally applicable to other types of flush toilets such as a so-called wash-down type flush toilets to design to be emptied of waste under a water flow action caused by the water drop in the bowl.

Figure 2:
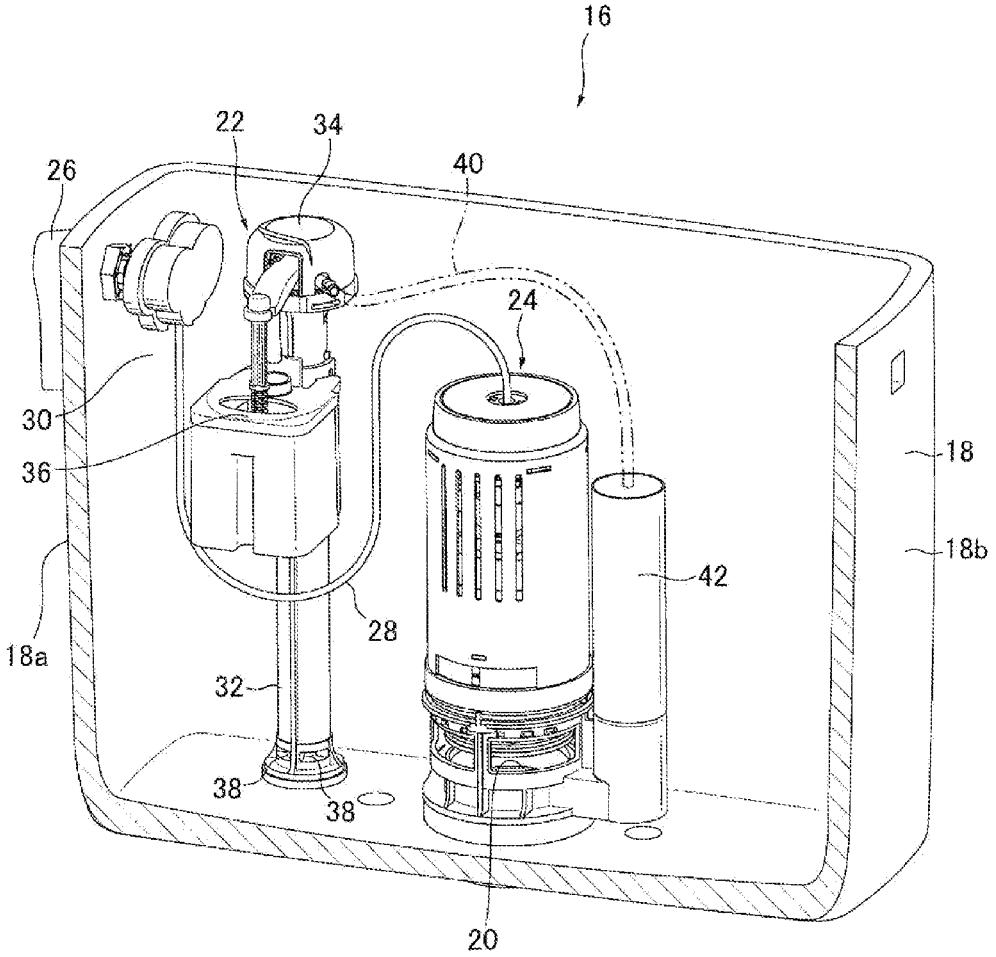
FIG. 2 is a front cutaway perspective view of a flush water tank assembly including an operating device for use with the flush water tank assembly according to the first embodiment of the present invention for illustrating the details of the internal structure of the flush water tank assembly.

With reference to FIG. 2, the details of the internal structure of the flush water tank assembly 16 will now be described.

FIG. 2 is a front cutaway perspective view of a flush water tank assembly including an operating device according to the first embodiment of the present invention, illustrating the details of the internal structure of the flush water tank assembly.

As shown in FIG. 2, the flush water tank assembly 16 comprises a flush water reservoir tank 18 for storing the flush water used for flushing of the flush toilet 1. The flush water reservoir tank 18 is provided at its bottom with a water discharge port 20 leading to a water conduit (not shown) of the toilet main unittoilet main unit 2, such that the flush water can be supplied from the flush water reservoir tank 18 to the water conduit (not shown) of the toilet main unittoilet main unit 2. The internal volume of the flush water reservoir tank 18 may depend on the type of toilets. The flush water reservoir tank 18 is a low-silhouette type flush water reservoir tank, for example.

As can be seen in FIG. 2, the flush water reservoir tank 18 of the flush water tank assembly 16 receives a water supply device 22 for delivering the flush water into the flush water reservoir tank 18, a water discharge valve device 24 for controlling a water discharge port 20 such that the flush water stored in the flush water reservoir tank 18 can be caused to flow into the water conduit (not shown) of the toilet main unittoilet main unit 2, and an operating device 30 for mechanically raising a valve body 56 (FIG. 3) in the water discharge valve device 24 through an operating wire 28 connected to an operating handle 26 on the outside of the flush water reservoir tank 18 when the operating handle is manually rotated for flushing.

The water supply device 22 comprises a water supply pipe 32 connected to an external source of water supply (not shown) and extending upwardly from the bottom of the flush water reservoir tank 18, a feed valve 34 attached to the top end of the water supply pipe 32 for switching between delivery and stop of the flush water flow from the water supply pipe 32 into the flush water reservoir tank 18, and a float 36 adapted to move upwardly and downwardly in the flush water reservoir tank depending on the level of water within the flush water reservoir tank 18 for switching the delivery and stop via the feed valve 34.

The water supply pipe 32 is provided at its bottom end with a water outlet 38 placed in fluid communication with the interior of the flush water reservoir tank 18 such that the flush water from the feed valve 34 is delivered into the flush water reservoir tank 18 through the water outlet 38.

The water supply device 22 also comprises a refill tube 40 fluidly connected to the feed valve 34. The refill tube 40 is partially positioned at a predetermined location within the overflow pipe 42 or flush water reservoir tank 18 so that the downstream end of the refill tube 40 is located adjacent to upward area of the top opening of the overflow pipe 42 of the water discharge valve device 24 which will be described later.

The float 36 in the water supply device 22 lowers with the level of the flush water being lowered when the flush water is discharged from within the flush water reservoir tank 18 into the toilet bowl through the water discharge valve device 24, the operation of which will be described later. In this manner, the feed valve 34 is opened to start the discharge of flush water from the water outlet 38 such that the flush water is discharged from the external source of water supply (not shown) into the flush water reservoir tank 18 of the flush water tank assembly 16.

As the flushing is continued while the level of water within the flush water reservoir tank 18 increases, the float 36 upwardly moves to close the feed valve 34, thereby stopping the delivery of flush water from the water outlet 38. In such a manner, the level of flush water within the flush water reservoir tank 18 can be maintained in a predetermined full level.

Figure 3:
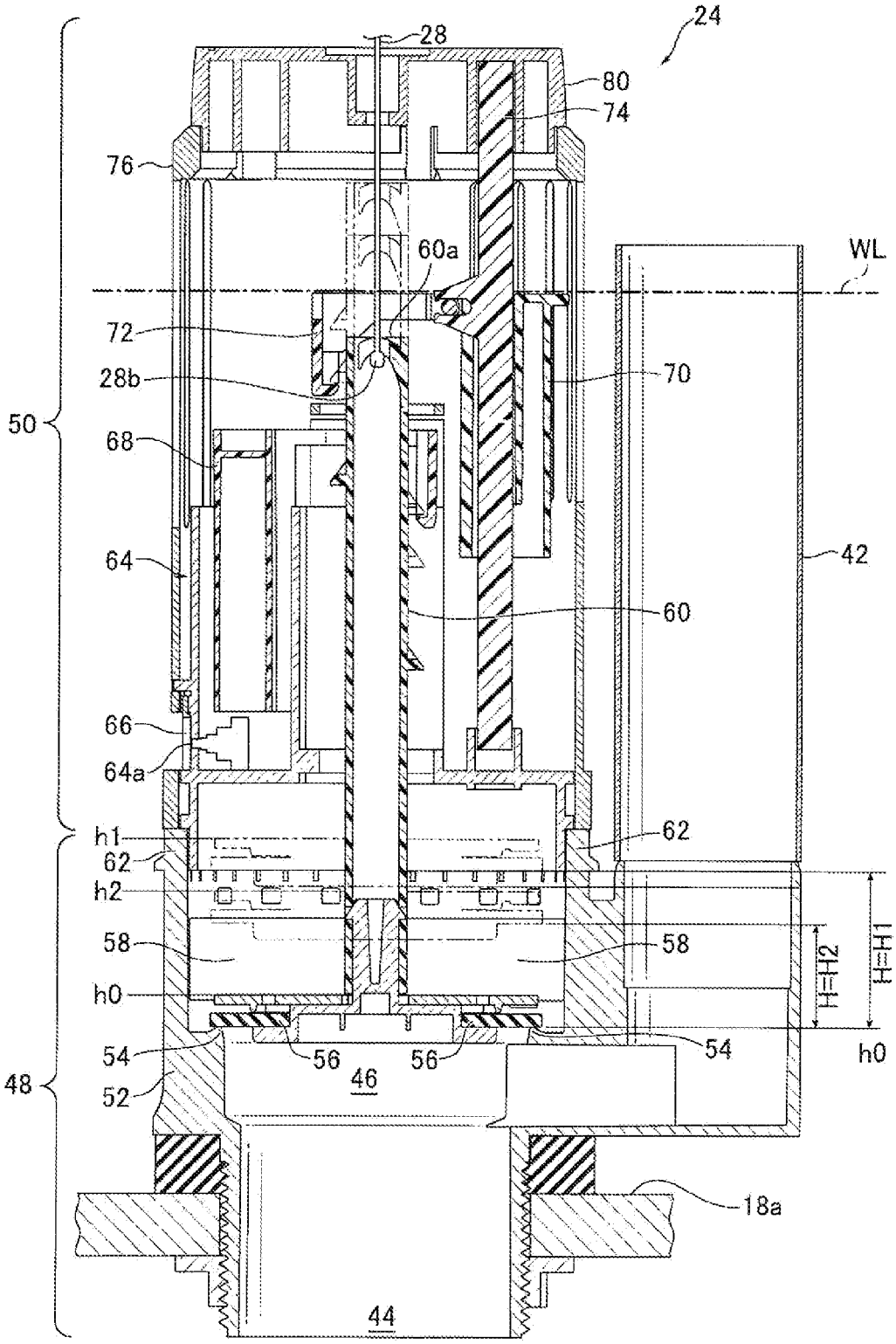
FIG. 3 is a sectional view of a water discharge valve device shown in FIG. 2 along its longitudinal center line, showing the state of the water discharge valve device according to the first embodiment of the present invention before start of flushing in small-scale and large-scale flushing modes.

With reference to FIGS. 1 to 3, a so-called direct operating type water discharge valve device 24 mounted on the operating device for use with the flush water tank assembly according to the first embodiment of the present invention will now be described.

FIG. 3 is a sectional view of a water discharge valve device shown in FIG. 2 along its longitudinally central line, showing the state of the water discharge valve device according to the first embodiment of the present invention before drainage start in small-scale and large-scale flushing modes.

As shown in FIGS. 1 to 3, the water discharge valve device 24 comprises a water discharge port unit 48 mounted on the inner bottom face of the flush water reservoir tank 18 and providing a water discharge port 46 fluidly connected to the water conduit 44 of the toilet main unittoilet main unit 2 and a flush valve unit 50 mounted on the top end of the water discharge port unit 48.

The water discharge port unit 48 of the water discharge valve device 24 comprises an water discharge port forming member 52 mounted on the inner bottom face of the flush water reservoir tank 18 at a predetermined position to form the water discharge port 46. The bottom end of the water discharge port forming member 52 is secured to the inner bottom face of the flush water reservoir tank 18. An overflow pipe 42 is connected to a part of the outer periphery of the water discharge port forming member 52 such that the overflow pipe 42 is fluidly connected to the water discharge port 46 formed in the interior of the water discharge port forming member 52.

The water discharge port forming member 52 comprises a valve seat 54 placed over the top circumference on the water discharge port 46. The water discharge port 46 is closed when this valve seat 54 abuts against the valve body 56 of the flush valve unit 50. The water discharge port forming member 52 also comprises a plurality of communicating ports 58 for conducting the flush water from the outside of the water discharge valve device 24 into the water discharge port 46.

As can be seen from FIG. 3, the flush valve unit 50 of the water discharge valve device 24 comprises a valve body 56, a main plastic shaft member or stem 60 mounted at its bottom end on the valve body 56 and extending in the vertical direction, an inner control barrel member 64 mounted on the top edge 62 of water discharge port forming member 52 in the water discharge port unit 48 for controlling the motion of the valve body 56, a shielding member 66 mounted on the outer wall 64*b* of the inner control barrel member 64 in which a flow regulation opening 64*a* is provided, a large-scale flushing float member of plastic 68 for starting the valve closing step in a large-scale flushing mode, a small-scale flushing float member of plastic 70 for starting the valve closing step in a small-scale flushing mode, a cam member 72 co-operating with the float member 70, a plastic support member 74 supporting these members 70 and 72, an outer control barrel member 76 externally surrounding these members 60 to 74, and a guide member 80 holding the top of the outer control barrel member 76 and guiding the vertical movement (upward and downward movement) of the operating wire 28.

The operating wire 28 in the water discharge valve device 24 is attached at its end to the top end 60*a* of the main shaft member 60 to open the valve body 56 when the main shaft member 60 is moved upwardly by the operating wire 28. The opening of the valve body 56 through the operating wire 28 will now be described.

On opening of the valve in the large-scale flushing mode of the water discharge valve device 24 as shown in FIG. 3, the operating device 30 is actuated as the operating handle 26 is rotated by a user to execute a predetermined large-scale flushing mode. The operating wire 28 is taken or wound up to a predetermined maximum level and the main shaft member 60 and valve body 56 of the flush valve unit 50 are moved upwardly to the respective highest position h1. At this time, the upward height (stroke) H of the valve body 56 relative to the valve seat 54 is equal to the maximum height (maximum stroke) H1 which is higher than the upper height H2 in the small-scale flushing mode (i.e., H1>H2). As a result, the large-scale flushing mode is started to deliver the flush water into the toilet main unittoilet main unit 2 of the flush toilet 1 through the water discharge valve device 24 of the flush water tank assembly 16.

As can be seen from FIG. 3, when the operating handle 26 in the water discharge valve device 24 is rotated by the user to start a predetermined small-scale flushing mode, the operating device 30 is actuated to pull up the operating wire 28 to a wind-up amount less than the maximum wind-up amount in the large-scale flushing mode. As a result, the main shaft member 60 and valve body 56 in the flush valve unit 50 are upwardly moved to a predetermined height position h2 lower than the respective highest positions so that the water discharge port 46 is opened. At this time, upper height (stroke) H of the valve body 56 relative to the valve seat 54 is equal to a height H2 lower than the maximum stroke H1 in the large-scale flushing mode. As a result, the small-scale flushing mode is started to move the flush water into the toilet main unittoilet main unit 2 of the flush toilet 1 through the water discharge valve device 24 of the flush water tank assembly 16.

In the water discharge valve device 24, the main shaft member 60 and valve body 56 are further moved downwardly as the water level id reduced while making a predetermined operation after the valve body 56 has moved upwardly to the respective levels in the large-scale and small-scale flushing modes as above-mentioned. As can be seen from FIG. 3, the valve body 56 then abuts against the valve seat 54 as in its stand-by (start) position h0 to close the water discharge port 46 whereby the large-scale or small-scale flushing mode is completed. At this time, the level of the flush water indicates the full level WL.

With reference to FIGS. 4 to 9, the operating device for use with the flush water tank assembly according to the first embodiment of the present invention will now be described in detail.

Figure 4:
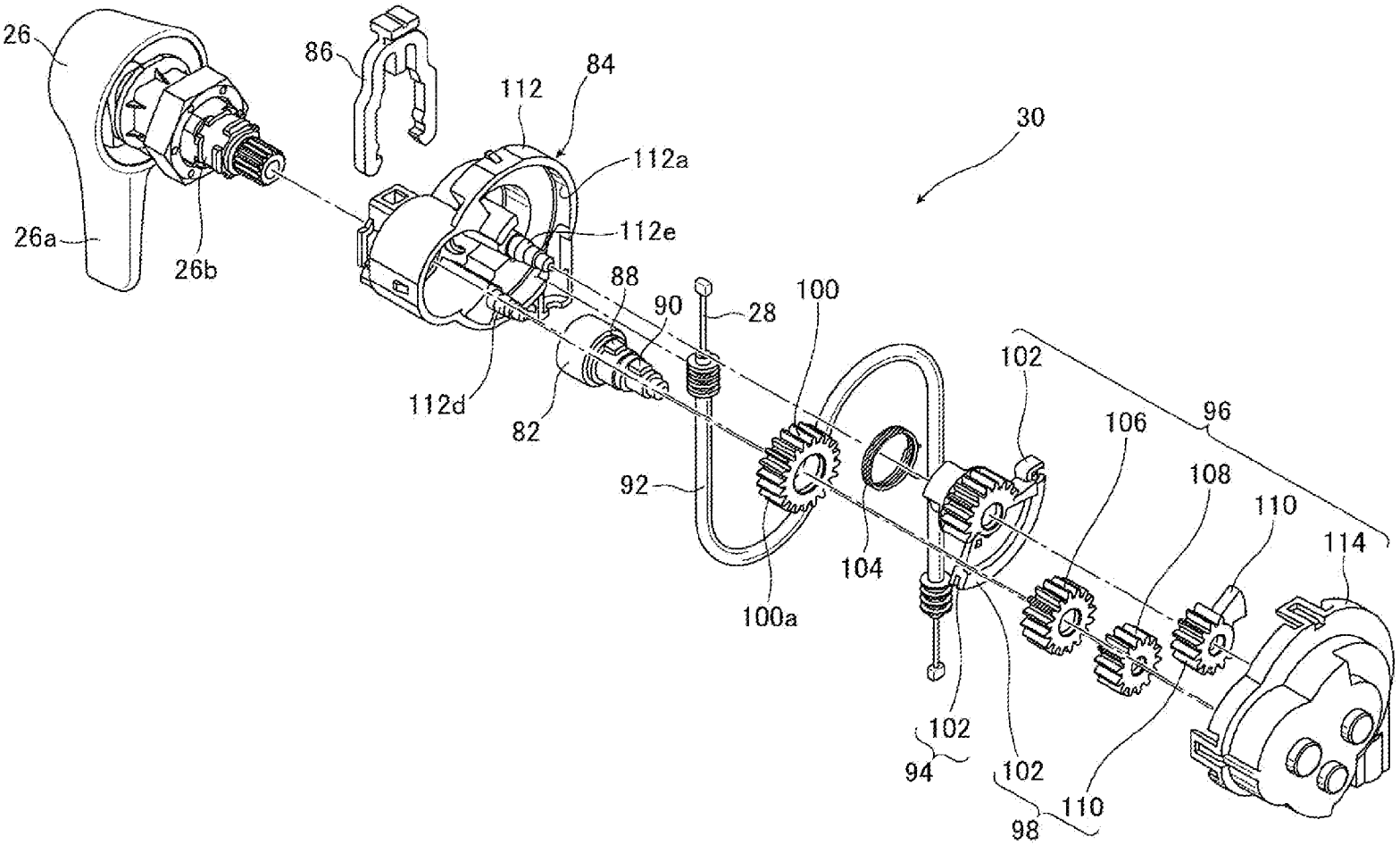
FIG. 4 is an exploded perspective view of the operating device for use with the flush water tank assembly according to the first embodiment of the present invention.
Figure 5:
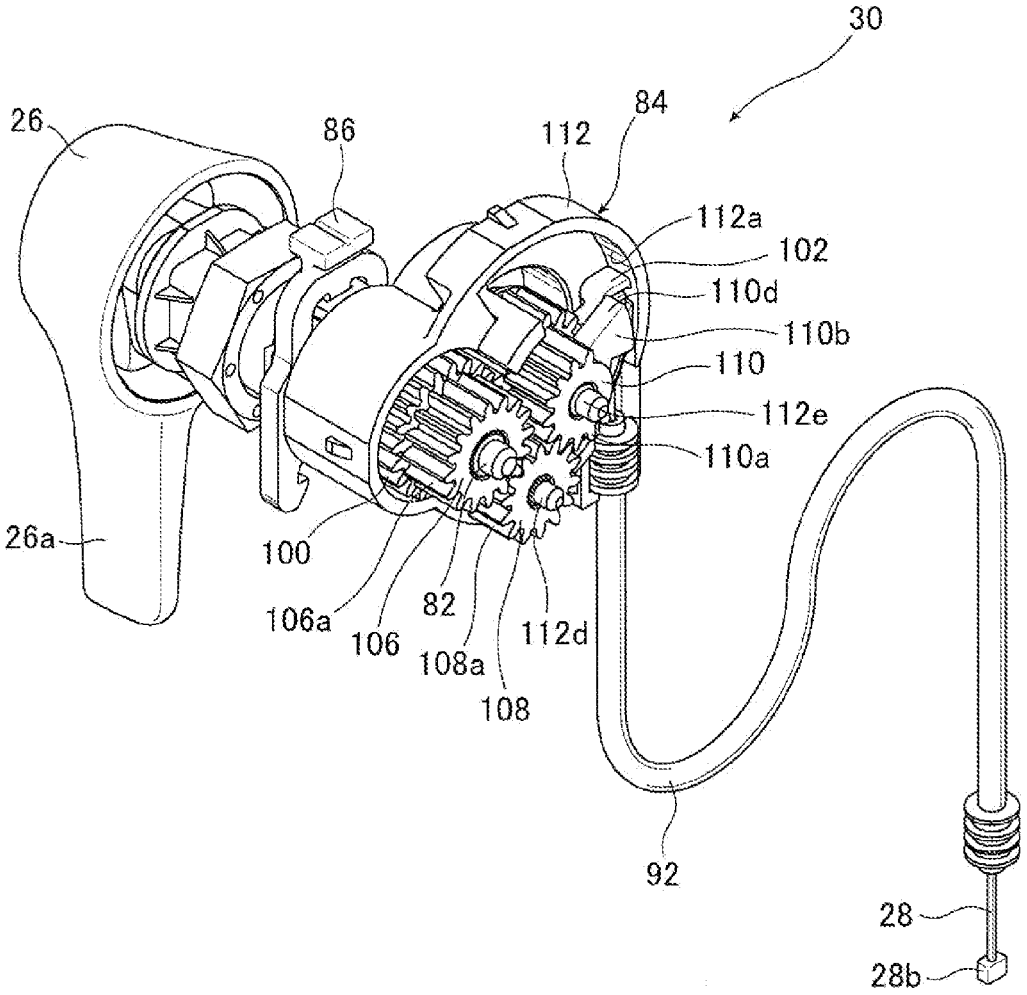
FIG. 5 is a perspective view of the operating device for use with the flush water tank assembly according to the first embodiment of the present invention with a cover cap removed.
Figure 6:
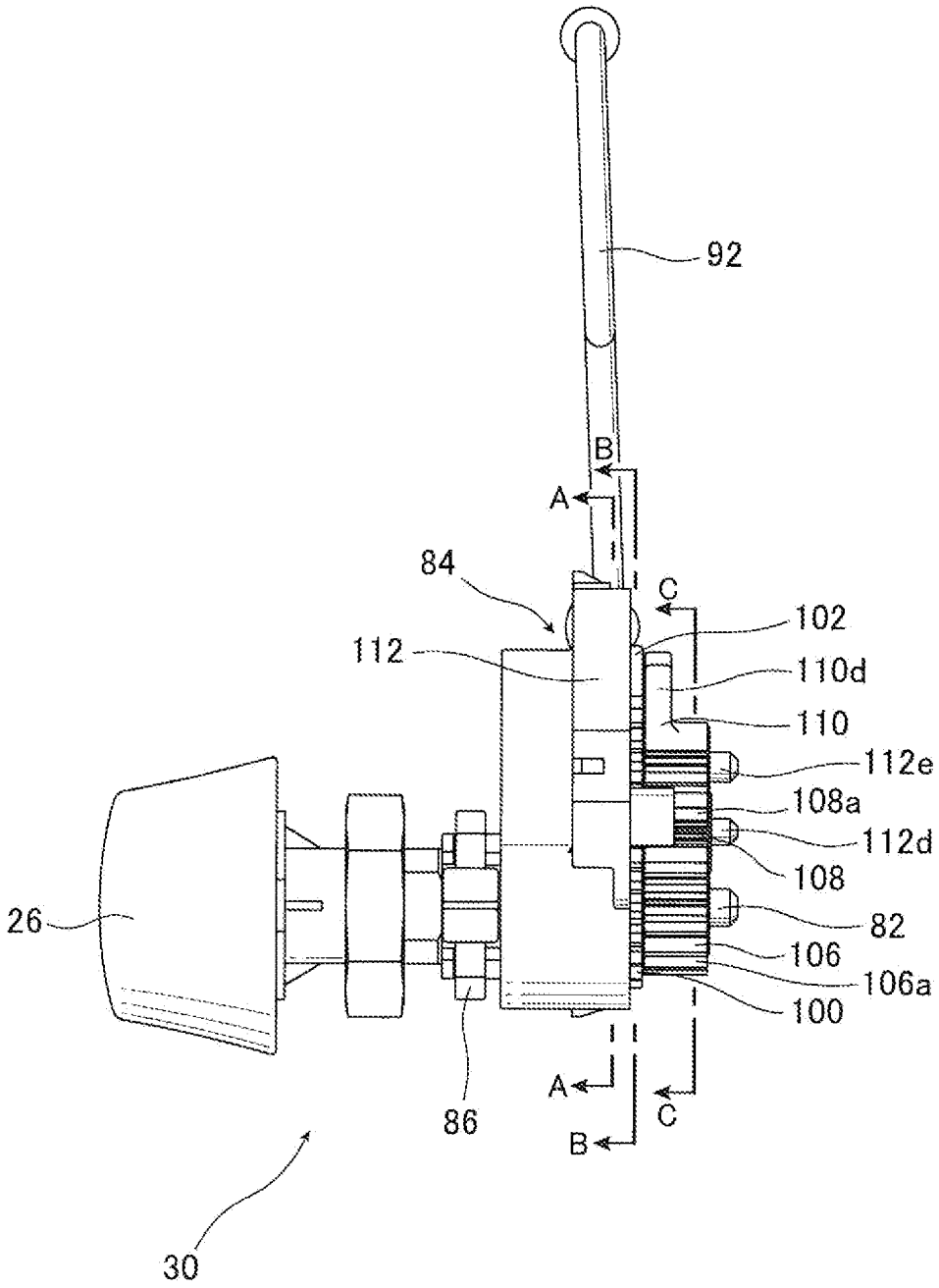
FIG. 6 is a top and partially sectional view of the operating device for use with the flush water tank assembly according to the first embodiment of the present invention.
Figure 7:
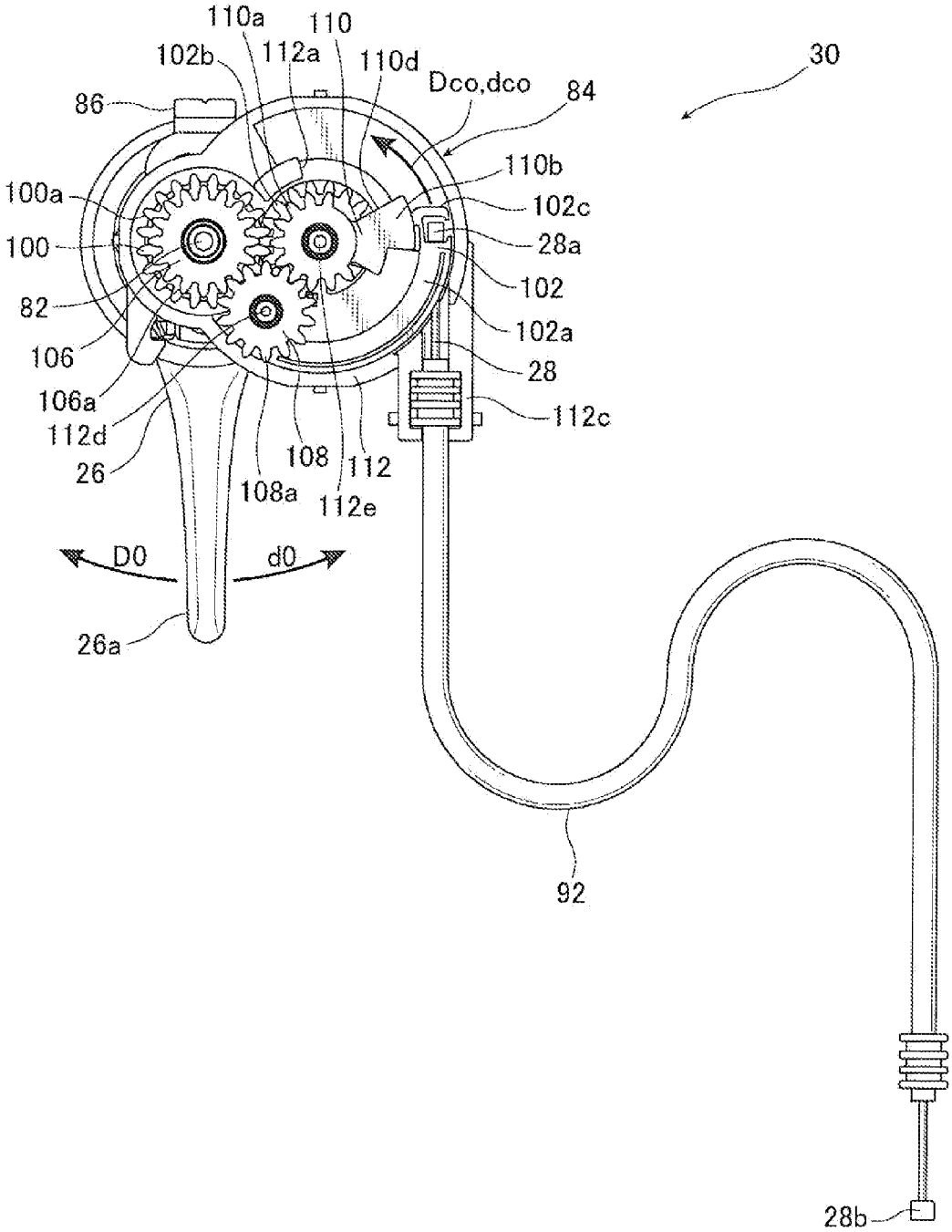
FIG. 7 is a plan view of the operating device for use with the flush water tank assembly according to the first embodiment of the present invention with the cover cap being removed.
Figure 8:
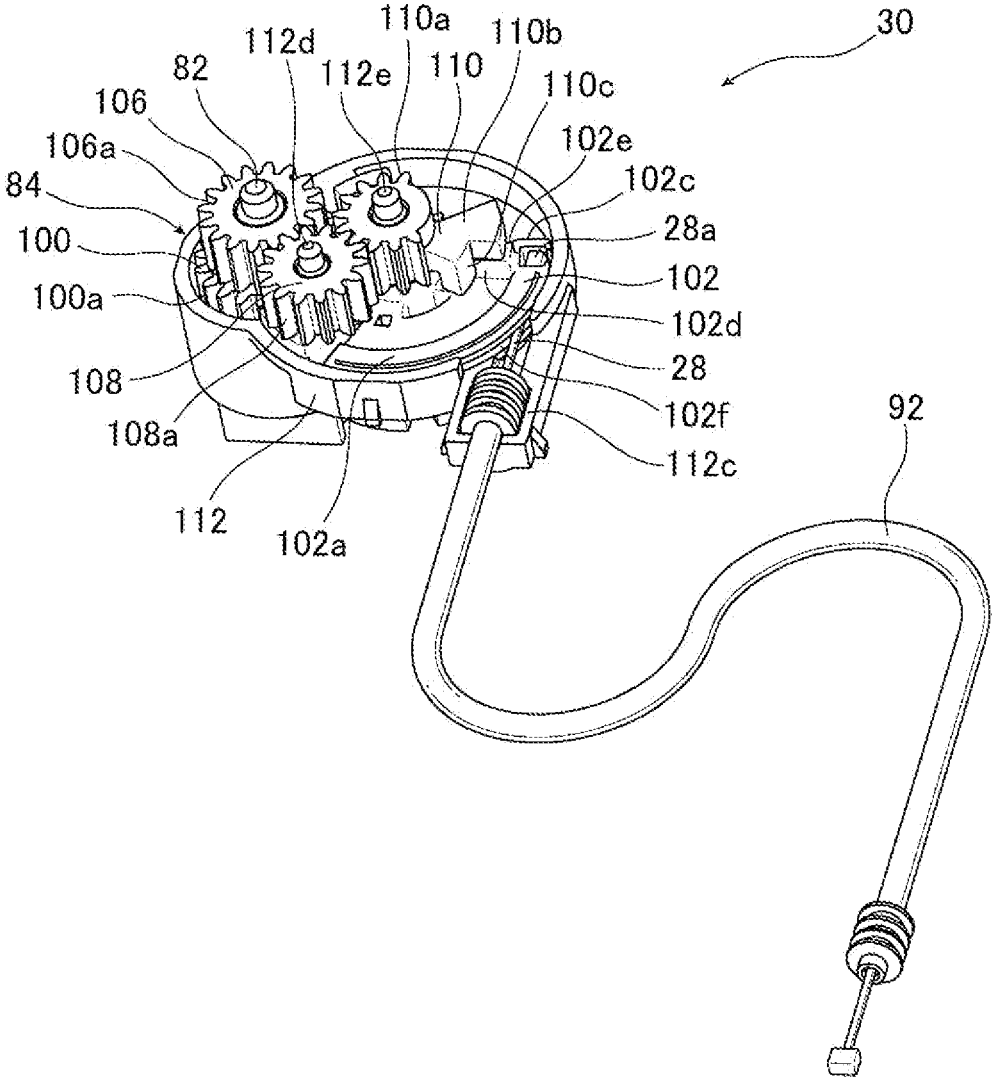
FIG. 8 is a bottom perspective view of the details of the internal structure of a drive unit in the operating device for use with the flush water tank assembly according to the first embodiment of the present invention with the cover cap removed.
Figure 9:
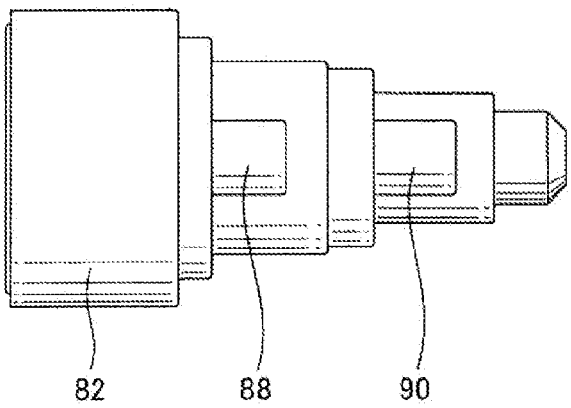
FIG. 9 (*a*) is a side view of a rotating shaft in the operating device for use with the flush water tank assembly according to the first embodiment of the present invention.
Figure 9:
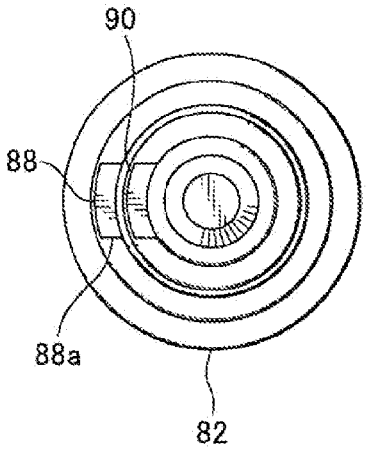

FIG. 4 is an exploded perspective view of the operating device for use with the flush water tank assembly according to the first embodiment of the present invention. FIG. 5 is a perspective view of the operating device for use with the flush water tank assembly according to the first embodiment of the present invention with a cover cap removed. FIG. 6 is a top and partially sectional view of the operating device for use with the flush water tank assembly according to the first embodiment of the present invention. FIG. 7 is a plan view of the operating device for use with the flush water tank assembly according to the first embodiment of the present invention with the cover cap removed. FIG. 8 is a bottom perspective view of the details of the internal structure of a drive unit in the operating device for use with the flush water tank assembly according to the first embodiment of the present invention with the cover cap removed. FIG. 9 (*a*) is a side view of a rotating shaft in the operating device for use with the flush water tank assembly according to the first embodiment of the present invention. FIG. 9 (*b*) is a front view, as viewed in the axial direction, of the rotating shaft of the operating device for use with the flush water tank assembly according to the first embodiment of the present invention.

The operating device for use with the flush water tank assembly according to the first embodiment of the present invention 30 is of the type which is manually rotated by a user in two directional modes. As shown in FIGS. 4 to 8, the operating device 30 of the present invention is disposed in the left-hand side 18*a* of the flush water reservoir tank 18 as viewed in front of the toilet bowl and configured to select either one of the large-scale and small-scale flushing mode when a user rotates in a forward direction (a one direction) or reverse direction (the opposite direction). The operating device 30 comprises a rotating shaft 82 for transmitting the rotation of the operating handle 26 placed outside of the flush water reservoir tank 18 to the internal elements of the flush water reservoir tank 18, the rotating shaft 82 being rotated in the forward or reverse direction depending on the rotation of the operating handle 26, a retaining ring 86 for clamping the rotating shaft 82, operating handle 26 and drive unit 84 together, and an operating wire 28 connecting the drive unit 84 with the water discharge valve device 24, the operating wire 28 being configured to move mechanically the valve body 56 depending on the movement of the operating wire 28 such that the amount of flush water delivered to the toilet main unittoilet main unit 2 will be changed to either one of two amounts for the large-scale and small-scale flushing modes. The drive unit 84 of the operating device 30 is disposed in the interior of the flush water reservoir tank 18 and connected to the rotating shaft 82 and operating wire 28, so that the drive unit 84 can move upwardly the operating wire 28 on the rotation of the rotating shaft 82.

The operating handle 26 is of left operating handle mounted on the left side 18*a* of the flush water reservoir tank 18. The operating handle 26 comprises a grip 26*a* extending downwardly in the vertical direction from the side of the flush water reservoir tank 18 and manually rotated by the user in the forward and backward directions, and a handle guide portion 26*b* supporting and guiding the rotation of the operating handle 26. Accordingly, the user can rotate the grip 26*a* forwardly or backwardly of the toilet main unittoilet main unit 2 to cause the operating handle 26 to rotate the rotating shaft 82 forwardly or reversely. Alternatively, the operating handle 26 may be a right side operating handle so as to be mounted on the right side of the flush water reservoir tank 18.

According to an alternative embodiment of the present invention, the rotating shaft of the operating device may be connected to an electric drive such as an electric motor which is controlled by a controller so that the rotating shaft can be rotated freely in the predetermined one direction or counter direction.

The first embodiment of the present invention is configured to perform a large-scale flushing operation when the user rotates the operating handle 26 through its grip 26*a* in the forward direction of rotation D0, the front side direction of rotation toward which the user rotates the grip 26*a* of the operating handle 26 is the forward direction of rotation D0, as shown in FIG. 7. This embodiment is configured to perform a small-scale flushing operation when the user rotates the operating handle 26 through its grip 26*a* in the reverse direction of rotation d0, the back side direction of rotation toward which the user rotates the grip 26*a* of the operating handle 26 is the reverse direction of rotation d0. The forward and reverse directions of rotation of the operating handle 26 may be alternated with each other. For example, the forward direction of rotation may be determined such that the grip 26*a* of the operating handle 26 is rotated forwardly to perform the small-scale flushing operation. The reverse direction of rotation may be determined such that the grip 26*a* of the operating handle 26 is rotated backwardly to perform the large-scale flushing operation. Furthermore, for example, the reverse direction of rotation may be determined such that the grip 26*a* of the operating handle 26 is rotated forwardly to perform the small-scale flushing operation. The forward direction of rotation may be determined such that the grip 26*a* of the operating handle 26 is rotated forwardly to perform the large-scale flushing operation.

The rotating shaft 82 penetrates from outside to inside of the flush water reservoir tank 18 and extends horizontally in the right and left direction of the flush water reservoir tank 18 along the longitudinal axis thereof. The rotating shaft 82 is engaged with the operating handle 26 outside of the flush water reservoir tank 18 and operatively connected to the drive unit 84 inside of the flush water reservoir tank 18 to extend into the interior of the drive unit 84.

The rotating shaft 82 has a first engagement part 88 formed in a step-like configuration on the outer periphery thereon and a second engagement part 90 formed into a step-like configuration on the outer periphery thereof at a position located more inwardly of the flush water reservoir tank 18 than the first engagement part 88.

When the rotating shaft 82 is rotated in the forward direction, the first engagement part 88 is configured such that one side 88*a* of the projecting step as viewed in the forward direction of rotation abuts against a first inner projection 100*b*, which will be described later, to rotate a first rotary gear member 100 together with the rotating shaft 82 in an interlocking manner.

When the rotating shaft 82 is rotated in the reverse direction, the second engagement part 90 is configured such that one side 90*a* of the projecting step as viewed in the reverse direction of rotation abuts against a second inner projection 106*b*, which will be described later, to rotate a second rotary gear member 106 together with the rotating shaft 82 in an interlocking manner.

The operating wire 28 extends into the interior of the drive unit 84 through the open end of a flexible tube 92 extending from the interior of the drive unit 84 into the water discharge valve device 24. The operating wire 28 is disposed for sliding within the tube 92.

With reference to FIGS. 4 to 9, the drive unit 84 of the operating device 30 in the flush water tank assembly according to the first embodiment of the present invention will be described schematically.

As can be seen from FIG. 4, the drive unit 84 of the operating device 30 according to the first embodiment of the present invention comprises a rotary wind-up mechanism 94 which has a radius of rotation greater than that of the rotating shaft 82 and can wind up the operating wire 28 along a common direction of rotation Dco, dco, a rotary direction changing mechanism 96 for changing the direction of rotation transmitted from the rotating shaft 82 to the rotary wind-up mechanism 94 so that the direction of rotation Dco, dco defines always a predetermined same (common) direction of rotation when the rotating shaft 82 is rotated in either one of the forward and reverse directions, and a limiting mechanism 98 for limiting the angle of rotation of the rotary wind-up mechanism 94 such that the angle of rotation of the rotary wind-up mechanism 94 when the rotating shaft 82 is rotated in either one of the forward and reverse directions is smaller than the angle of rotation of the rotary wind-up mechanism 94 when the rotating shaft 82 is rotated in the other of the reverse and forward directions.

With reference to FIGS. 4 to 14, the structural details of the rotary wind-up mechanism 94, rotary direction changing mechanism 96 and limiting mechanism 98 in the drive unit of the operating device in the flush water tank assembly according to the first embodiment of the present invention will be described.

Figure 10:
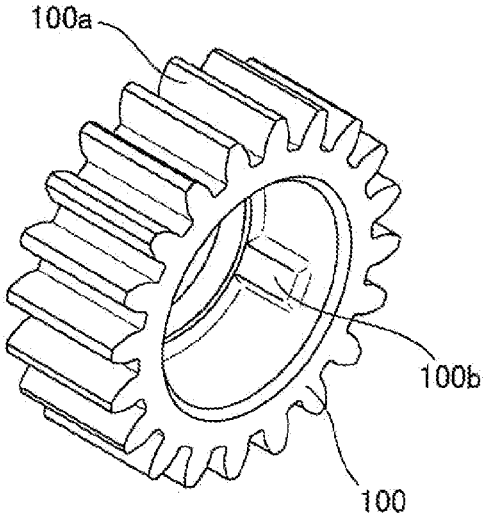
FIG. 10 (*a*) is a perspective view of the first rotary gear member in the operating device for use with the flush water tank assembly according to the first embodiment of the present invention.
Figure 10:
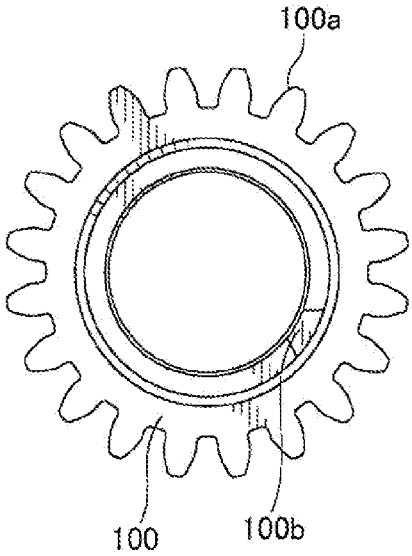
Figure 11:
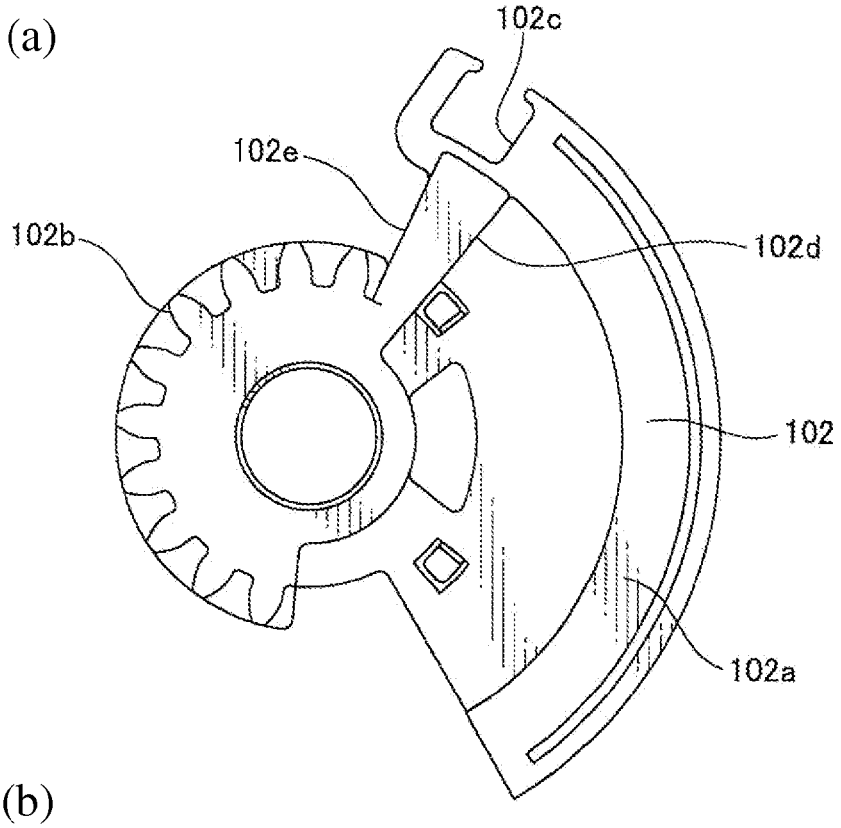
FIG. 11 (*a*) is a front view, as viewed in the axial direction, of a rotary wind-up member in the operating device for use with the flush water tank assembly according to the first embodiment of the present invention.
Figure 11:
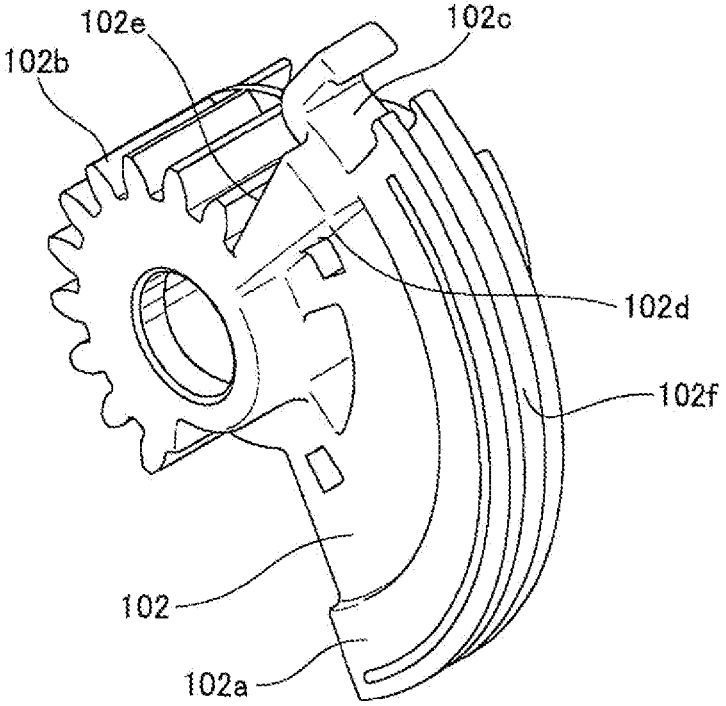
Figure 12:
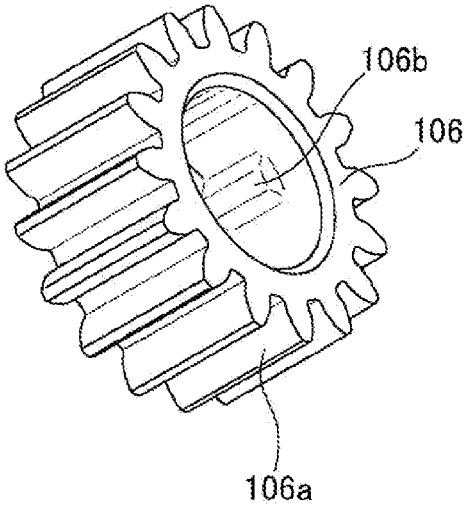
FIG. 12 (*a*) is a perspective view of the second rotary gear member in the operating device for use with the flush water tank assembly according to the first embodiment of the present invention.
Figure 12:
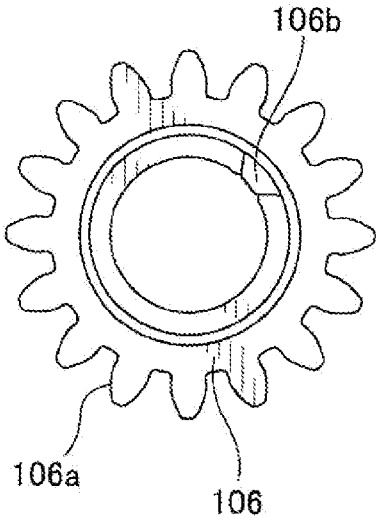
Figure 13:
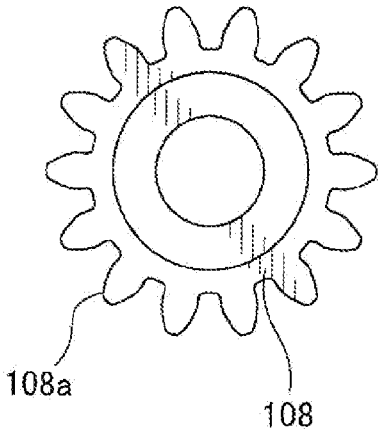
FIG. 13 is a front view of a third rotary gear member in the operating device for use with the flush water tank assembly according to the first embodiment of the present invention.
Figure 14:
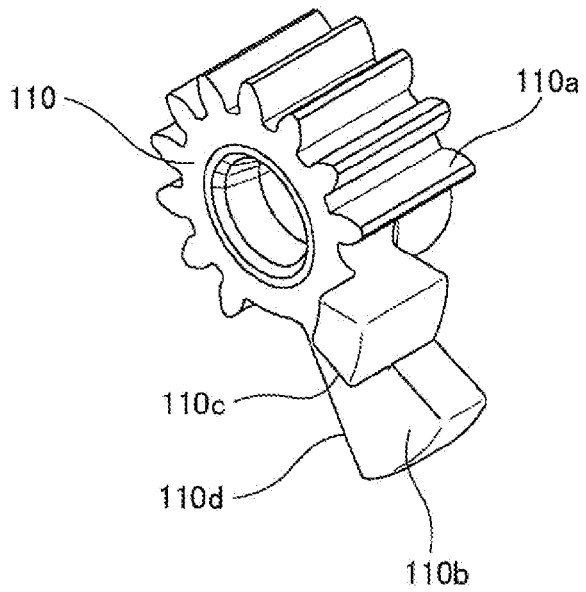
FIG. 14 (*a*) is a perspective view of a rotating abutment member in the operating device for use with the flush water tank assembly according to the first embodiment of the present invention.
Figure 14:
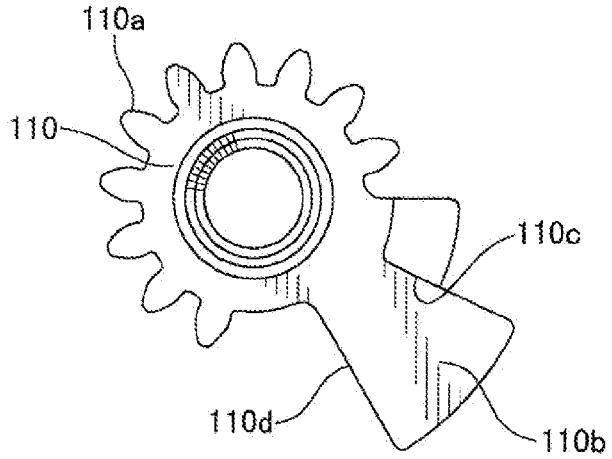
Figure 14:
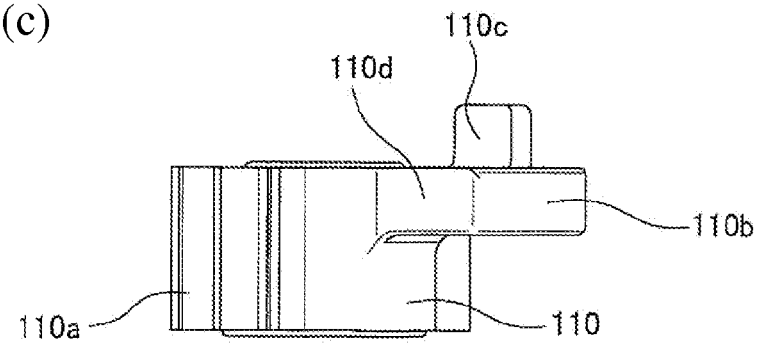

FIG. 10 (*a*) is a perspective view of the first rotary gear member in the operating device for use with the flush water tank assembly according to the first embodiment of the present invention. FIG. 10 (*b*) is a front view, as viewed in the axial direction, of the first rotary gear member in the operating device for use with the flush water tank assembly according to the first embodiment of the present invention. FIG. 11 (*a*) is a front view, as viewed in the axial direction, of a rotary wind-up member in the operating device for use with the flush water tank assembly according to the first embodiment of the present invention. FIG. 11 (*b*) is a perspective view of the rotary wind-up member in the operating device for use with the flush water tank assembly according to the first embodiment of the present invention. FIG. 12 (*a*) is a perspective view of the second rotary gear member in the operating device for use with the flush water tank assembly according to the first embodiment of the present invention. FIG. 12 (*b*) is a front view, as viewed in the axial direction, of the second rotary gear member in the operating device for use with the flush water tank assembly according to the first embodiment of the present invention. FIG. 13 is a front view of a third rotary gear member in the operating device for use with the flush water tank assembly according to the first embodiment of the present invention. FIG. 14 (*a*) is a perspective view of a rotating abutment member in the operating device for use with the flush water tank assembly according to the first embodiment of the present invention. FIG. 14 (*b*) is a front view, as viewed in the axial direction, of the rotating abutment member in the operating device for use with the flush water tank assembly according to the first embodiment of the present invention. FIG. 14 (*c*) is a side view of a rotary abutment member in the operating device for use with the flush water tank assembly according to the first embodiment of the present invention.

The drive unit 84 comprises a first rotary gear member 100 incorporated into the rotary direction changing mechanism 96, a rotary wind-up member 102 incorporated into the rotary wind-up mechanism 94, rotary direction changing mechanism 96 and limiting mechanism 98, a return spring 104 configured to return the rotary wind-up member 102 to its stand-by position when the rotary wind-up member 102 is rotated, a second rotary gear member 106 incorporated into the rotary direction changing mechanism 96, a third rotary gear member 108 incorporated into the rotary direction changing mechanism 96, a rotary abutment member 110 incorporated into the rotary direction changing mechanism 96 and limiting mechanism 98, a cover member 112 of wall-shaped configuration standing inwardly of the flush water reservoir tank 18 to cover the first rotary gear member 100, the rotary wind-up member 102, the return spring 104, the second rotary gear member 106, the third rotary gear member 108 and the outer periphery of the rotary abutment member 110, and a cover cap 114 adapted to mate with the cover member 112 to cover the inside of the flush water reservoir tank 18, the cover cap 114 co-operating with the cover member 112 to form the outer periphery of the drive unit 84.

The operating device 30 according to the first embodiment of the present invention may be mounted on the right side 18*b* of the flush water reservoir tank 18. In such case, the structural features of the operating device 30 may be reversed in the front-to-back arrangement thereof about the internal center of the operating device 30 such that the large-scale flushing operation can be carried out when the user rotates the operating handle forwardly.

The cover member 112 comprises a first stop 112*a* formed on the upper part of the cover member 112, a second stop 112*b* formed on the lower part of the cover member 112, a tube mounting part 112*c* for mounting the tube 92, a third rotary gear member shaft 112*d* for rotatably supporting the third rotary gear member 108, and a wind-up member shaft 112*e* for rotatably supporting the rotary wind-up member 102. The second stop 112*b* can prevent the rotary wind-up member 102 from rotating from the stand-by position in a direction opposite to the wind-up direction (upward direction). Since the second stop 112*b* is disposed to stop the rotary wind-up member 102 at its stand-by position when the rotary wind-up member 102 is rotated in its return direction, the initiate position of the rotary wind-up member 102 can be maintained constant.

The first rotary gear member 100 comprises a first circular gear part 100*a* having external teeth formed on the outer periphery thereon and a first inner protrusion 100*b* inwardly extending from the inner periphery of the first rotary gear member. The first rotary gear member 100 is rotatably mounted on the rotating shaft 82.

Figure 16:
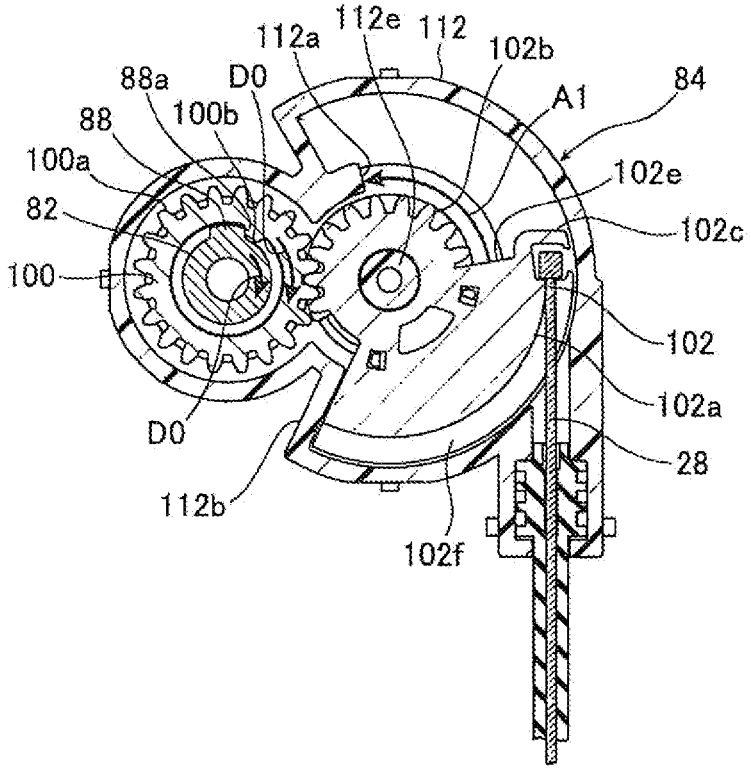
FIG. 16 (*a*) is a cross-sectional view, taken along line A-A in FIG. 6, of the details of the internal structure of the drive unit in the operating device for use with the flush water tank assembly according to the first embodiment of the present invention when the operating handle of the drive unit is its stand-by position before the operating handle is rotated.
Figure 16:
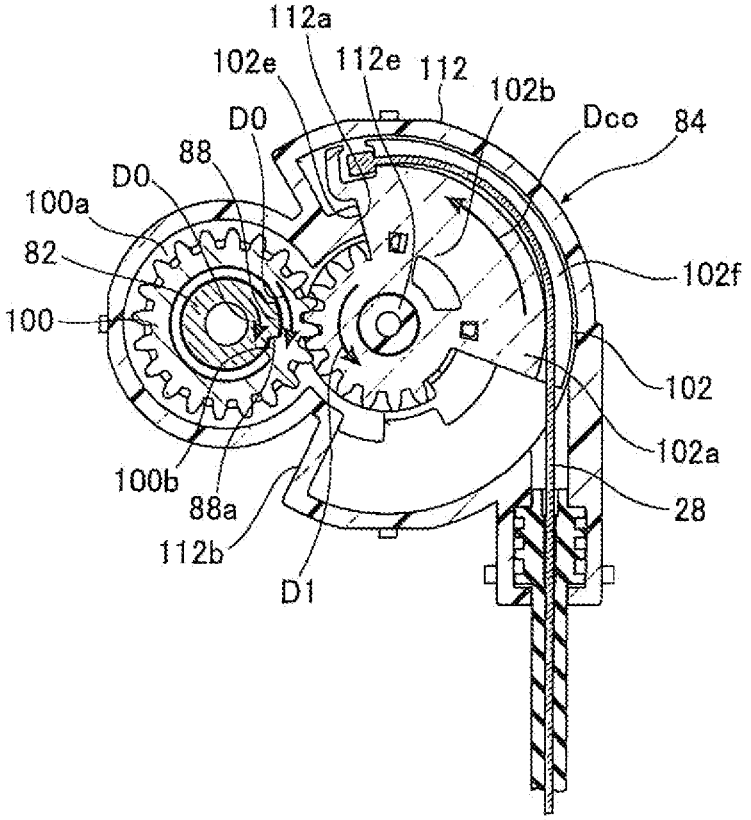

As can be seen from FIG. 16 (*a*), the first inner protrusion 100*b* of the first rotary gear member 100 is disposed on the side of the rotating shaft in its forward direction of rotation to place into engagement with the first engagement part 88 of the rotating shaft 82 when the rotating shaft 82 is rotated in the forward direction and if it is desired to rotate the rotary wind-up member 102.

The first rotary gear member 100 causes the first engagement part 88 of the rotating shaft 82 to urge the first inner protrusion 100*b* in the direction of rotation when the first engagement part 88 is rotated to a position as the first engagement part 88 engages (and pulls) the first inner protrusion 100*b*. At this time, the rotating shaft 82 is rotated together with the first rotary gear member 100 in the same direction of rotation.

In such a manner, the first rotary gear member 100 is rotated together with the rotating shaft 82 in the forward direction of rotation, for example, when the rotating shaft 82 is rotated in the forward direction of rotation. Since the first engagement part 88 of the rotating shaft 82 is rotated in the reverse direction of rotation so that the first engagement part 88 will not be engaged (pulled) by the first inner protrusion 100*b*, for example, when the rotating shaft 82 is rotated in the reverse direction of rotation, only the rotating shaft 82 is rotated while the first rotary gear member 100 is maintained stationary. Accordingly, the first rotary gear member 100 is configured to rotate together with the rotating shaft 82 only in the selected forward direction of rotation.

The rotary wind-up member 102 lifts the operating wire 28 along its own direction of rotation (wind-up direction) Dco, dco. The rotary wind-up member 102 comprises a pulley part 102*a* formed thereof through approximately one-third of the circumferential length of the rotary wind-up member 102 to reel the operating wire 28 up in its own direction of rotation, a sector-shaped wind-up member gear portion 102*b* formed on the rotary wind-up member 102 through approximately two-thirds of the circumferential length of the rotary wind-up member 102 and having external teeth operatively engaged by the first toothed part 100*a*, a mounting part 102*c* formed on the pulley part 102*a* at one end of the circumferential arc for mounting the operating wire 28 on the pulley part 102*a* along its circumferential length, a rotary wind-up member receiving portion 102*d* located on the pulley part 102*a* at a position outwardly of the wind-up member shaft 112*e* for receiving a force rotating the rotary wind-up member receiving portion 102*d*, and a first limiting part 102*e* forming a part of the upper end of the pulley part 102*a* and being engaged by the first stop 112*a* when the rotary wind-up member 102 is rotated to the first angle of rotation A1.

The rotary wind-up member 102 can rotates about the wind-up member shaft 112*e* with the rotary wind-up member 102 having the wind-up member shaft 112*e* passing centrally therethrough. The rotary wind-up member 102 is formed as an integrated rotary member providing the common wind-up member shaft 112*e* for the pulley part 102*a* and wind-up member gear portion 102*b*. Accordingly, the rotary wind-up member 102 causes the wind-up member gear portion 102*b* and the pulley part 102*a* to rotate in the same direction of rotation.

In the rotary wind-up member 102, the radius of curvature (radius of rotation) of the pulley part 102*a* is greater than that of the wind-up member gear portion 102*b* and also than the radius of curvature (radius of rotation) of the rotating shaft 82.

The pulley part 102*a* comprises a groove 102*f* formed along the outer periphery thereof which is recessed in the radially inward direction. Therefore, the operating wire 28 can be wound off positively around the pulley part 102*a* while being received in the groove 102*f*.

The mounting part 102*c* is configured to fit in the drive unit side portion 28*a* of the operating wire 28 at the top end of the outer periphery of the pulley part 102*a*. The mounting part 102*c* is formed in line with the groove 102 which has a C-shaped configuration facing outwardly from the rotary wind-up member 102 as viewed in a plane view as shown in FIG. 7. Therefore, the drive unit side portion 28*a* of the operating wire 28 can fixedly fit in the mounting part 102*c*. Additionally, the operating wire 28 can be wound around the pulley part 102*a* while the pulley part 102*a* can be unwound out of the groove portion of the pulley part 102*a*.

The rotary wind-up member receiving portion 102*d* has a wall face extending upright from the top face of the pulley part 102*a*. Therefore, the first abutment 110*c* of the rotary abutment member 110 is engaged by the rotary wind-up member receiving portion 102*d* when the rotary abutment member 110 is rotated in the wind-up direction.

The first limiting part 102*e* is formed on a part of the upper limit of pulley part 102*a* and adapted to be engaged by the first stop 112*a* when the pulley part 102*a* is rotated in the wind-up direction. Engagement of the first limiting part 102*e* with the first stop 112*a* limits the range of rotation in which the operating wire 28 is wound up in the direction of rotation of the first limiting part 102*e* into a first range of rotation.

Figure 15:
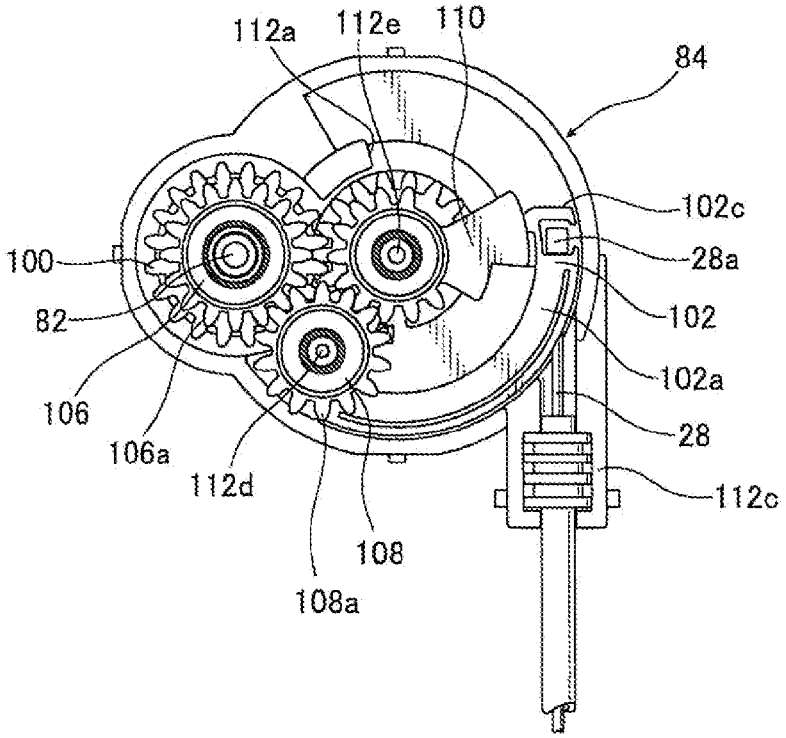
FIG. 15 (*a*) is a front view of the details of the internal structure of the drive unit in the operating device for use with the flush water tank assembly according to the first embodiment of the present invention when the cover cap has been removed and when the drive unit is in its stand-by position before an operating handle is rotated.
Figure 15:
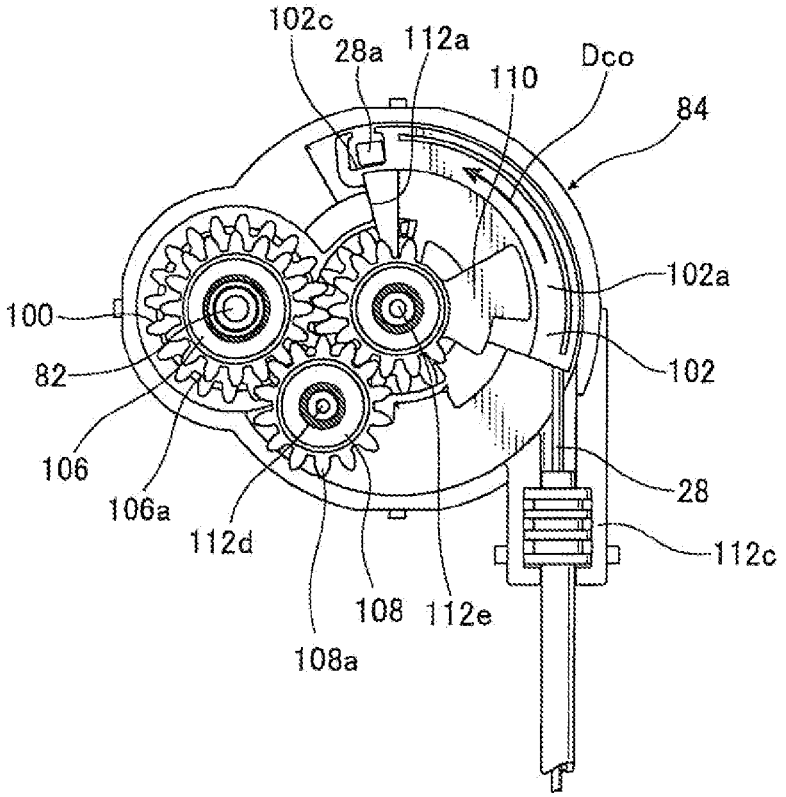

The return spring 104 is a coil spring which is mounted on the outer periphery of the wind-up member shaft 112*e* between the rotary wind-up member 102 and the cover member 112. The return spring 104 provides a return force acting on the rotary wind-up member 102 by which the rotary wind-up member 102 is returned to its stand-by position after it has been rotated from the stand-by position, as shown in FIG. 15(*b*).

The return spring 104 co-operates with the rotary direction changing mechanism 96 providing the same direction of rotation to the rotary wind-up member 102. Thus, the rotary wind-up member 102 can be returned relatively precisely to a predetermined stand-by position by comparison with the arrangement wherein the rotary wind-up member has two directions of rotation.

The second rotary gear member 106 comprises a second gear part 106*a* forming a circular gear and having external teeth on the outer periphery thereon and a second inner protrusion 106*b* extending inwardly of the inner periphery of the second rotary gear member 106. The second rotary gear member 106 is rotatably mounted on the rotating shaft 82. If it is desired to rotate the rotary wind-up member 102 through the second rotary gear member 106 when the rotating shaft 82 is rotated in the reverse direction, as in the first embodiment of the present invention, the second inner protrusion 106*b* of the second rotary gear member 106 can be located at a side opposite the second engagement part 90 of the rotating shaft 82 in the reverse direction of rotation of the rotating shaft. On the other hand, if it is desired to rotate the rotary wind-up member 102 through the second rotary gear member 106 when the rotating shaft 82 is rotated in the forward direction of rotation, the second inner protrusion 106*b* may be located in the forward direction of rotation of the rotating shaft 82 with respect to the second engagement part 90 of the rotating shaft 82.

With the second rotary gear member 106 attached to the rotating shaft 82, when the second engagement part 90 of the rotating shaft 82 is rotated in the reverse direction to be engaged (or hooked) by the second inner protrusion 106*b*, the second engagement part 90 acts to push the second inner protrusion 106*b* in the direction of rotation (reverse direction of rotation) of the second engagement part 90. Thus, the second rotary gear member 106 is rotated together with the rotating shaft 82 in the same direction of rotation. In such a manner, the second rotary gear member 106 is mounted on the rotating shaft 82 so that they can rotate together, if the rotating shaft 82 is rotated in either one of the forward and reverse directions of rotation, for example, when the rotating shaft 82 is rotated in the reverse direction of rotation.

On the other hand, only the rotating shaft 82 is idled and the second rotary gear member 106 is maintained in the non-rotating state since the second engagement part 90 of the rotating shaft 82 is rotated in the forward direction of rotation and thus is not engaged (or pulled) by the second inner protrusion 106*b*, if the rotating shaft 82 is rotated in either one of the forward or reverse directions of rotation, for example, when the rotating shaft 82 is rotated in the forward direction of rotation.

Therefore, the second rotary gear member 106 is adapted to be rotated together with the rotating shaft 82 only in the reverse direction of rotation.

The third rotary gear member 108 comprises a third toothed part 108*a* having external teeth formed thereon. This third toothed part 108*a* is adapted to be engaged by the second toothed part 106*a* so that the third toothed part 108*a* is rotated around the third rotary gear member shaft 112*d*. The third rotary gear member 108 is rotatably mounted on the third rotary gear member shaft 112*d*. The third toothed part 108*a* of the third rotary gear member 108 has the direction of rotation opposite to that of the second toothed part 106*a*.

The rotary abutment member 110 comprises an abutment member gear portion 110*a* having external teeth formed on the circumference thereof over the length of approximately three-fourths of the outer periphery thereof to engage with the third toothed part 108*a*, and a rotation abutment 110*b* formed on the circumference thereof over the length of approximately a quarter of the outer periphery of the rotary abutment member 110.

The rotary abutment 110*b* is also provided with a first abutment 110*c* engaged by the rotary wind-up member receiving portion 102*d* of the rotary wind-up member 102 to rotate the rotary wind-up member 102 in the same direction as the direction of rotation of the rotary abutment 110*b*, and a second limiting part 110*d* engaged by the first stop 112*a* when the rotary abutment 110*b* is rotated to a second angle of rotation A2 which is smaller than the first angle of rotation A1.

The rotary abutment member 110 is located above the wind-up member 102 and rotatably mounted around the wind-up member shaft 112*e*. The rotary abutment member 110 is formed as an integral rotating member comprising the abutment member gear portion 110*a*, first abutment 110*c* and second limiting part 110*d* which have rotate about the common wind-up member shaft 112*e*. Therefore, the rotary abutment member 110*a* is adapted to be rotated in the same direction of rotation as the direction of rotation of the rotary abutment 110*b*.

The abutment member gear portion 110*a* is formed as a partial circle-shaped (sector-shaped or partial circle-shaped) gear.

Figure 21:
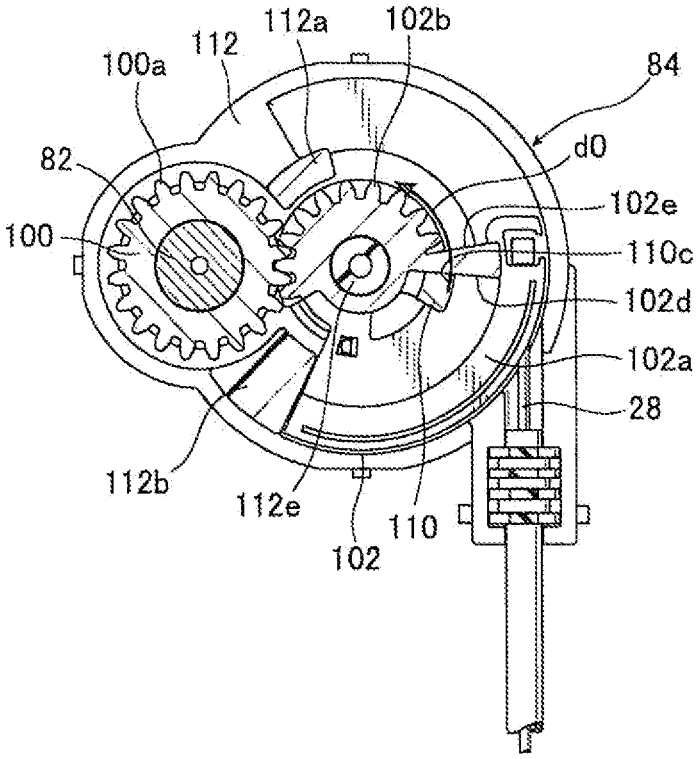
FIG. 21 (*a*) is a cross-sectional view, taken along line B-B in FIG. 6, of the details of the internal structure of the drive unit in the operating device for use with the flush water tank assembly according to the first embodiment of the present invention when the operating handle of the drive unit is its stand-by position before the operating handle is rotated.
Figure 21:
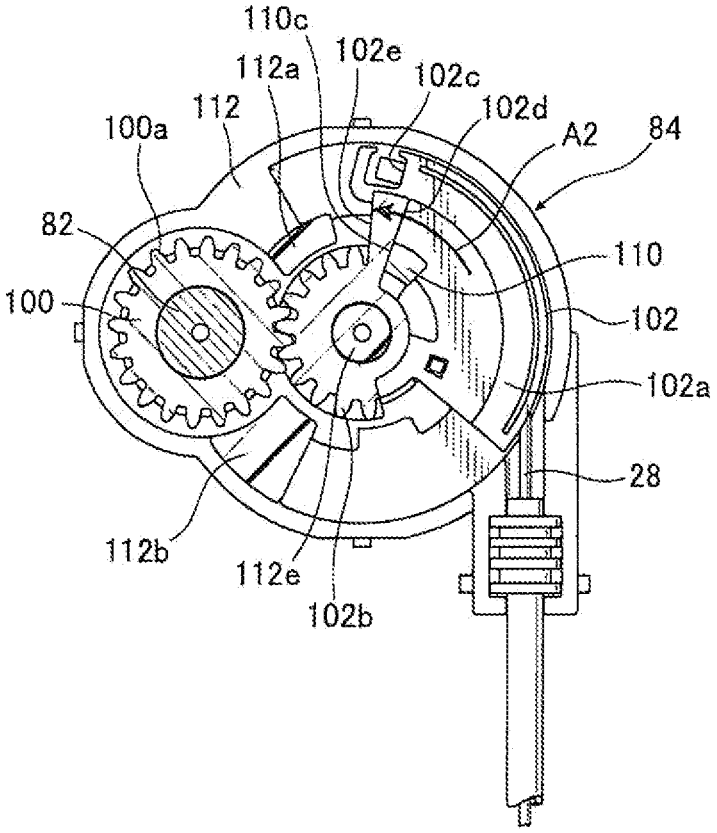

The first abutment part 110*c* is configured to define a part having the radius from the wind-up member shaft 112*e* to the first abutment 110*c* which is substantially the same as the radius from the wind-up member shaft 112*e* on the rotary wind-up member 102 to the rotary wind-up member receiving portion 102*d* and further to extend from the rotary abutment 102 outwardly of the flush water reservoir tank of the wind-up member shaft 112*e* (or in the direction of movement of the rotary wind-up member). Therefore, the first abutment 110*c* is engaged by the rotary wind-up member receiving portion 102*d* to pull the rotary wind-up member receiving portion 102*d* so that the rotary wind-up member 102 is rotated in the forward direction, when the rotary abutment member 110 is rotated in the forward direction, as shown in detail in FIG. 21.

The second limiting part 110*d* forms the top wall of the rotary abutment member 110, which top wall extends forwardly of the first limiting part 102*e* on the top end of the rotary wind-up member 102 as viewed in the direction of rotation when the rotary abutment member 110 is rotated together with the rotary wind-up member 102 in the forward direction. That is to say, the second limiting part 110*d* provides a further limiting part forwardly of the first limiting part 102*e* as viewed in the direction of rotation when the rotary abutment member 110 is engaged by the rotary wind-up member 102. Therefore, the second limiting part 110*d* is engaged by the first stop 112*a* to stop and limit the rotation of the rotary abutment member 110 and rotary wind-up member 102 when the rotary abutment member 110 is rotated together with the rotary wind-up member 102 in the forward direction. Therefore, the limitation of the rotation of the rotary wind-up member 102 causes the limitation of the range of movement in the operating wire 28.

As can be understood, the drive unit 84 may include any mechanisms which rotate the rotary wind-up member 102 in the same direction of rotation Dco, dco in combination with the other gear member or the other mechanism, in addition of the above-mentioned combination of gear members.

The first rotary gear member 100 and rotary wind-up member 102 can be incorporated into a speed increasing mechanism for increasing the angle of rotation of the rotary wind-up member 102 relative to the angle of rotation of the operating handle 26. The speed increasing mechanism is configured to provide a gear ratio (ratio between each number of respective gear teeth of two meshing gears) between the first toothed part 100*a* and the wind-up member gear portion 102*b*, which gear ratio increases the angle of rotation of the rotary wind-up member 102 greater than the angles of rotation of the rotating shaft 82 and first rotary gear member 100 which are rotated by the operating handle 26.

Additionally, the second rotary gear member 106, third rotary gear member 108, rotary abutment member 110 and rotary wind-up member 102 may be incorporated into a speed increasing mechanism for increasing the rotation angle in the rotary wind-up member 102 greater than the angle of rotation of the operating handle 26. The speed increasing mechanism is configured to provide a gear ratio (ratio between each number of respective gear teeth of two meshing gears) between the second toothed part 100*a* and the wind-up member gear portion 102*b*, which gear ratio increases the angle of rotation of the rotary wind-up member 102 relative to the angles of rotation of the rotating shaft 82 and second rotary gear member 106 which are rotated by the operating handle 26.

On the contrary, the first rotary gear member 100 and rotary wind-up member 102 may be incorporated into a speed reducing mechanism for reducing the angle of rotation of the rotary wind-up member 102 lower than the angle of rotation of the operating handle 26. The speed reducing mechanism is configured to provide a gear ratio (ratio between each number of respective gear teeth of two meshing gears) between the first toothed part 100*a* and the wind-up member gear portion 102*b*, which gear ratio reduces the angle of rotation of the rotary wind-up member 102 relative to the angles of rotation of the rotating shaft 82 and first rotary gear member 100 which are rotated by the operating handle 26.

Additionally, the second rotary gear member 106, third rotary gear member 108, rotary abutment member 110 and rotary wind-up member 102 may be incorporated into a speed reducing mechanism for reducing the rotation angle in the rotary wind-up member 102 relative to the angle of rotation of the operating handle 26. The speed reducing mechanism is configured to provide a gear ratio (ratio in the number of the gear teeth) between the second toothed part 106*a* and the wind-up member gear portion 102*b*, which gear ratio reduces the angle of rotation of the rotary wind-up member 102 relative to the angles of rotation of the rotating shaft 82 and second rotary gear member 106 which are rotated by the operating handle 26.

As aforementioned, in the drive unit 84, the first rotary gear member 100 and rotary wind-up member 102 may be incorporated into a speed increasing mechanism or speed reducing mechanism, since the wind-up member shaft 112*e* of the rotary wind-up member 102 is mounted on another shaft separate from the rotating shaft 82. Furthermore, the second rotary gear member 106, third rotary gear member 108, rotary abutment member 110 and rotary wind-up member 102 may be incorporated into a speed increasing mechanism or speed reducing mechanism. Therefore, the drive unit 84 may have either one of the speed increasing mechanism and speed reduction mechanism even if the operating handle 26 is rotated in either the forward or reverse direction of rotation.

With reference to FIGS. 15 to 18, operation (function) the operating device for use with the flush water tank assembly according to the first embodiment of the present invention will now be described.

First of all, referring to FIGS. 15 to 18, the large-scale flushing mode is explain below which is performed by the flush water tank assembly comprising the operating device for use with the flush water tank assembly according to the first embodiment of the present invention and a flush toilet equipped with such flush water tank assembly.

As shown in FIG. 15 (*a*), the operating handle 26 is positioned in a lower stand-by position in the vertical direction before it is actuated by a user. As can be best seen in FIGS. 3 and 15(*a*), the rotary wind-up member 102 of the drive unit 84 is in its stand-by position (initial position) and the valve body 56 connected to the operating wire 28 closes the water discharge port 46. At this time, the initial pooled water-level in the flush water reservoir tank 18 is full-level WL (FIG. 3).

When the user wishes to start the large-scale flushing operation in such a stand-by state as shown in the FIG. 15 (*a*), the user rotates the operating handle 26 from its stand-by position in the forward direction of rotation D0 by forwardly pulling the grip 26*a* of the operating handle 26. If the operating handle 26 is rotated in the forward direction of rotation, the rotating shaft 82 connected to the operating handle 26 is rotated in the forward direction.

As can be seen in FIGS. 16 (*a*) and (*b*), as the rotating shaft 82 is rotated in the direction of rotation D0, the first engagement part 88 of the rotating shaft 82 is engaged by the first inner protrusion 100*b* of the first rotary gear member 100 to rotate the rotating shaft 82 and first rotary gear member 100 together in the direction of rotation D0. The wind-up member gear portion 102*b* engaging with the first toothed part 100*a* is rotated together with the first toothed part 100*a* in the reverse direction. Therefore, the rotary wind-up member 102 is rotated in the reverse direction of rotation D1 (=Dco) opposite to the direction of rotation D0 of the rotating shaft 82. This reverse direction of rotation D1 becomes the common direction of rotation Dco. As will be described below, the rotary wind-up member 102 will wind up the operating wire 28 always in the same and common direction of rotation (pull-up direction) Dco independently of the direction of rotation of the operating handle 26.

Figure 17:
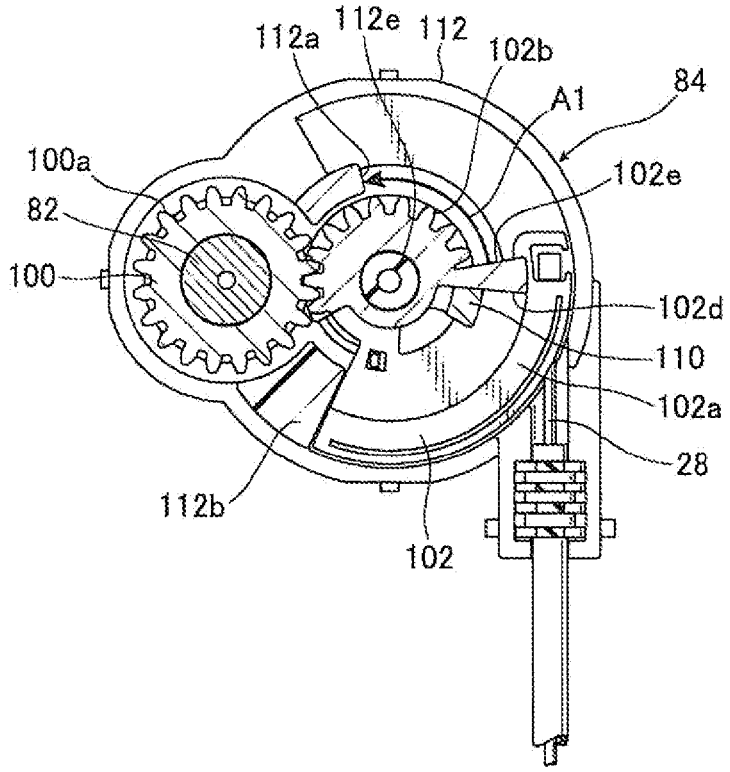
FIG. 17 (*a*) is a cross-sectional view, taken along line B-B in FIG. 6, of the details of the internal structure of the drive unit in the operating device for use with the flush water tank assembly according to the first embodiment of the present invention when the operating handle of the drive unit is in its stand-by position before being rotated.
Figure 17:
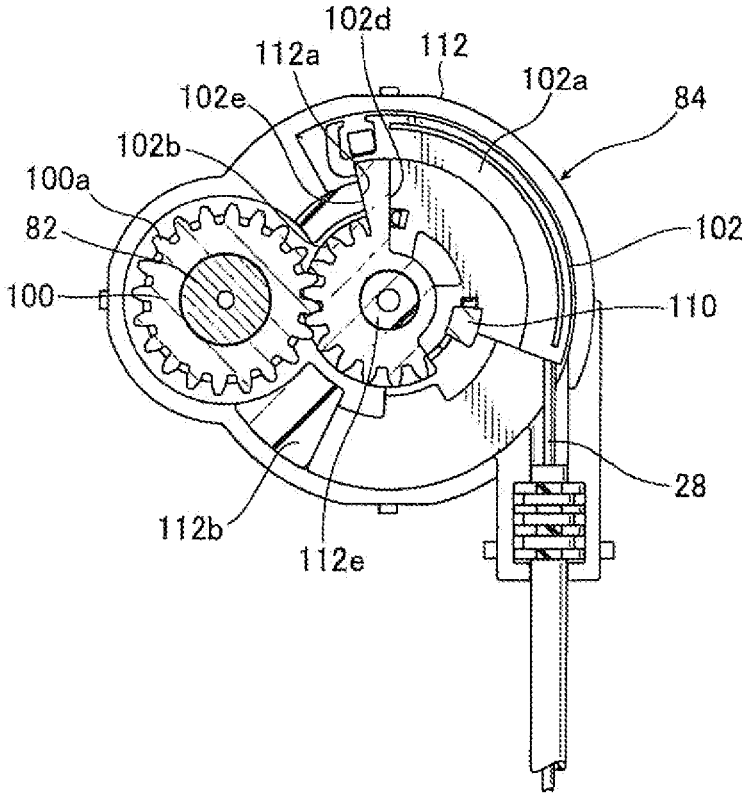
Figure 18:
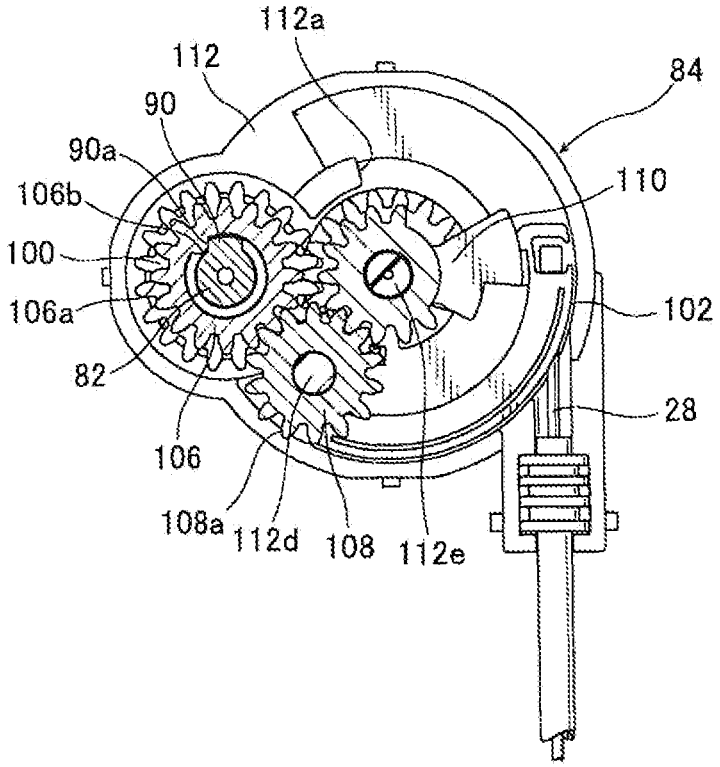
FIG. 18 (*a*) is a cross-sectional view, taken along line C-C in FIG. 6, of the details of the internal structure of the drive unit in the operating device for use with the flush water tank assembly according to the first embodiment of the present invention when the operating handle of the drive unit is its stand-by position before the operating handle is rotated.
Figure 18:
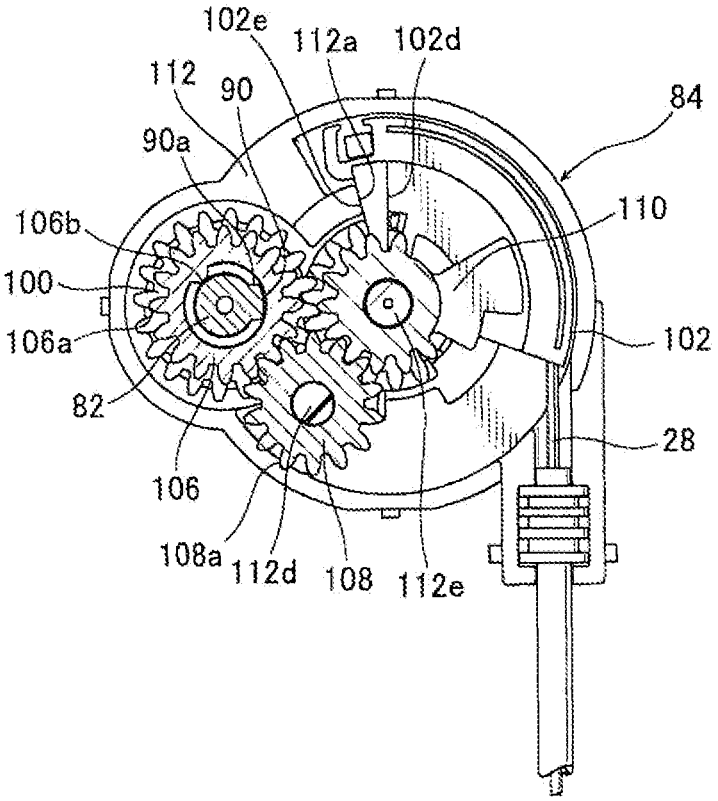

When the rotating shaft 82 is rotated in the forward direction in such a manner, the second engagement part 90 of the rotating shaft 82 does not engage the second inner protrusion 106*b* of the second rotary gear member 106, but rotates in the forwardly (idles), as shown in FIGS. 18 (*a*) and (*b*). As shown in FIGS. 17 (*b*) and 18 (*b*), consequently, the second rotary gear member 106 is not rotated, resulting in the third rotary gear member 108 engaging with the second rotary gear member 106 not rotated, and also the rotary abutment member 110 engaging with the third rotary gear member 108 not rotated. These members are maintained at their stand-by positions. At this time, the rotary abutment member 110 does not act on the rotary wind-up member 102 which performs the wind-up operation in the direction of rotation Dco independently of the rotary abutment member 110.

As the rotary wind-up member 102 is rotated in the direction of rotation Dco, the pulley part 102*a* is upwardly rotated in the direction of rotation Dco to wind up the operating wire 28 mounted on the mounting part 102*c*. When the end 28*a* of the operating wire 28 within the drive unit is pulled up along the groove 102*f* on the outer periphery of the pulley part 102*a*, the valve body 56 mechanically connected to the opposite flush valve end 28*b* of the operating wire 28 is upwardly moved to drain the flush water reservoir tank 18.

As can be seen in FIGS. 16 (*b*), 17 (*b*) and so on, the rotation of the pulley part 102*a* is limited and stopped when the first limiting part 102*e* is engaged by the first stop 112*a*. That is to say, the pulley part 102*a* is rotated to the first rotation angle A1 corresponding to the first range of rotation, and the amount of pull up in the operating wire 28 determined by the angle of rotation of the pulley part 102*a* is set at a relatively large level. Therefore, the valve body 56 of the water discharge valve device 24 can be moved to a relatively high position h1. As a result, the large-scale flushing mode is performed in which the amount of flush water supplied to the toilet bowl from the flush water reservoir tank 18 is relatively increased.

Since the amount of flush water discharged from the flush water reservoir tank 18 varies when the amount of pull up in the operating wire 28 directly moving the valve body 56 of the water discharge valve device 24 varies, it is required to control the amount of pull up in the operating wire 28 precisely. According to the present invention, the rotary wind-up member 102 can be operated always in the same direction of wind-up (Dco, dco) to return the rotary wind-up member 102 relatively precisely to its stand-by position (initial position). As a result, variation in the rotation of the rotary wind-up member 102 can be reduced for each flushing operation to reduce variation in the amount of pull up of the operating wire 28. Consequently, the pull up of the operating wire 28 can be controlled relatively precise.

Variation in the rotation of the rotary wind-up member 102 can be reduced also using the first and second stops 112*a* and 212*b*.

When the user releases the operating handle 26, the rotary wind-up member 102 is rotated to return to the initial stand-by position under action of the return spring. At the same time, the first rotary gear member 100 is also rotated to return, thereby causing the operating handle 26 to return to its initial stand-by position. As a result, the rotary wind-up member 102 is returned to its initial stand-by position. When the valve body 56 connected to the operating wire 28 closes the water discharge port 46, the drainage through the water discharge valve device 24 is terminated. Subsequently, a predetermined water feed is performed to fill the flush water reservoir tank 18 to the full water-level WL. In such a manner, the flush water tank assembly 16 will be returned to its initial stand-by state before the operating handle 26 is actuated.

With reference to FIGS. 19 to 22, the small-scale flushing mode will now be described which is performed by the flush water tank assembly comprising the operating device for use with the flush water tank assembly according to the first embodiment of the present invention and a flush toilet equipped with such flush water tank assembly.

Figure 19:
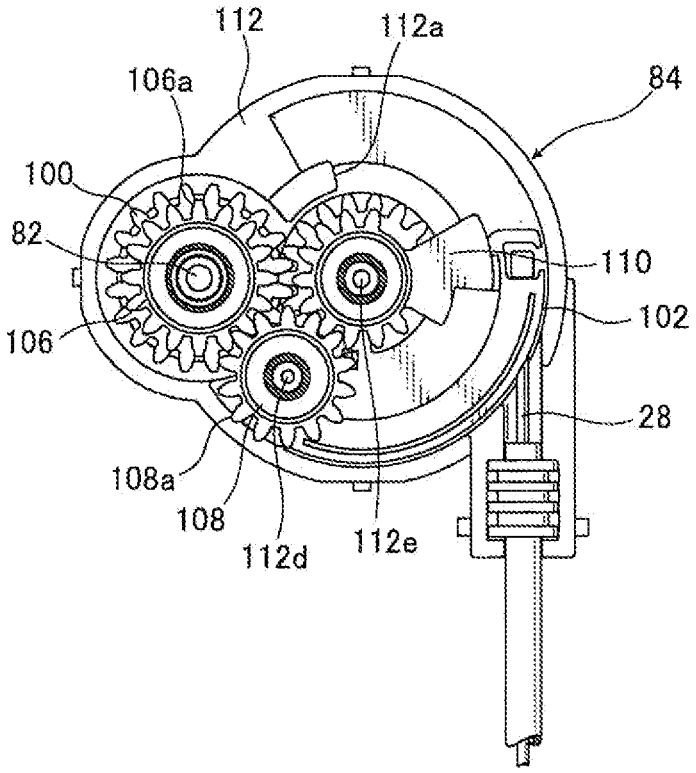
FIG. 19 (*a*) is a front view of the details of the internal structure of the drive unit in the operating device for use with the flush water tank assembly according to the first embodiment of the present invention when the cover cap has been removed and when the operating handle of the drive unit is in its stand-by position before being rotated.
Figure 19:
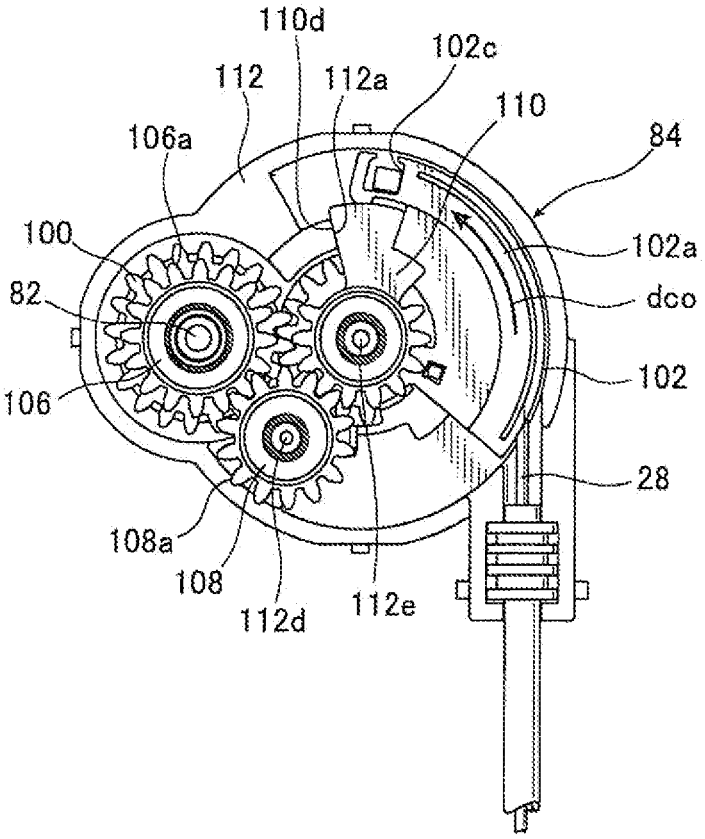

Since the conditions of the flush water tank assembly 16 and drive unit 84 before the user begins to actuate the operating handle 26 to perform the small-scale flushing mode as shown in FIG. 19 (*a*) are equal to those of the flush water tank assembly 16 and drive unit 84 in the large-scale flushing mode shown in FIG. 15 (*a*), they will not be described repeatedly.

Figure 22:
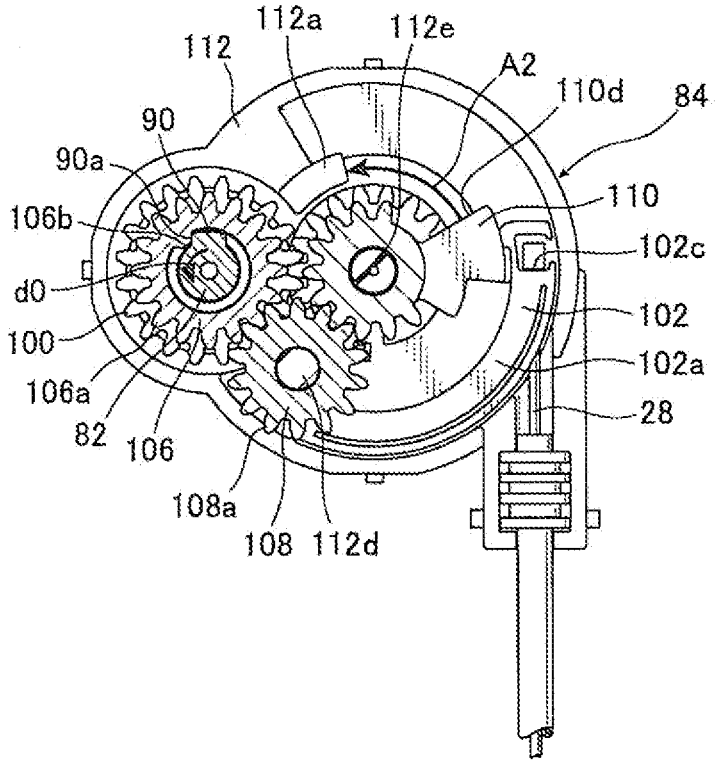
FIG. 22 (*a*) is a cross-sectional view, taken along line C-C in FIG. 6, of the details of the internal structure of the drive unit in the operating device for use with the flush water tank assembly according to the first embodiment of the present invention when the operating handle of the drive unit is its stand-by position before the operating handle is rotated.
Figure 22:
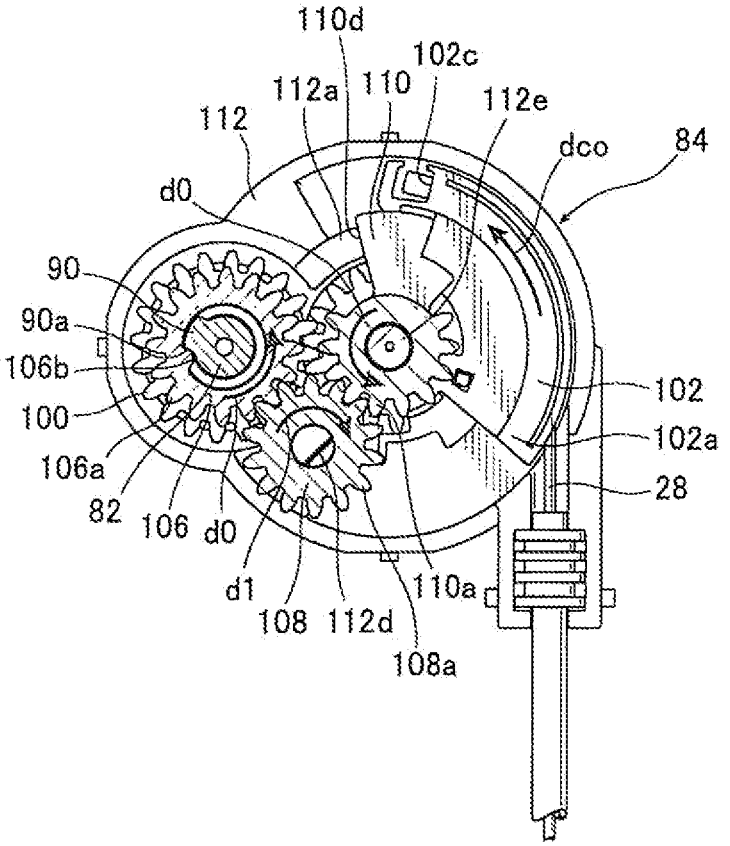

When the user wishes to begin the manual flushing operation in the small-scale flushing mode in the stand-by state as shown in FIG. 19 (*a*), the user rotates (pushes) the grip 26*a* of the operating handle 26 from its stand-by position backwardly of the toilet main unit 2. When the operating handle 26 is rotated in the reverse direction of rotation D0, the rotating shaft 82 connected to the operating handle 26 is also rotated in the reverse direction of rotation. When the rotating shaft 82 is rotated in the reverse direction, the second engagement part 90 of the rotating shaft 82 is engaged by the second inner protrusion 106*b* of the second rotary gear member 106 such that the second rotary gear member 106 co-operates with the rotating shaft 82 to rotate in the reverse direction of rotation D0, as shown in FIGS. 22 (*a*) and (*b*). The third toothed part 108*a* of the third rotary gear member 108 engaging with the second toothed part 106*a* of the second rotary gear member 106 is rotated in the direction of rotation d1 opposite to that of the second toothed part 106*a*. Further, the abutment member gear portion 110*a* of the rotary abutment member 110 engaging with the third toothed part 108*a* of the third rotary gear member 108 is rotated in the direction of rotation D0 opposite to that of the third toothed part 108*a*. In such a manner, the direction of rotation of the rotary abutment member 110 and rotary wind-up member 102 can correspond to that of the large-scale flushing mode by using the different number of gears for transmitting the rotation between the small-scale flushing mode and the large-scale flushing mode.

Therefore, the rotary abutment member 110 is rotated in the same reverse direction of rotation D0 (=dco) due to the fact that the direction of rotation of the rotating shaft 82 is changed by the second rotary gear member 106, third rotary gear member 108 and rotary abutment member 110.

When the rotary abutment member 110 is rotated in the reverse direction of rotation, the first abutment 110*c* of the rotary abutment member 110 is engaged by the rotary wind-up member receiving portion 102*d* of the rotary wind-up member 102 to rotate the rotary abutment member 110 together with the rotary wind-up member 102 in the reverse direction of rotation. In such a manner, the rotary wind-up member 102 is adapted to wind up the operating wire 28 always in the same and common direction of rotation (wind-up direction) Dco, dco independently of the direction of rotation of the operating handle 26.

Figure 20:
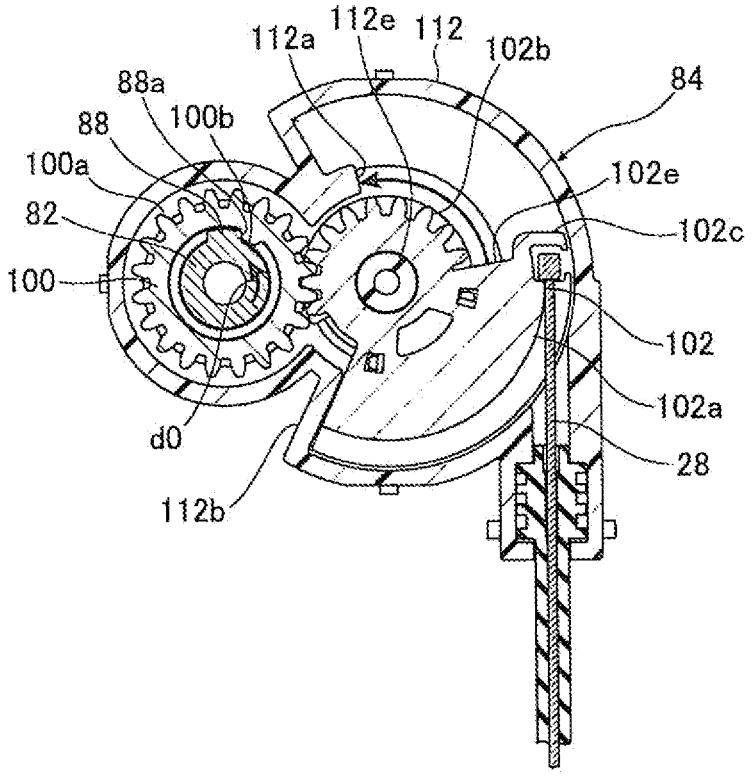
FIG. 20 (*a*) is a cross-sectional view, taken along line A-A in FIG. 6, of the details of the internal structure of the drive unit in the operating device for use with the flush water tank assembly according to the first embodiment of the present invention when the operating handle of the drive unit is its stand-by position before the operating handle is rotated.
Figure 20:
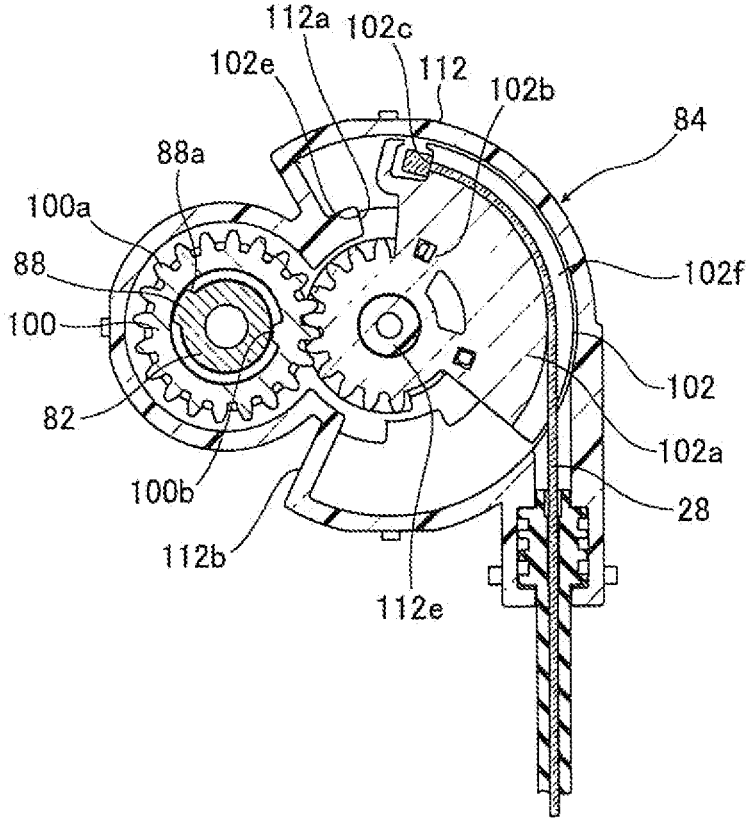

When the rotating shaft 82 is rotated in the reverse of rotation, the first engagement part 88 of the rotating shaft 82 does not engage the first inner protrusion 100*b* of the first rotary gear member 100, but rotates in the reverse direction (idles), as shown in FIG. 20 (*a*) and FIG. 20 (*b*). As shown in FIG. 20 (*b*), therefore, the first rotary gear member 100 is not rotated by the rotating shaft 82. Since the rotary wind-up member 102 is rotated by the second rotary gear member 106, third rotary gear member 108 and rotary abutment member 110 in the reverse direction of rotation, however, the first toothed part 100*a* engaging with the wind-up member gear portion 102*b* is be rotated. Even in such a case, however, the first engagement part 88 will not be engaged by the first inner protrusion 100*b*.

As the rotary wind-up member 102 is rotated in the reverse direction of rotation dco (=d0), the pulley part 102*a* is upwardly rotated to wind up the operating wire 28 mounted on the mounting part 102*c*. The drive unit end 28*a* of the operating wire 28 is pulled up along the groove portion 102*f* in the outer periphery of the pulley part 102*a*. As a result, the valve body 56 mechanically connected to the drive unit end 28*b* of the operating wire 28 is upwardly move to drain the flush water reservoir tank 18.

As shown in FIG. 22 (*b*), the rotation of the pulley part 102*a* is limited and stopped by engagement of the second limiting part 110*d* of the rotary abutment 110*b* with the first stop 112*a*. In other words, the pulley part 102*a* is rotated to the second angle of rotation A2 corresponding to the second range of rotation, and the amount of pull up of the operating wire 28 determined by the angle of rotation of the pulley part 102*a* is set relatively small. The second angle of rotation A2 is set to be smaller than the first angle of rotation A1. Therefore, the valve body 56 of the water discharge valve device 24 can be moved to a relatively low position h2. As a result, the small-scale flushing mode will be performed in which the amount of flush water supplied to the toilet bowl from the flush water reservoir tank 18 is relatively decreased.

When the user releases the operating handle 26 to return it to its initial stand-by position, the rotary wind-up member 102 is rotated to return to the initial stand-by position under the action of the return spring 104. When the rotary wind-up member 102 is returned to its initial stand-by position to close the water discharge port 46 through the valve body 56 connected to the operating wire 28, the drainage in the water discharge valve device 24 is finished. Subsequently, a predetermined water feed is performed to fill the flush water reservoir tank 18 to the full water-level WL. In such a manner, the flush water tank assembly 16 will be returned to its initial stand-by state before the operating handle 26 is actuated.

In the operating device 30 of the flush water tank assembly according to the first embodiment of the present invention, the user can selectively rotates the operating handle 26 in the forward or reverse direction of rotation to select either one of the large-scale and small-scale flushing modes. The rotary direction changing mechanism 96 can change the direction of rotation transmitted from the rotating shaft 82 to the rotary wind-up mechanism 94 into the same direction of rotation (Dco, dco) even if the rotating shaft 82 is rotated in either one of the forward and reverse directions of rotation. Therefore, variation in the amount of wind up of the operating wire 28 in the direction of rotation of the rotary wind-up mechanism 94 can be reduced to operate the valve body 56 so that the appropriate amount of flush water can be delivered to the toilet bowl.

Further, it is only necessary for the user to selectively actuate the operating handle 26 in the forward or reverse direction of rotation, in order that the limiting mechanism 98 can control the angle of rotation of the rotary wind-up mechanism 94 such that the angle of rotation A1 in the rotary wind-up mechanism 94 when the rotating shaft 82 is rotated in one of the forward or reverse direction of rotation is smaller than the angle of rotation of the rotary wind-up mechanism 94 when the rotating shaft 82 is rotated in the other of the reverse or forward direction of rotation. Thus, the amount of wind up of the operating wire 28 around the rotary wind-up mechanism 94 can be changed appropriately. Accordingly, the user can simply and easily choose the direction of rotation of the operating handle 26 to choose the large-scale or small-scale flushing modes such that the valve body 56 can be moved appropriately to provide an appropriate amount of flush water to the toilet bowl. Consequently, the ease-to-use can be improved.

Further, in the operating device 30 of the flush water tank assembly according to the first embodiment of the present invention, the use can operate the operating handle 26 to rotate it in the forward or inverse direction of rotation and select the large-scale or small-scale flushing mode. The rotary direction changing mechanism 96 of the drive unit 84 can change the direction of rotation transmitted from the rotating shaft 82 to the rotary wind-up mechanism 94 into the same direction of rotation (Dco, dco) even if the rotating shaft 82 is rotated in either one the forward and reverse directions of rotation.

In other words, when the rotating shaft 82 is rotated in either one of the forward and reverse directions of rotation, the first rotary gear member 100 is rotated together with the rotating shaft 82 in the same direction. The first toothed part 100*a* of the first rotary gear member 100 is engaged with the wind-up member gear portion 102*b* which is in turn rotated by the rotating shaft 82 in the direction opposite to that of the rotating shaft 82. In this manner, the rotary wind-up member 102 can wind up the operating wire 28 by rotating in the direction opposite to that of the rotating shaft 82.

On the other hand, when the rotating shaft 82 is rotated in the other of the forward and reverse directions of rotation, the second rotary gear member 106 is rotated together with the rotating shaft 82 in the same direction. The second toothed part 106*a* of the second rotary gear member 106 is engaged and rotated by the third toothed part 108*a* of the third rotary gear member 108 which is rotated by the second rotary gear member 106 in the direction opposite to that of the second rotary gear member 106. Further, the third toothed part 108*a* of the third rotary gear member 108 is engaged and rotated by the abutment member gear portion 110*a* of the rotary abutment member 110 which is rotated by the third rotary gear member 108 in the direction opposite to that of the third rotary gear member 108. The first abutment 110*c* of the rotary abutment member 110 is engaged by the rotary wind-up member receiving portion 102*d* of the rotary wind-up member 102 to rotate the rotary wind-up member receiving portion 102*d* in the same direction as the direction of rotation of the rotary abutment member 110. Consequently, the rotary wind-up member 102 will be rotated in the same direction as the direction of rotation of the rotating shaft 82. In this manner, the rotary wind-up member 102 can wind up the operating wire 28 as the rotary wind-up member 102 is rotated in the same direction as the direction of rotation of the rotating shaft 82.

Accordingly, the rotary direction changing mechanism 96 can change the direction of rotation transmitted from the rotating shaft 82 to the rotary wind-up member 102 so that the rotary wind-up member 102 can be rotated always in the same direction of rotation, even when the rotating shaft 82 is rotated in either one of the forward and reverse directions of rotation. By using such a relatively simple structure, the direction of rotation of the rotary wind-up member 102 can remain unchanged.

Accordingly, even though the user operates the operating handle 26 in either one of the forward and reverse directions, the rotary wind-up member 102 can wind up appropriately the operating wire 28 in its own direction of rotation, which can appropriately actuate the valve body 56 always.

In the operating device 30 of the flush water tank assembly according to the first embodiment of the present invention, further, the first rotary gear member 100 is rotated together with the rotating shaft 82 when the rotating shaft 82 is rotated in either one of the forward and reverse directions of rotation. The first toothed part 100*a* of the first rotary gear member 100 is engaged by the wind-up member gear portion 102*b* to rotate the rotary wind-up member 102. At this time, the second rotary gear member 106 is maintained at its initial position rather than rotating and thus the rotary abutment member 110 is also maintained at its initial position. When the rotary wind-up member 102 is rotated to the first angle of rotation A1, the first limiting part 102*e* is engaged by the first stop 112*a* of the cover member 112 to limit the range of rotation in which the rotary wind-up member 102 winds up the operating wire 28 to the first range of rotation.

If the rotating shaft 82 is rotated in the other of the forward and reverse directions of rotation, the second rotary gear member 106 is rotated together with the rotating shaft 82. The second toothed part 106*a* of the second rotary gear member 106 is engaged by the third toothed part 108*a* of the third rotary gear member 108 to rotate the third rotary gear member 108. Furthermore, the third toothed part 108*a* of the third rotary gear member 108 is engaged by the abutment member gear portion 110*a* of the rotary abutment member 110 to rotate the rotary abutment member 110. At this time, the first abutment 110*c* of the rotary abutment member 110 is engaged by the rotary wind-up member receiving portion 102*d* of the rotary wind-up member 102 to rotate the rotary wind-up member 102 in the same direction as that of the rotary abutment member 110. When the rotary abutment member 110 and rotary wind-up member 102 are rotated to the second angle of rotation A2, the second limiting part 110*d* of the rotary abutment member 110 is engaged by the first stop 112*a* of the cover member 112 to limit the range of rotation in which the rotary wind-up member 102 winds up the operating wire 28 to the second range of rotation which is smaller than the first range of rotation.

Accordingly, it is only necessary for the use to selectively operate the operating handle 26 in the forward or reverse direction of rotation in order that the limiting mechanism 98 of the drive unit 84 can control the range of rotation of the rotary wind-up member 102 such that the angle of rotation of the rotary wind-up member 102 when the rotating shaft 82 is rotated in either one of the forward and reverse directions of rotation becomes larger than the angle of rotation of the rotary wind-up member 102 when the rotating shaft 82 is rotated in the other of the forward and reverse directions of rotation. Thus, the amount of pull up of the operating wire 28 around the rotary wind-up member 102 can be changed appropriately. Accordingly, it is only necessary for the user to rotate the operating handle 26 in the forward or reverse direction of rotation in order to select one of the large-scale and small-scale flushing modes, thereby providing an improved ease-to-use.

In the operating device 30 of the flush water tank assembly according to the first embodiment of the present invention, the angle of rotation of the rotating shaft 82 required to rotate the rotary wind-up member 102 to a predetermined angle of rotation can be reduced. This can reduce the angle of rotation of the operating handle 26 required to rotate the rotating shaft 82. Accordingly, the usability can be improved since the user is not required to provide a further still rotation of the operating handle 26.

In the operating device 30 of the flush water tank assembly according to the first embodiment of the present invention, further, an operating force for rotation of the rotating shaft 82 required to rotate the rotary wind-up member 102 to a predetermined angle of rotation can be reduced, resulting in a reduced operating force required to rotate the operating handle 26. Since the user can rotate the operating handle 26 with little effort, the user can operate the operating handle 26 more easily and simply.

In the operating device 30 of the flush water tank assembly according to the first embodiment of the present invention, further, the rotary wind-up member 102 is returned to its preset stand-by position by the return spring 104 after it has been operated by the user. Consequently, the valve body 56 is not left at its open state. Together with the rotary direction changing mechanism 96 for changing the direction of rotation of the rotary wind-up member 102 to the predetermined same direction of rotation, the return spring 104 can return the rotary wind-up member 102 to its preset stand-by position in a relatively precise manner. Therefore, an appropriate flushing operation can be performed when the flush toilet is next used.

In the operating device 30 of the flush water tank assembly according to the first embodiment of the present invention, further, either one of the speed increasing and reducing mechanisms can be provided even if the operating handle 26 is rotated in either one of the forward and reverse directions of rotation. This can improve the usability for the user.

In the operating device 30 of the flush water tank assembly according to the first embodiment of the present invention, furthermore, the whole drive unit 84 can be made compact since the shaft on which the rotary wind-up mechanism 94 rotates is common with the rotating shaft 82.

Additionally, the present invention provides the flush water tank assembly 16 including the aforementioned operating device 30.

With such arrangement of the present invention, the flush water tank assembly can include the operating device providing a stable operation.

Additionally, the present invention provides the flush toilet 1 equipped with the aforementioned flush water tank assembly 16.

With such arrangement of the present invention, the flush toilet can be equipped with the flush water tank assembly providing a stable operation.

With reference to FIGS. 23 to 27, an operating device of a flush water tank assembly according to the second embodiment of the present invention will now be described.

Figure 23:
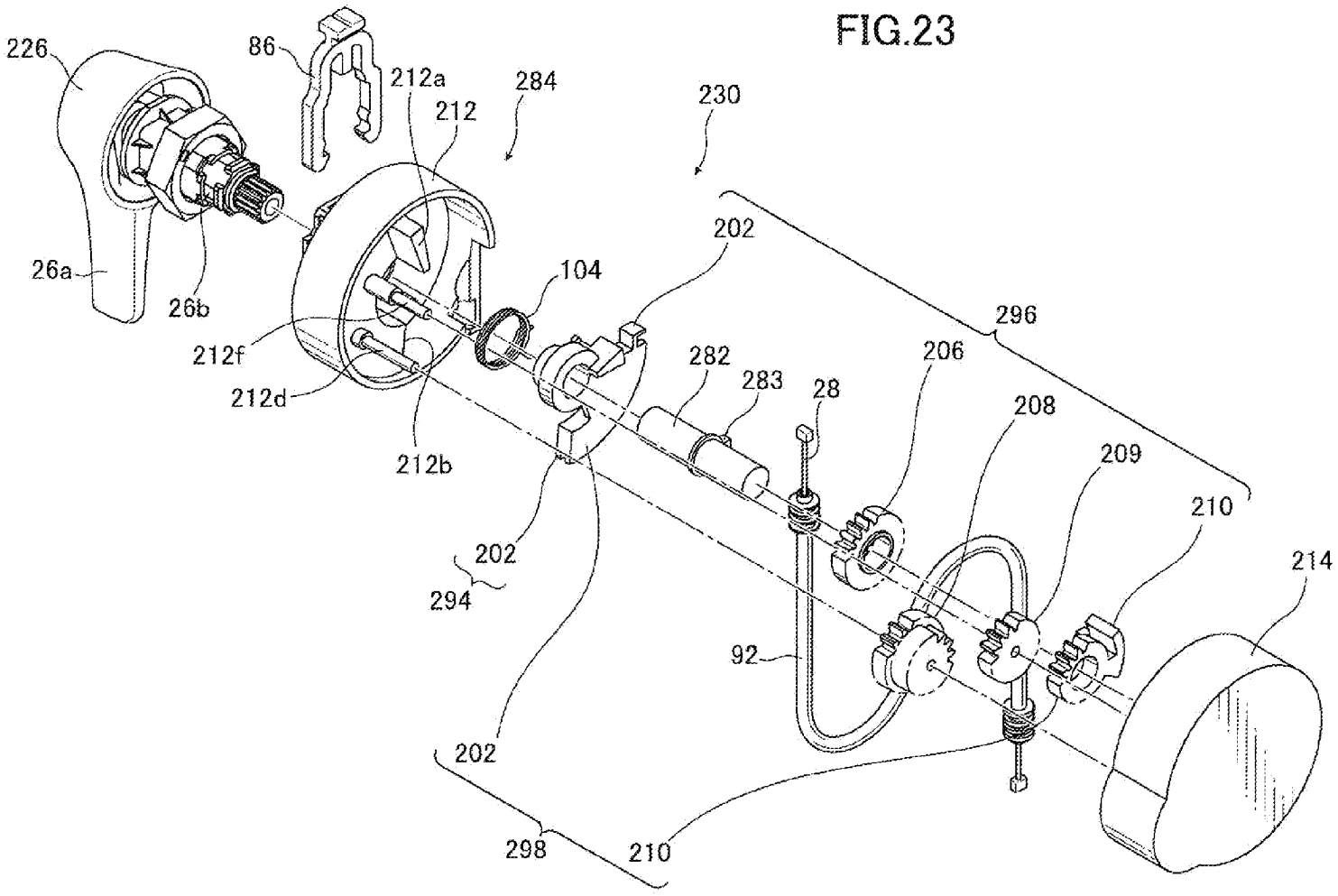
FIG. 23 is an exploded perspective view of the operating device for use with the flush water tank assembly according to a second embodiment of the present invention.
Figure 24:
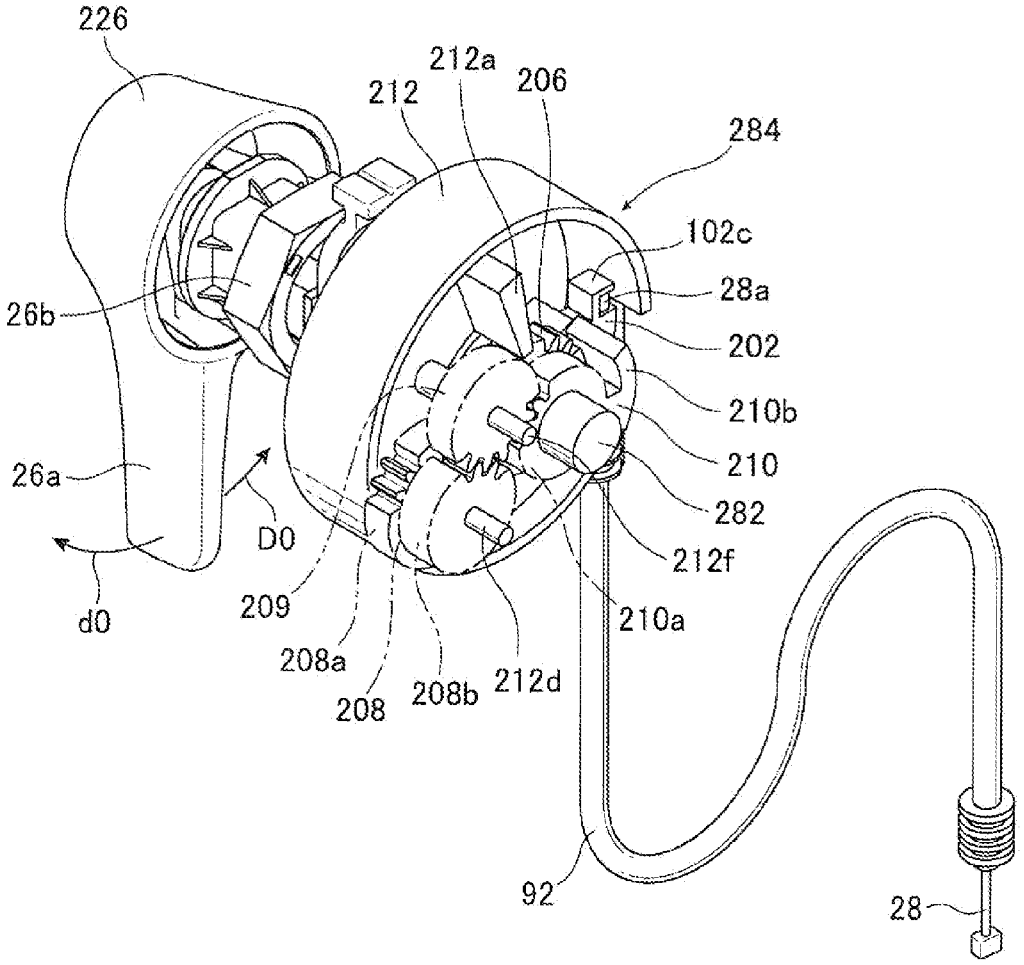
FIG. 24 is a perspective view of the details of the internal structure of the drive unit in the operating device of a flush water tank assembly according to the second embodiment of the present invention when a cover cap is removed, briefly showing the second rotary gear member, third rotary gear member, fifth rotary gear member and external rotating abutment member gear in the drive unit.
Figure 25:
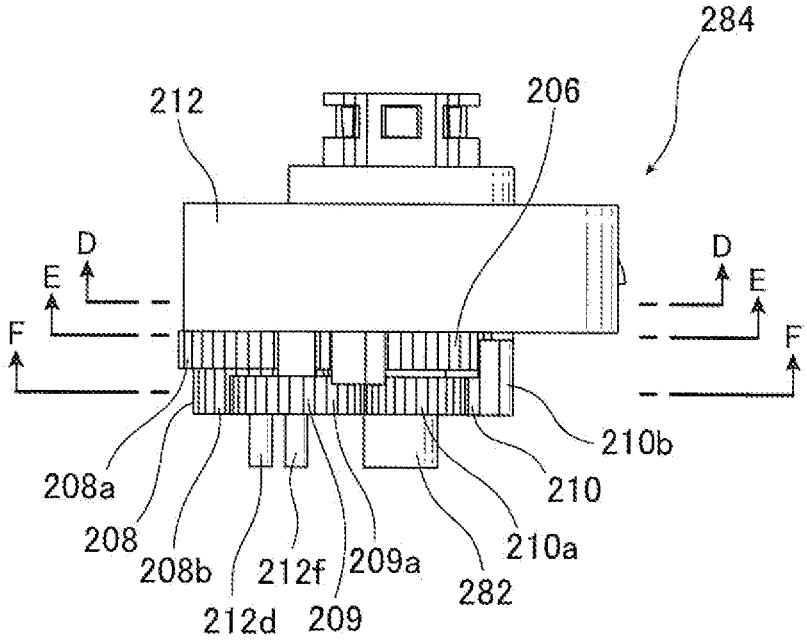
FIG. 25 is a perspective view of the details of the internal structure of the drive unit in the operating device of a flush water tank assembly according to the second embodiment of the present invention when the cover cap is removed, briefly showing the second rotary gear member, third rotary gear member, fifth rotary gear member and external rotating abutment member gear in the drive unit.
Figure 26:
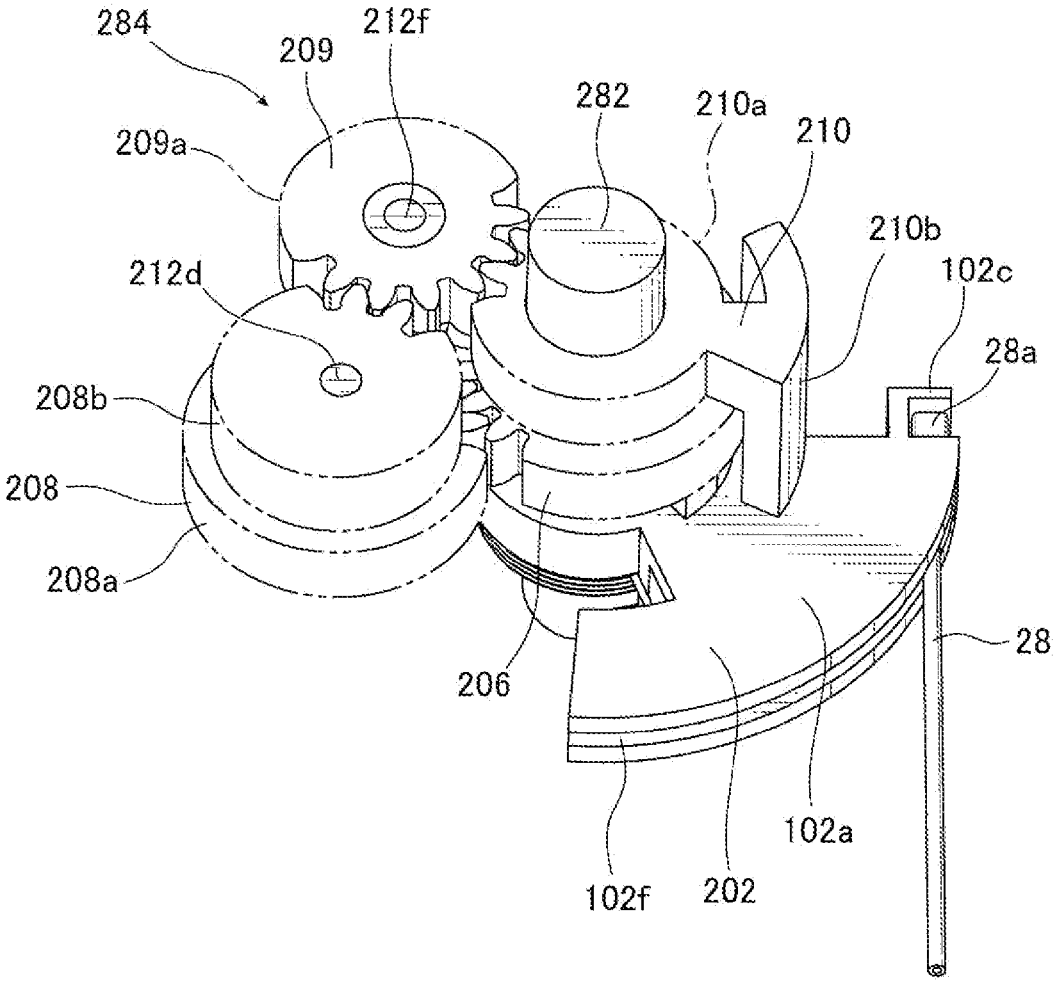
FIG. 26 is a schematic view showing the positional relationship of the second rotary gear member, third rotary gear member, fifth rotary gear member, rotating abutment member and rotary wind-up member of the drive unit in the operating device of a flush water tank assembly according to the second embodiment of the present invention.
Figure 27:
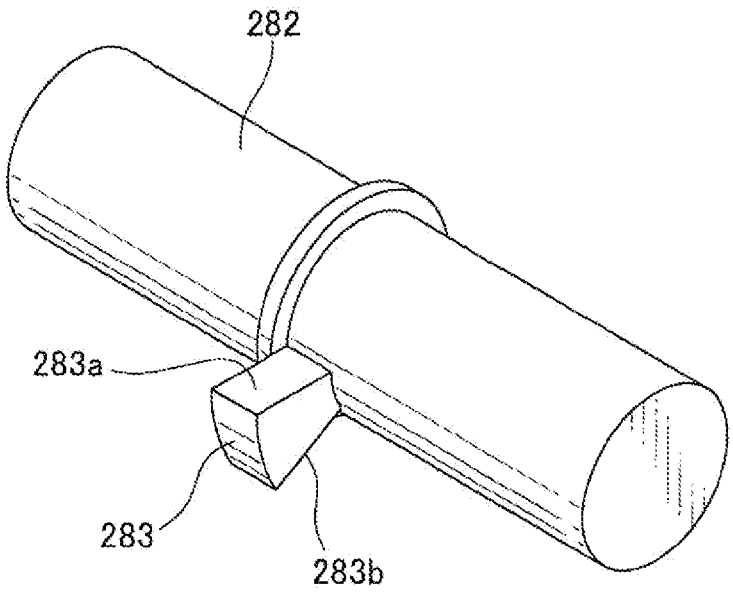
FIG. 27 (*a*) is a perspective view of a rotating shaft in the operating device for use with the flush water tank assembly according to the second embodiment of the present invention.
Figure 27:
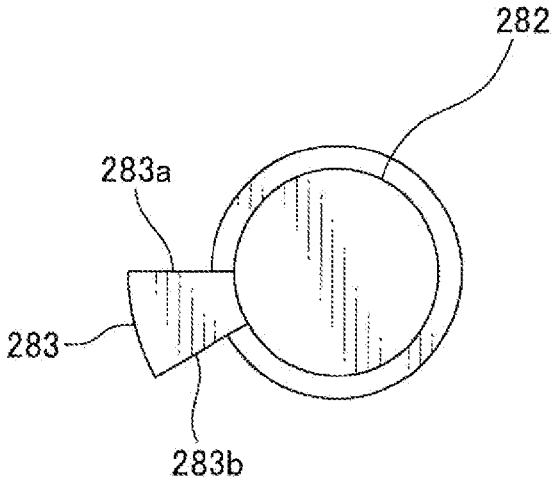

FIG. 23 is an exploded perspective view of the operating device for use with the flush water tank assembly according to the second embodiment of the present invention. FIG. 24 is a perspective view of the details of the internal structure of the drive unit in the operating device of a flush water tank assembly according to the second embodiment of the present invention when a cover cap is removed, briefly showing the second rotary gear member, third rotary gear member, fifth rotary gear member and external rotating abutment member gear in the drive unit. FIG. 25 is a perspective view of the details of the internal structure of the drive unit in the operating device of a flush water tank assembly according to the second embodiment of the present invention when the cover cap is removed, briefly showing the second rotary gear member, third rotary gear member, fifth rotary gear member and external rotating abutment member gear in the drive unit. FIG. 26 is a schematic view showing the positional relationship of the second rotary gear member, third rotary gear member, fifth rotary gear member, rotating abutment member and rotary wind-up member of the drive unit in the operating device of a flush water tank assembly according to the second embodiment of the present invention. FIG. 27 (*a*) is a perspective view of a rotating shaft in the operating device for use with the flush water tank assembly according to the second embodiment of the present invention. FIG. 27 (*b*) is a front view of the rotating shaft of the operating device according to the second embodiment of the present invention as viewed from the interior of the flush water reservoir tank in the axial direction.

The same components of the second embodiment of the present invention as in the first embodiment are designated by the same reference numerals and will not be further described.

In connection with the second embodiment of the present invention, the drawings schematically shows the gears thereof with circles or partial circles simplified according to JIS (Japanese Industrial Standard) and other standards.

Only the components of the operating device for use with the flush water tank assembly according to the second embodiment of the present invention which are different from those of the first embodiment of the present invention, they will be described later.

The flush water tank assembly including the operating device according to the second embodiment of the present invention and the flush toilet equipped with the flush water tank assembly will not be further described since they are respectively identical with the flush water tank assembly including the operating device according to the first embodiment of the present invention and the flush toilet equipped with the flush water tank assembly.

An operating device 230 of a flush water tank assembly according to the second embodiment of the present invention is one that is operated by the user in two directions of rotation. The operating device 230 of the present invention comprises an operating handle 226 located on the left side 18*a* of the flush water reservoir tank 18 as viewed from the front of the toilet bowl and used to select the large-scale or small-scale flushing mode dependent on the fact that the operating handle 226 is rotated by the user in the forward or reverse direction of rotation, a rotating shaft 282 configured to transmit the rotation of the operating handle 226 placed outside of the flush water reservoir tank 18 to the inside of the flush water reservoir tank 18 and to be rotated by the operating handle 226 in the forward or reverse direction of rotation, and a drive unit 284 disposed within the flush water reservoir tank 18 and connected to the rotating shaft 282 and an operating wire 28 such that it will wind up the operating wire 28 on rotation of the rotating shaft 282.

The second embodiment of the present invention is configured to perform the large-scale flushing operation when the operating handle 226 is rotated by the user in the forward direction of rotation D0 in which the operating grip 26*a* of the operating handle 226 is moved backwardly as shown in FIG. 24, unlike the first embodiment. The second embodiment of the present invention is configured to perform the small-scale flushing operation when the operating handle 226 is rotated by the user in the reverse direction of rotation d0 in which the grip 26*a* of the operating handle 226 is moved forwardly. The forward and reverse directions of rotation of the operating handle can be freely changed from one to another. Therefore, the present invention may be configured to perform the small-scale flushing operation when the operating handle is rotated by the user in the forward direction of rotation in which the grip of the operating handle is moved forwardly. The present invention may be configured to perform the large-scale flushing operation when the operating handle is rotated by the user in the reverse direction of rotation in which the grip of the operating handle is moved backwardly.

The operating handle 226 may be attached to the right side of the flush water reservoir tank 18.

The rotating shaft 282 has a first engagement part 283 which extends radially and outwardly from the outer periphery and is formed in a sector-shaped configuration having a fixed thickness.

When the rotating shaft 282 is rotated in the forward direction of rotation, the forward side 283*a* of the sector-shaped portion of the first engagement part 283 as viewed in the forward direction of rotation is engaged by a rotary wind-up member receiving portion 202*d* which will be described later, such that the rotary wind-up member 202 is rotatable together with the rotating shaft 282. When the rotating shaft 282 is rotated in the reverse direction of rotation, the backward side 283*a* of the sector-shaped portion of the first engagement part 283 as viewed in the forward direction of rotation is engaged by a second rotary gear receiving portion 206*d* which will be described later, such that the rotary gear member 206 is rotatable together with the rotating shaft 282.

With reference to FIGS. 23 to 27, the drive unit 284 of the operating device 230 in the flush water tank assembly according to the second embodiment of the present invention will be described schematically.

Figure 33:
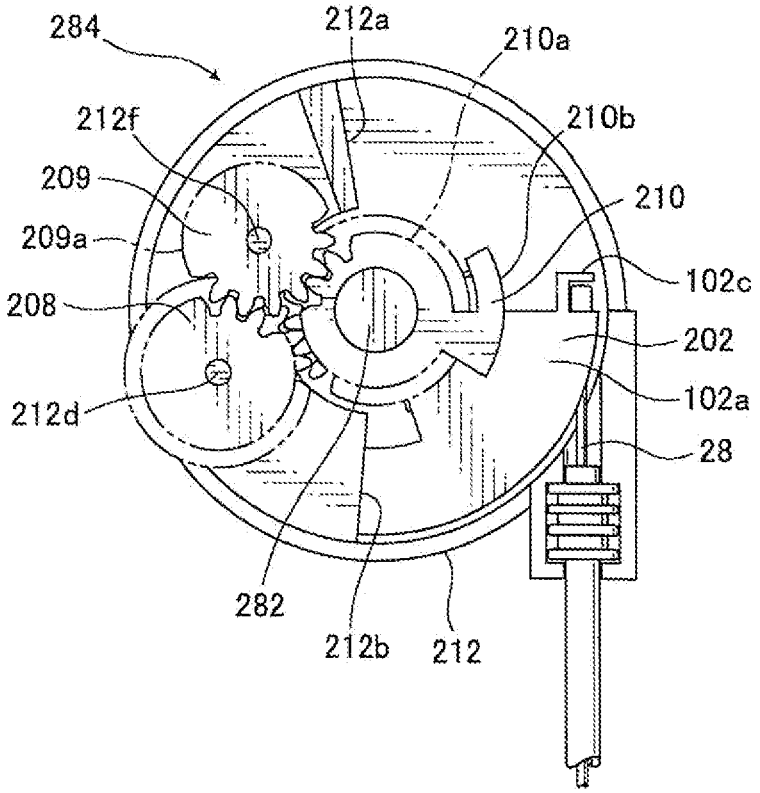
FIG. 33 (*a*) is a front view of the details of the internal structure of the drive unit in the operating device for use with the flush water tank assembly according to the second embodiment of the present invention when the cover cap has been removed and when the operating handle of the drive unit is in its stand-by position before being rotated.
Figure 33:
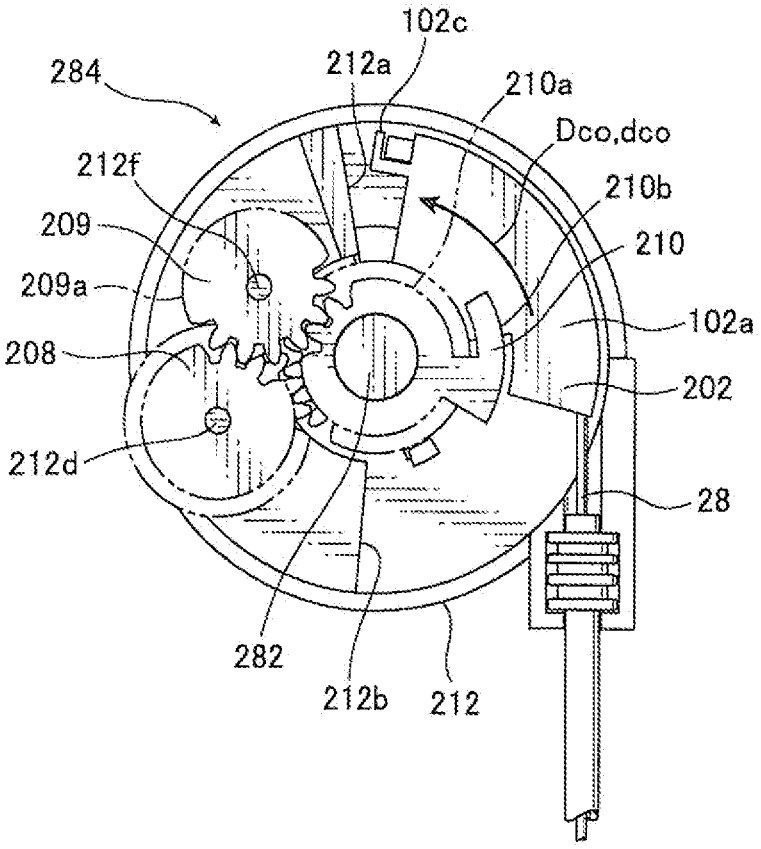

The drive unit 284 of the operating device 230 according to the second embodiment of the present invention comprises a rotary wind-up mechanism 294 which has a radius of rotation larger than that of the rotating shaft 282 and can wind up the operating wire 28 along a common direction of rotation Dco, dco (see FIG. 33 (*b*)), a rotary direction changing mechanism 296 for changing the direction of a rotation transmitted from the rotating shaft 282 to the rotary wind-up mechanism 294 so that the direction of rotation Dco, dco will provide a predetermined direction of rotation when the rotating shaft 282 is rotated in either one of the forward and reverse directions, and a limiting mechanism 298 for limiting the angle of rotation of the rotary wind-up mechanism 294 such that the angle of rotation of the rotary wind-up mechanism 294 when the rotating shaft 282 is rotated in one of the forward and reverse directions is smaller than the angle of rotation of the rotary wind-up mechanism 294 when the rotating shaft 282 is rotated in the other of the reverse and forward directions.

With reference to FIGS. 23 to 32, the structural features of the rotary wind-up mechanism 294, rotary direction changing mechanism 296 and limiting mechanism 298 in the drive unit of the operating device in the flush water tank assembly according to the second embodiment of the present invention will be described in detail.

Figure 28:
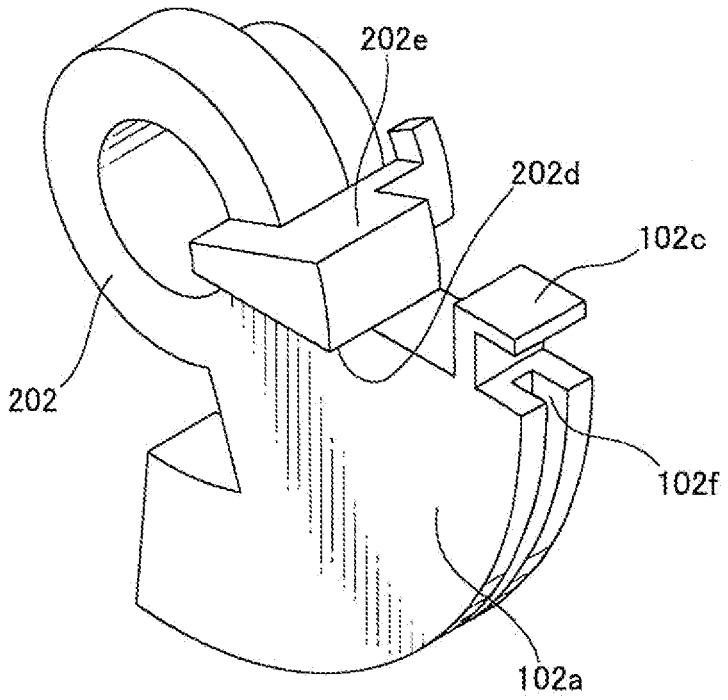
FIG. 28 (*a*) is a perspective view of a rotary wind-up member in the operating device for use with the flush water tank assembly according to the second embodiment of the present invention.
Figure 28:
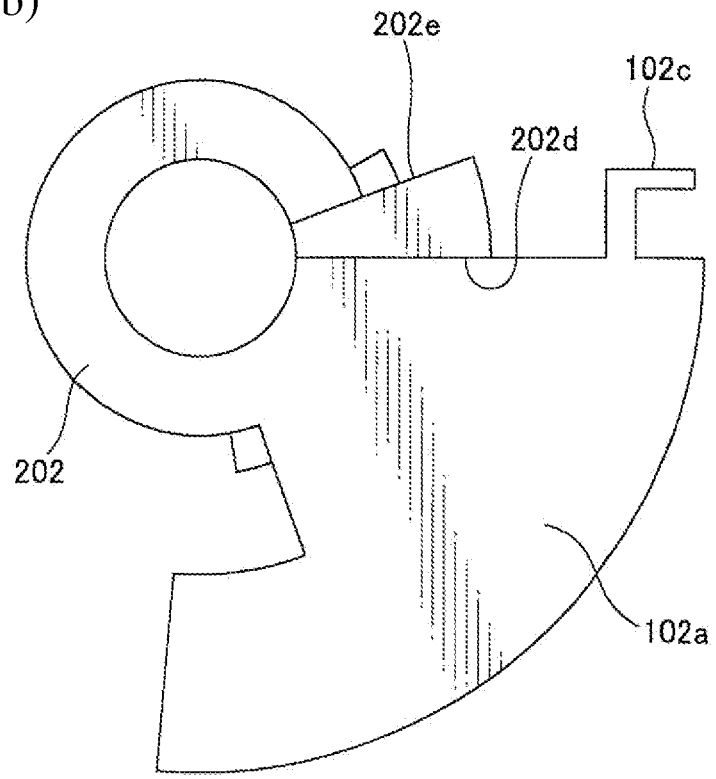
Figure 29:
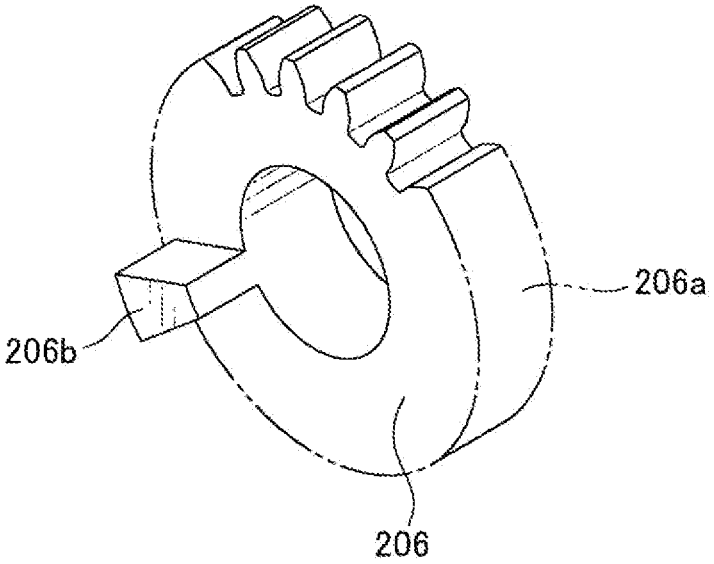
FIG. 29 (*a*) is a perspective view of the second rotary gear member in the operating device for use with the flush water tank assembly according to the second embodiment of the present invention.
Figure 29:
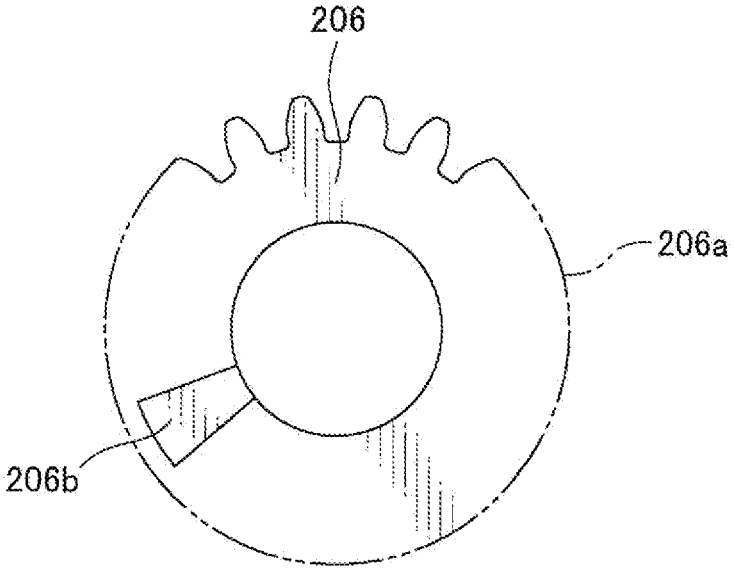
Figure 30:
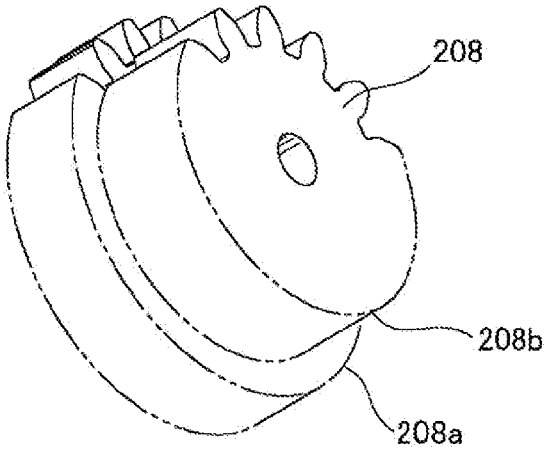
FIG. 30 (*a*) is a perspective view of the third rotary gear member in the operating device for use with the flush water tank assembly according to the second embodiment of the present invention.
Figure 30:
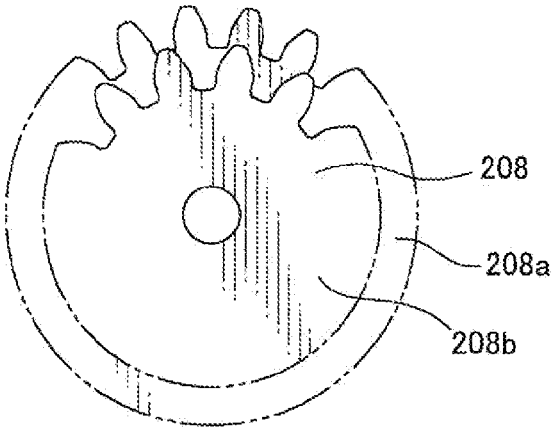
Figure 31:
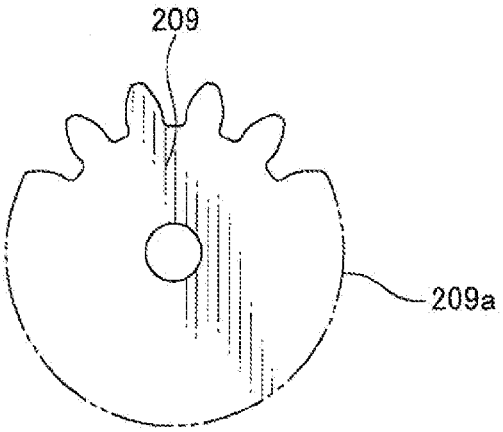
FIG. 31 is a front view of the fifth rotary gear member in the operating device for use with the flush water tank assembly according to the second embodiment of the present invention.
Figure 32:
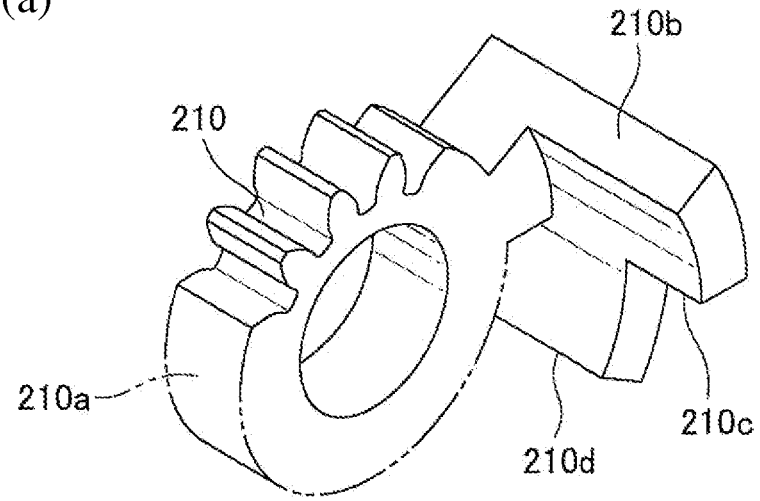
FIG. 32 (*a*) is a perspective view of the rotary abutment member in the operating device for use with the flush water tank assembly according to the second embodiment of the present invention.
Figure 32:
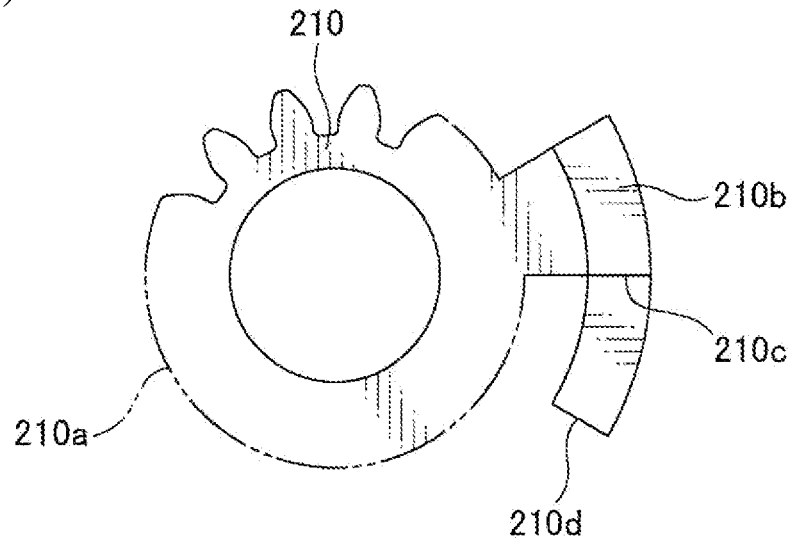

FIG. 28 (*a*) is a perspective view of the first rotary gear member in the operating device for use with the flush water tank assembly according to the second embodiment of the present invention. FIG. 28 (*b*) is a front view of the rotary wind-up member in the operating device for use with the flush water tank assembly according to the second embodiment of the present invention as viewed from the interior of the flush water reservoir tank in the axial direction. FIG. 29 (*a*) is a perspective view of the second rotary gear member in the operating device for use with the flush water tank assembly according to the second embodiment of the present invention. FIG. 29 (*b*) is a front view of the second rotary gear member in the operating device for use with the flush water tank assembly according to the second embodiment of the present invention as viewed from the exterior of the flush water reservoir tank in the axial direction. FIG. 30 (*a*) is a perspective view of the third rotary gear member in the operating device for use with the flush water tank assembly according to the second embodiment of the present invention. FIG. 30 (*b*) is a front view of the third rotary gear member in the operating device for use with the flush water tank assembly according to the second embodiment of the present invention as viewed from the interior of the flush water reservoir tank in the axial direction. FIG. 31 is a front view of the fifth rotary gear member in the operating device for use with the flush water tank assembly according to the second embodiment of the present invention. FIG. 32 (*a*) is a perspective view of the rotary abutment member in the operating device for use with the flush water tank assembly according to the second embodiment of the present invention. FIG. 32 (*b*) is a front view of the rotary abutment member in the operating device for use with the flush water tank assembly according to the second embodiment of the present invention as viewed from the exterior of the flush water reservoir tank in the axial direction.

The drive unit 284 comprises a rotary wind-up member 202 incorporated into the rotary wind-up mechanism 294, the rotary direction changing mechanism 296 and the limiting mechanism 298, a return spring 104 configured to return the rotary wind-up member 202 to its stand-by position when the rotary wind-up member 202 is rotated, a second rotary gear member 206 incorporated into the rotary direction changing mechanism 296, a third rotary gear member 208 incorporated into the rotary direction changing mechanism 296, a fifth rotary gear member 209 incorporated into the rotary direction changing mechanism 296, a rotary abutment member 210 incorporated into the rotary direction changing mechanism 296 and limiting mechanism 298, a cover member 212 of wall-shaped configuration extending toward the interior of the flush water reservoir tank 18 to cover the rotary wind-up member 202, the second rotary gear member 106, the third rotary gear member 108, the fifth rotary gear member and the outer periphery of the rotary abutment member 210, and a cover cap 214 adapted to mate with the cover member 212 to cover the inside of the flush water reservoir tank 18, the cover cap 214 co-operating with the cover member 212 to form the outer periphery of the drive unit 284.

The operating device 230 according to the second embodiment of the present invention can be mounted on the left side 18*a* of the flush water reservoir tank 18 if the user can mostly operate the handle with his left hand. However, the operating device may be mounted on the right side 18*b* of the flush water reservoir tank 18 in order that the user can easily operate with his right hand. In case where the operating device of the second embodiment of the present invention is one for right hand type which can be mounted on the right side 18*b* of the flush water reservoir tank 18, the structural features of the operating device 230 should be reversed from side to side with respect to the center of the operating device 230 such that the large-scale flushing operation can be carried out when the user rotates the operating handle backwardly.

The cover member 212 comprises a first stop 212*a* formed on the upper part of the cover member 212, a second stop 212*b* formed on the lower part of the cover member 212, a third rotary gear member shaft 212*d* for rotatably supporting the third rotary gear member 208, and a fifth rotary gear member shaft 212*f* for rotatably supporting the fifth rotary gear member 209. The second stop 212*b* can prevent the rotary wind-up member 202 from rotating from the stand-by position in a direction opposite to the wind-up direction (upward direction). Since the second stop 212*b* is disposed to block the rotary wind-up member 202 at its stand-by position when the rotary wind-up member 202 is rotated in its return direction, the initiate position of the rotary wind-up member 202 can be maintained constant.

The rotary wind-up member 202 comprises a rotary wind-up member receiving portion 202*d* located outwardly of the rotating shaft and inwardly of the outer periphery of the pulley part and configured to receive a force rotating the rotary wind-up member 202, and a first limiting part 202*e* forming a part of the upper end of the pulley part 102*a* and being engaged by the first stop 212*a* when the rotary wind-up member 202 is rotated to the first angle of rotation A1. The drive unit 284 is configured to have such a size that can cover the predetermined radius and range of rotation required for the rotary wind-up member 202 to wind up the operating wire 28 in its own direction of rotation. Since the rotating shaft of this rotary wind-up member 202 is common with the rotating shaft 282, the whole drive unit 284 can be configured in a more compact manner by comparison with the case that the rotating shaft of the rotary wind-up member 202 is separate from the rotating shaft 282. This permits the radius of the rotary wind-up member 202 to increase relatively greatly.

When the first engagement part 283 of the rotating shaft 282 is rotated into engagement with (or hooked by) the rotary wind-up member receiving portion 202*d*, the first engagement part 283 operates to urge the rotary wind-up member receiving portion 202*d* in the direction in which the first engagement part 283 is rotated. Thus, the rotary wind-up member 202 will be rotated together with the rotating shaft 282 in the same direction of rotation.

In such a manner, the rotary wind-up member 202 is rotated together with the rotating shaft 282 in the forward direction of rotation when the direction of rotation of the rotating shaft 282 is either one of the forward and reverse directions of rotation, for example, when the direction of rotation of the rotating shaft 282 is the forward direction of rotation. On the other hand, the first engagement part 283 of the rotating shaft 282 is rotated in the reverse direction of rotation to be engaged (or hooked) by the rotary wind-up member receiving portion 202*d* when the direction of rotation of the rotating shaft 282 is either one of the forward and reverse directions of rotation, for example, when the direction of rotation of the rotating shaft 282 is the reverse direction of rotation. Therefore, the rotary wind-up member

202 will not be directly rotated by the rotation of the rotating shaft 282 (the rotary wind-up member 202 will be rotated by the rotary abutment member 210 and so on, as will be described below).

The rotary wind-up member receiving portion 202*d* is defined by a protrusion which extends from the top end of the pulley part 102*a* as viewed in the pull-up direction to a predetermined height toward the inside of the pulley part 102*a* (inwardly of the water reservoir tank in the axial direction of the rotating shaft 282). Further, the first abutment 210*c* of the rotary abutment member 210 is engaged by the rotary wind-up member receiving portion 202*d* when the rotary abutment member 210 is rotated in the pull-up direction.

A first limiting portion 202*e* is formed on a part of the top end of the pulley portion 102*a* and configured to be engaged by a first stop 212*a* when the pulley part 102*a* is rotated in the pull-up direction. The engagement of the first limiting portion 202*e* with the first stop 212*a* limits the range of rotation wherein the rotating shaft winds up the operating wire 28 in the direction of rotation of the first limiting portion 102*e* into a first range of rotation.

The first limiting part 202*e* comprises a sector-shaped projection which defines a forward end of the pulley part 102*a* as viewed in the wind-up direction and which is formed at a level higher than that of the inner surface of the pulley part 102*a*. The first limiting part 202*a* is adapted to be engaged by the first stop 212*a* when the pulley part 202*a* is rotated in the pull-up direction. Engagement of the first limiting part 202*e* with the first stop 212*a* limits the range of rotation in which the operating wire 28 is wound up in the direction of rotation of the first limiting part 202*e* into a first range of rotation.

The return spring 104 co-operates with the rotary direction changing mechanism 296 providing the same direction of rotation to the rotary wind-up member 202. Thus, the rotary wind-up member 202 can be returned relatively precisely to a predetermined stand-by position by comparison with the arrangement in which the rotary wind-up member has two directions of rotation.

The second rotary gear member 206 comprises a second gear part 206*a* forming a circular gear and having external teeth on the outer periphery thereof and a receiving portion 206*b* which is mounted on the drive unit 294 which projects toward an area near the first engaging portion 283 of the rotating shaft 282 as viewed in the opposite rotational direction. The second rotary gear member 206 is rotatably mounted on the rotating shaft 82. The second rotary gear member receiver portion 206*b* of the second rotary gear member 206 is located at a side opposite the second engagement part 283 of the rotating shaft 282 in the reverse direction of rotation of the rotating shaft.

With the second rotary gear member 206 attached to the rotating shaft 282, when the first engagement part 283 of the rotating shaft is rotated in the reverse direction to be engaged (or hooked) by the second rotary gear member receiving portion 206*b*, the first engaging portion 283 acts to push the second rotary gear member receiving portion 206*b* in the direction of rotation (reverse direction of rotation) of the first engagement part 283. Thus, the second rotary gear member 206 is rotated together with the rotating shaft 282 in the same direction of rotation. In such a manner, the second rotary gear member 206 can be mounted on the rotating shaft 282 so that they can rotate together, if the rotating shaft 82 is rotated in either one the forward and reverse directions of rotation, for example, when the rotating shaft 282 is rotated in the reverse direction of rotation.

On the other hand, only the rotating shaft 282 is idled and the second rotary gear member 206 is maintained in the non-rotating state since the second engagement part 90 of the rotating shaft 282 is rotated in the forward direction of rotation and thus is not engaged (or pulled) by the second inner protrusion 106*b*, if the rotating shaft 282 is rotated in either one of the forward and reverse directions of rotation, for example, when the rotating shaft 282 is rotated in the forward direction of rotation.

Therefore, the second rotary gear member 206 is adapted to be rotated together with the rotating shaft 282 only in the reverse direction of rotation.

The third rotary gear member 208 comprises a third toothed part 208*a* having external teeth formed thereon and a fourth toothed part 208*b* formed integral with the third toothed part 208*a* such that it can rotate with the third toothed part 208*a* and provided on the peripheral portion thereof with external teeth which are axially offset from those of the third toothed part 208*a*. This third toothed part 208*a* is adapted to be engaged by the second toothed part 206*a* and the fourth toothed part 208*b* which can be rotated together with the third toothed part 208*a* in the same direction is adapted to be engaged by the fifth toothed part 209*a*. The third and fourth toothed parts 208*a* and 208*b* is attached to the third rotary gear member shaft 212*d* which can be rotated about the third rotary gear member shaft 212*d*.

The fifth rotary gear member 209 comprises a fifth toothed part 209*a* having external teeth formed thereon, which is adapted to mesh with the fourth toothed part 208*b* and rotate about a shaft 212*f* of the fifth rotary gear member 209. The fifth toothed part 209*a* of the fifth rotary gear member 209 has its direction of rotation opposite to that of the third toothed part 208*a*.

The rotary abutment member 210 comprises an abutment member gear portion 210*a* having external teeth formed on a circumference thereof over the length of approximately three-fourths of the outer periphery thereof to mesh with the fifth toothed part 209*a*, and a rotation abutment portion 210*b* including a radially extending portion connected to the abutment member gear portion 210*a* at a part of the outer peripheral portion thereof and an arcuate wall extending circumferentially from the radially extending portion and defining an arc of circle centered on the rotational shaft.

The rotation abutment portion 210*b* is also provided with a first abutment part 210*c* forming a part of the arcuate wall that extends from the outer side of the rotary abutment member 210 beyond the radial outer side of the second rotary gear member 206 to a place near the inner surface of the rotary wind-up member 202 and adapted to abut against the second rotary wind-up receiving portion 202*d* of the rotary wind-up member 202 so as to rotate the rotary wind-up member 202 in the same direction as that of the rotary abutment member 210 and a second limiting part 210*d* forming a part of the arcuate wall that extends from the radial outer side of the rotary abutment member 210 toward the rotary wind-up member 202 to a level corresponding to a level of the first stop 212*a* and adapted to abut against the first stop 212*a* as the rotary abutment 110*b* is rotated to a second angle of rotation A2 which is smaller than the first angle of rotation A1.

The rotary abutment member 210 is located above the wind-up member 202 and the second rotary gear member 206 and rotatably mounted around the wind-up member shaft 282. The rotary abutment member 210 is formed as an integral rotating member comprising the abutment member gear portion 210*a*, first abutment part 210*c* and second limiting part 210*d* which rotate about the common rotating shaft 282. Therefore, the rotary abutment member 210*a* is adapted to be rotated in the same direction of rotation as the direction of rotation of the rotary abutment 210*b*.

The abutment member gear portion 210*a* is formed as a partial circle-shaped (sector-shaped or partial circle-shaped) gear.

The first abutment part 210*c* is configured to define a part having the radius (distance) from the rotating shaft 282 to the first abutment part 210*c* which is substantially the same as the radius from the rotating shaft 282 of the rotary wind-up member 202 to the rotary wind-up member receiving portion 202*d*. The first abutment 210*c* is engaged by the rotary wind-up member receiving portion 202*d* to hook the rotary wind-up member receiving portion 202*d* so that the rotary wind-up member 202 is rotated in the forward direction, when the rotary abutment member 210 is rotated in the forward direction.

The second limiting part 210*d* defines the top wall of the rotary abutment member 210, which top wall extends forwardly of the first limiting part 202*e* on the top end of the rotary wind-up member 202 as viewed in the direction of rotation when the rotary abutment member 210 is rotated together with the rotary wind-up member 202 in the reverse direction. That is to say, the second limiting part 210*d* provides a further limiting part forwardly of the first limiting part 202*e* as viewed in the direction of rotation when the rotary abutment member 210 is engaged by the rotary wind-up member 202. Therefore, the second limiting part 210*d* abuts against the first stop 212*a* to stop and limit the rotation of the rotary abutment member 210 and rotary wind-up member 102 when the rotary abutment member 210 is rotated together with the rotary wind-up member 102 in the forward direction.

The second rotary gear member 206, third rotary gear member 208, fifth rotary gear member 209, rotary abutment member 210 and rotary wind-up member 202 can be incorporated into a speed increasing mechanism for increasing the angle of rotation of the rotary wind-up member 202 relative to the angle of rotation of the operating handle 226. The speed increasing mechanism is configured to provide a gear ratio (ratio between each number of respective gear teeth of two meshing gears) between the second toothed part 206*a* and the abutment member gear portion 210*a*, which gear ratio increases the angle of rotation of the rotary abutment member 210 and the wind-up member 202 relative to the angles of rotation of the rotating shaft 282 and second rotary gear member 206 which are rotated by the operating handle 226.

On the contrary, the second rotary gear member 206, third rotary gear member 208, fifth rotary gear member 209, rotary abutment member 210 and rotary wind-up member 202 can be incorporated into a speed increasing mechanism for decreasing the angle of rotation of the rotary wind-up member 202 relative to the angle of rotation of the operating handle 226. The speed increasing mechanism is configured to provide a gear ratio (ratio between each number of respective gear teeth of two meshing gears) between the second toothed part 206*a* and the abutment member gear portion 210*a*, which gear ratio decreases the angle of rotation of the rotary abutment member 210 and the wind-up member 202 relative to the angles of rotation of the rotating shaft 282 and second rotary gear member 206 which are rotated by the operating handle 226.

With reference to FIGS. 33 to 40, operation (function) of the operating device for use with the flush water tank assembly, the flush water tank assembly including the operating device and the flush toilet comprising the flush water tank assembly according to the second embodiment of the present invention will now be described.

Apart from the operation of the operation of the operating device for use with the flush water tank assembly, the operation of the flush water tank assembly and also the flush toilet comprising the flush water tank assembly will not be repeatedly described since they are respectively similar to the flush water tank assembly including the operating device and the flush toilet comprising the flush water tank assembly according to the first embodiment of the present invention in terms of operation.

First of all, with reference to FIGS. 33 to 36, the large-scale flushing mode which is performed by the flush water tank assembly including the operating device and the flush toilet comprising the flush water tank assembly according to the second embodiment of the present invention will be described hereinafter.

Now, the operating handle 226 is positioned in a lower stand-by position in the vertical direction before it is actuated by a user. As can be seen in FIG. 33 (*a*), the rotary wind-up member 202 and also the operating wire 28 connected to the rotary wind-up member 202 of the drive unit 284 are in their stand-by position (initial position) and the valve body 56 connected to the operating wire 28 closes the water discharge port 46. At this time, the initial pooled water-level in the flush water reservoir tank 18 is full-level WL (FIG. 3).

Figure 34:
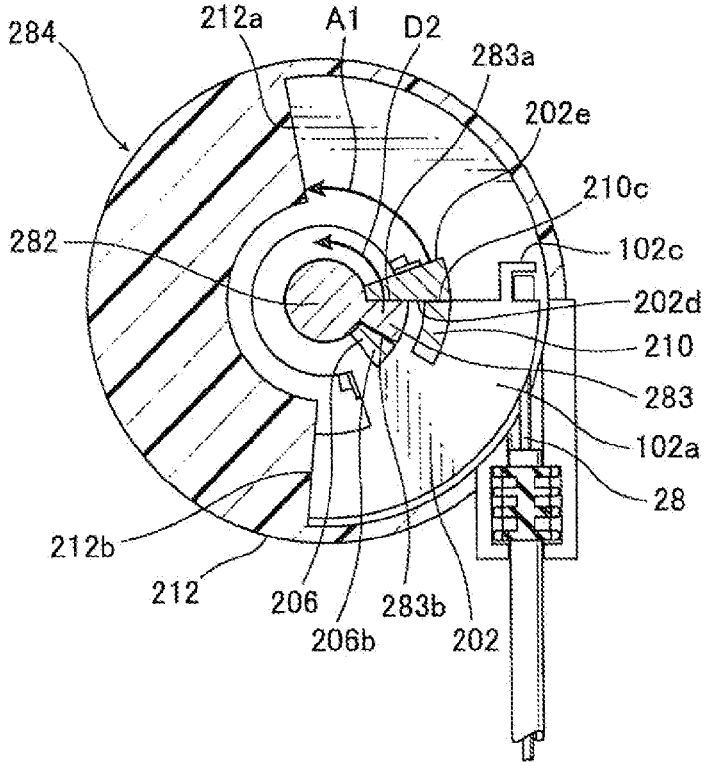
FIG. 34 (*a*) is a cross-sectional view, taken along line D-D in FIG. 25, of the details of the internal structure of the drive unit in the operating device for use with the flush water tank assembly according to the second embodiment of the present invention when the operating handle of the drive unit is its stand-by position before the operating handle is rotated.
Figure 34:
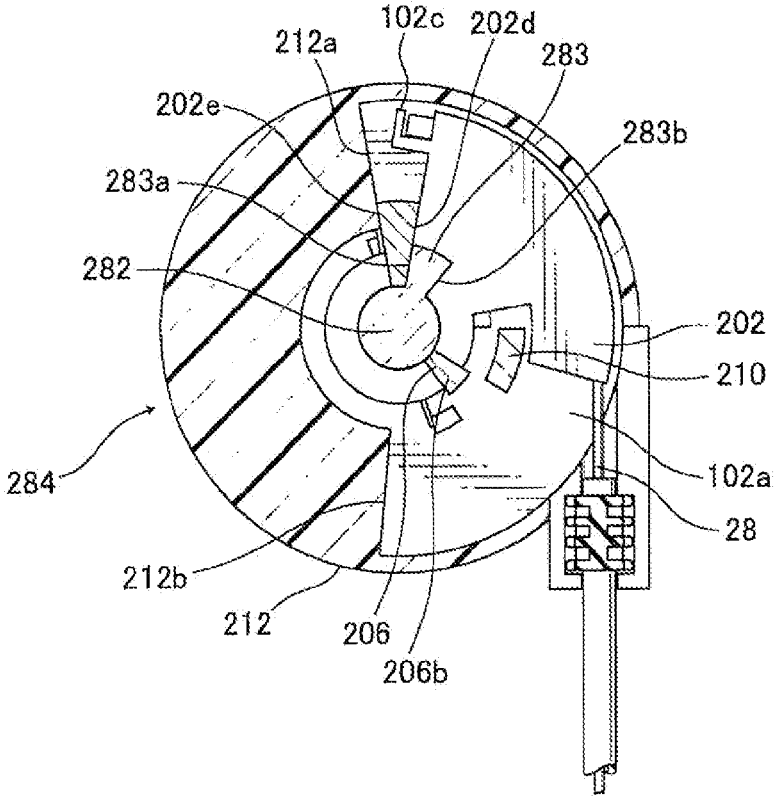

When the user wishes to start the large-scale flushing operation in such a stand-by state as shown in the FIG. 33 (*a*), the user rotates the operating handle 226 from its stand-by position in the forward direction of rotation D2 by rearwardly pulling (pushing upwardly) the grip 26*a* of the operating handle 226. If the operating handle 226 is rotated in the forward direction of rotation, the rotating shaft 282 connected to the operating handle 226 is rotated in the forward direction. As can be seen in FIGS. 34 (*a*) and 34 (*b*), as the rotating shaft 282 is rotated in the forward direction of rotation D0, the first engagement part 283 of the rotating shaft 282 is engaged by the rotary wind-up member receiving part 202*d* of the rotary wind-up member 202 to rotate the rotating shaft 282 and the rotary wind-up member 202 in an interlocking manner in the direction of rotation D2. Therefore, the rotary wind-up member 202 is rotated in the forward direction of rotation D2 (=Dco) opposite to the forward direction of rotation of the rotating shaft 282. As will be described below, the rotary wind-up member 202 will wind up the operating wire 28 always in the same and common direction of rotation (pull-up direction) Dco independently of the direction of rotation of the operating handle 226.

Figure 35:
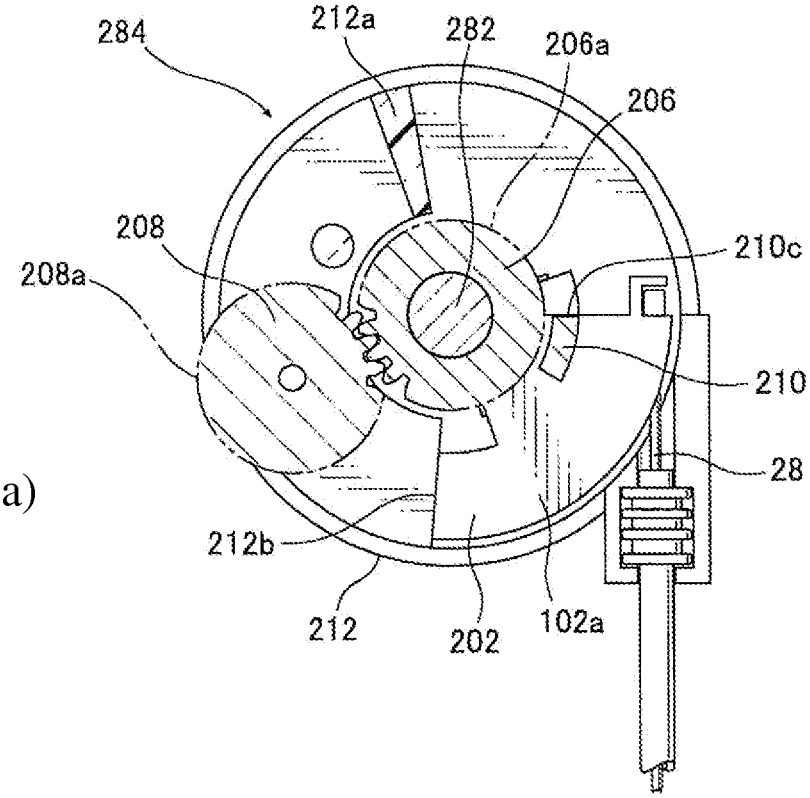
FIG. 35 (*a*) is a cross-sectional view, taken along line E-E in FIG. 25, of the details of the internal structure of the drive unit in the operating device for use with the flush water tank assembly according to the second embodiment of the present invention when the operating handle of the drive unit is its stand-by position before the operating handle is rotated.
Figure 35:
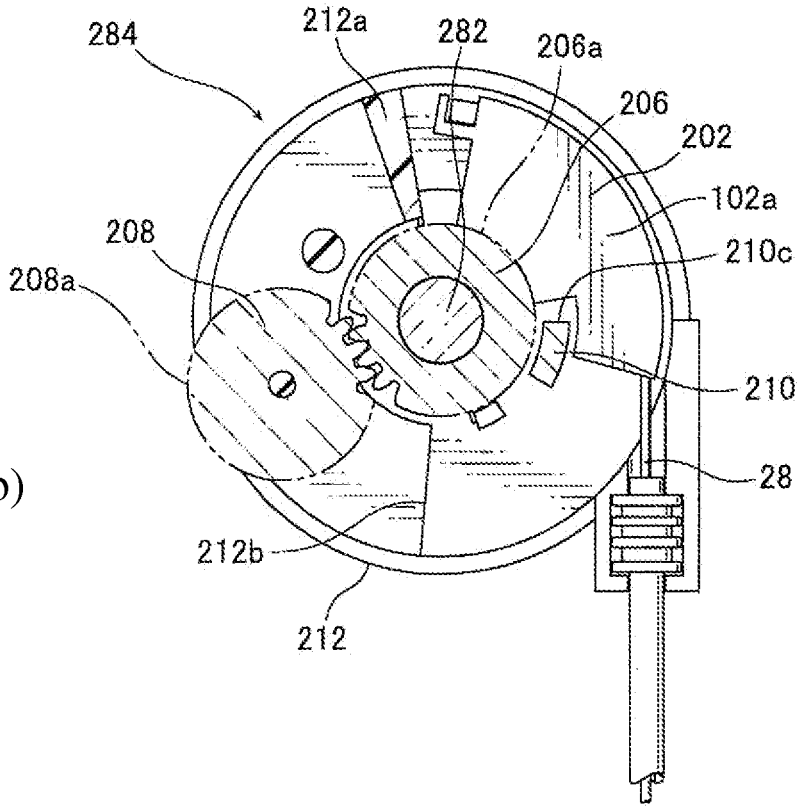
Figure 36:
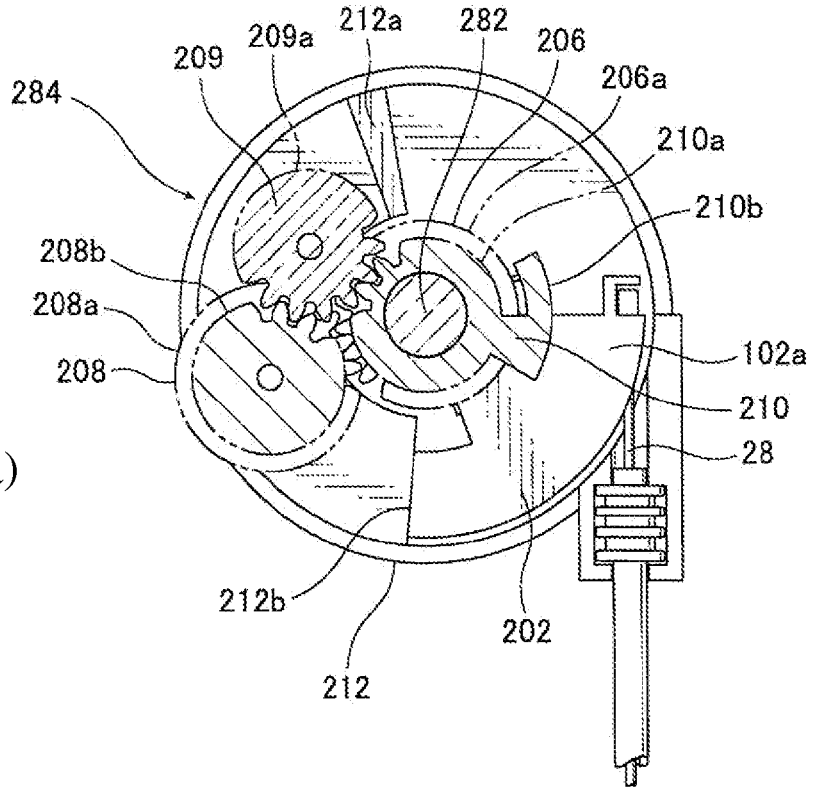
FIG. 36 (*a*) is a cross-sectional view, taken along line F-F in FIG. 25, of the details of the internal structure of the drive unit in the operating device for use with the flush water tank assembly according to the second embodiment of the present invention when the operating handle of the drive unit is its stand-by position before the operating handle is rotated.
Figure 36:
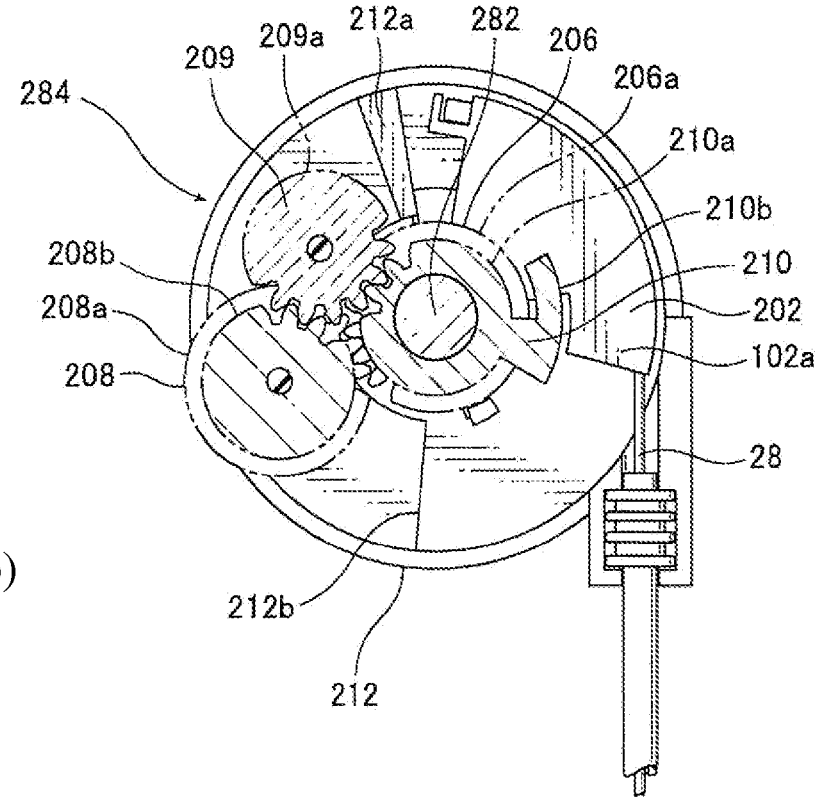

As can be seen in FIGS. 34 (*a*) and 34 (*b*), when the rotating shaft 282 is rotated in the forward direction, the first engagement part 283 of the rotating shaft 282 does not engage the second rotary gear member receiving part 206*d* of the second rotary gear member 206, but rotates in the forward direction (idles). Consequently, as can be seen in FIGS. 35 and 36, the second rotary gear member 206 is not rotated and thus the third rotary gear member 208 meshing with the second rotary gear member 206 is also not rotated. Further, the fourth rotary abutment member 208 meshing with the third toothed part 208*a* is not rotated and thus the fifth rotary gear member 209 meshing with the fourth toothed part 208*b* is not rotated. As a result, the abutment member toothed part 210*a* is not rotated and thus the rotary abutment member 210 is not rotated. Accordingly, these members are maintained at their stand-by positions. At this time, the rotary abutment member 210 does not act on the rotary wind-up member 202 which performs the wind-up operation in the forward direction of rotation independently of the rotary abutment member 210.

As the rotary wind-up member 202 is rotated in the direction of rotation D2, the pulley part 102*a* is upwardly rotated to wind up the operating wire 28 mounted on the mounting part 102*c*. When the drive unit end 28*a* of the operating wire 28 is pulled up along the groove 102*f* in the outer periphery of the pulley part 102*a*, the valve body 56 mechanically connected to the opposite flush valve end 28*b* of the operating wire 28 is upwardly moved to drain the flush water reservoir tank 18.

As can be seen in FIG. 34 (*b*), the rotation of the pulley part 102*a* is limited and stopped when the first limiting part 202*e* is engaged by the first stop 212*a*. That is to say, the pulley part 102*a* is rotated to the first rotation angle A1 corresponding to the first range of rotation, and the amount of pull up in the operating wire 28 determined by the angle of rotation of the pulley part 202*a* is set at a relatively large level. Therefore, the valve body 56 of the water discharge valve device 24 can be moved to a relatively high position h1 and as a result, the large-scale flushing mode will be performed in which the amount of flush water supplied to the toilet bowl from the flush water reservoir tank 18 is relatively increased.

When the user releases the operating handle 226, the rotary wind-up member 202 is rotated to return to the initial stand-by position under action of the return spring 104. When the first rotary gear member 202 is rotated to return to the initial stand-by position, the operating handle 226 is also rotated to return to its initial stand-by position. When the rotary wind-up member 202 return to its initial stand-by position and the valve body 56 connected to the operating wire 28 closes the water discharge port 46, the drainage through the water discharge valve device 24 is terminated. Subsequently, a predetermined water feed is performed to fill the flush water reservoir tank 18 to the full water-level WL. In such a manner, the flush water tank assembly 16 can return to its initial stand-by state before the operating handle 226 is actuated.

With reference to FIGS. 37 to 40, the small-scale flushing mode will now be described which is performed by the flush water tank assembly including the operating device and the flush toilet comprising the flush water tank assembly according to the second embodiment of the present invention.

Figure 37:
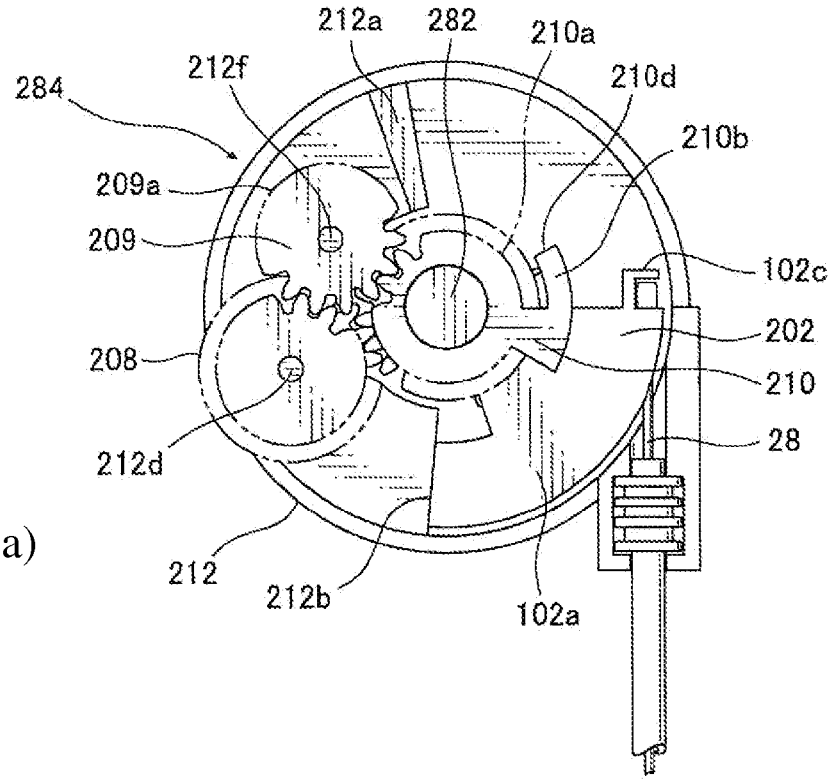
FIG. 37 (*a*) is a front view of the details of the internal structure of the drive unit in the operating device for use with the flush water tank assembly according to the second embodiment of the present invention when the cover cap has been removed and when the operating handle of the drive unit is in its stand-by position before being rotated.
Figure 37:
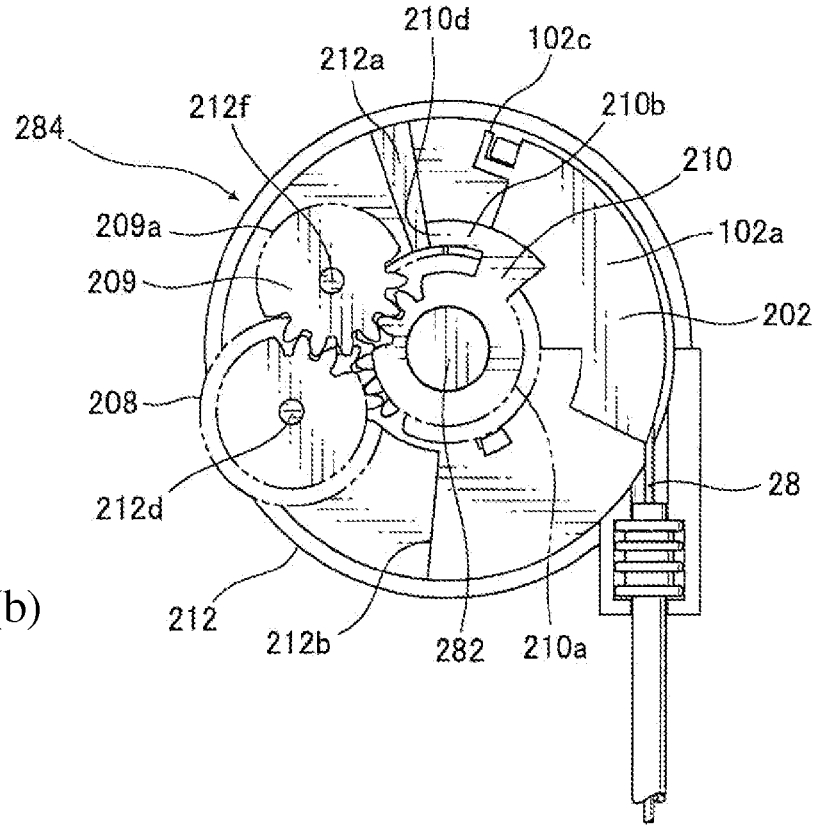

Since the conditions of the flush water tank assembly and drive unit before the user begins to actuate the operating handle 226 to perform the small-scale flushing mode as shown in FIG. 37 (*a*) are equal to those of the flush water tank assembly and drive unit in the large-scale flushing mode shown in FIG. 33 (*a*), they will not be described.

Figure 38:
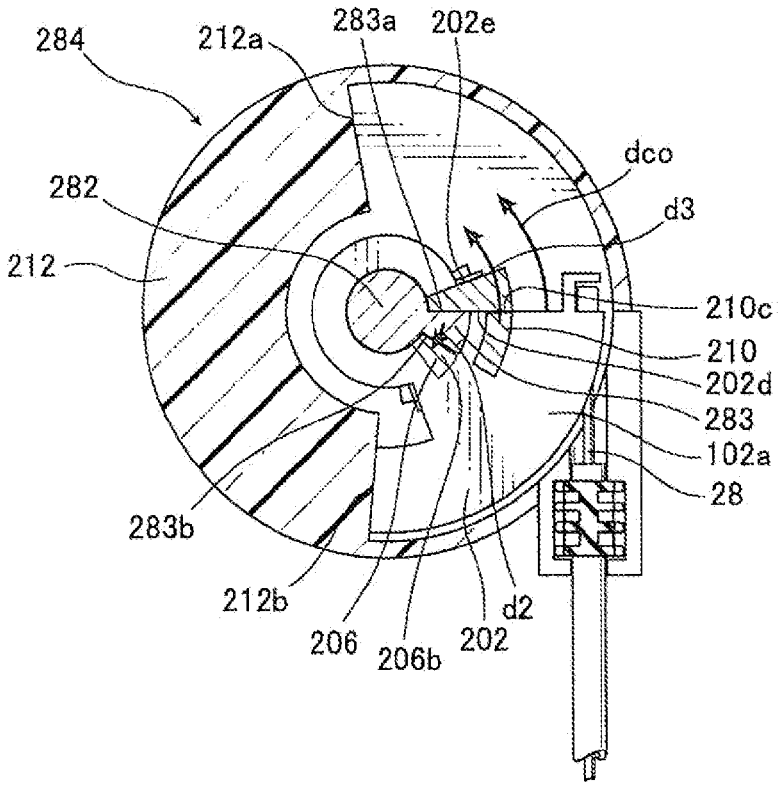
FIG. 38 (*a*) is a cross-sectional view, taken along line D-D in FIG. 25, of the details of the internal structure of the drive unit in the operating device for use with the flush water tank assembly according to the second embodiment of the present invention when the operating handle of the drive unit is its stand-by position before the operating handle is rotated.
Figure 38:
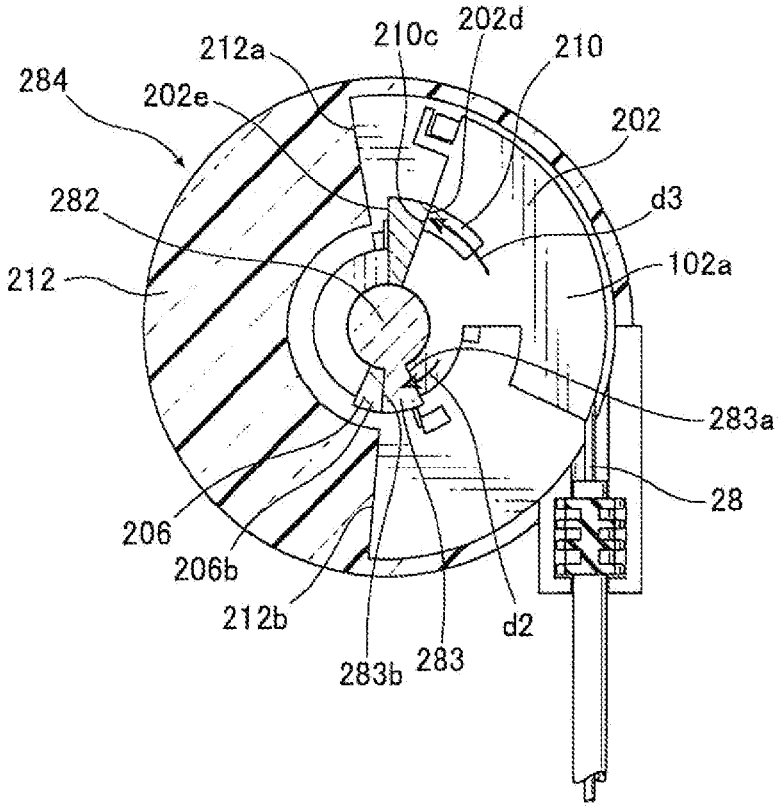
Figure 39:
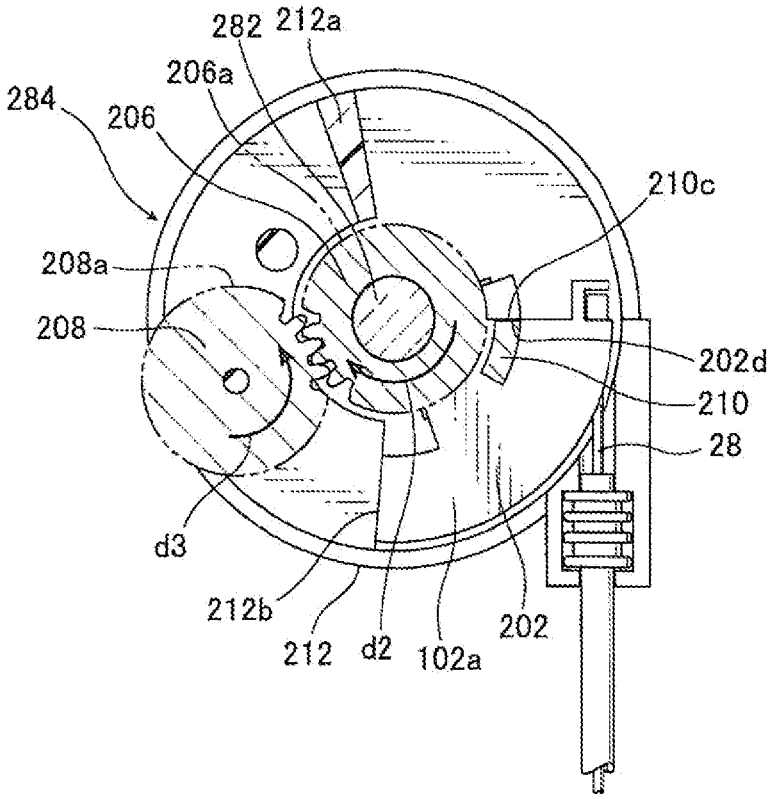
FIG. 39 (*a*) is a cross-sectional view, taken along line E-E in FIG. 25, of the details of the internal structure of the drive unit in the operating device for use with the flush water tank assembly according to the second embodiment of the present invention when the operating handle of the drive unit is its stand-by position before the operating handle is rotated.
Figure 39:
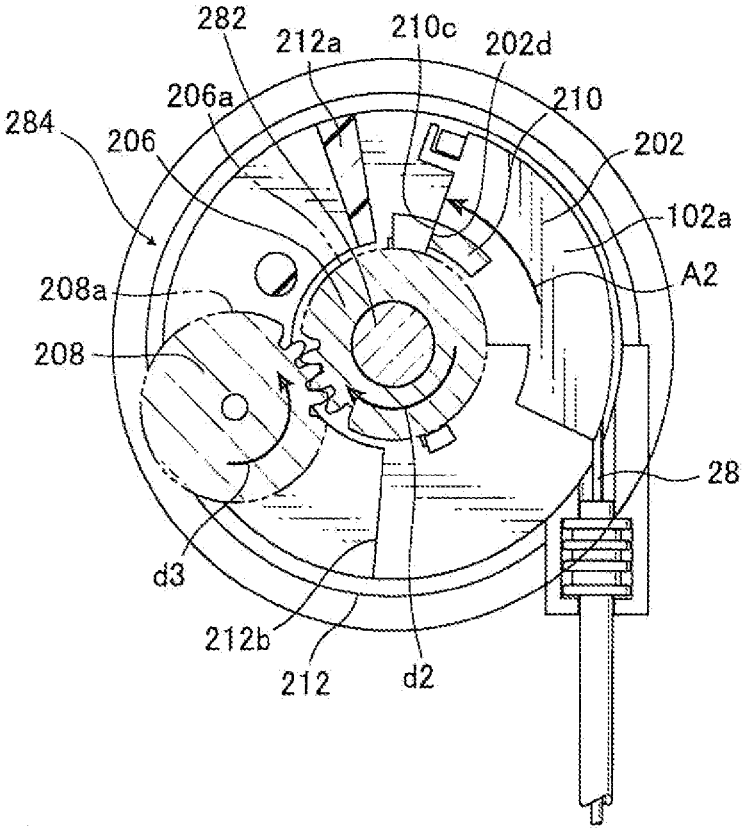
Figure 40:
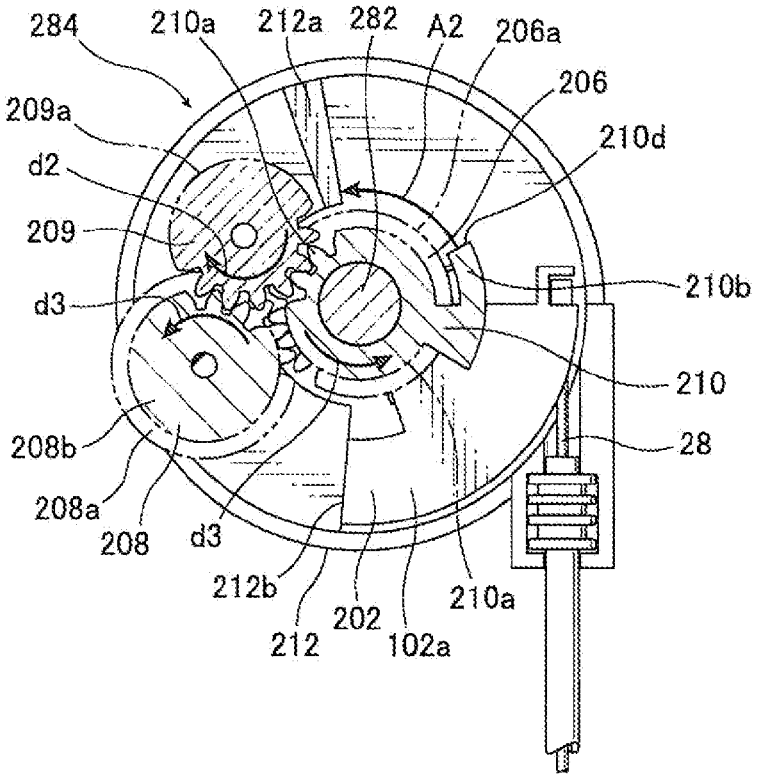
FIG. 40 (*a*) is a cross-sectional view, taken along line F-F in FIG. 25, of the details of the internal structure of the drive unit in the operating device for use with the flush water tank assembly according to the second embodiment of the present invention when the operating handle of the drive unit is its stand-by position before the operating handle is rotated.
Figure 40:
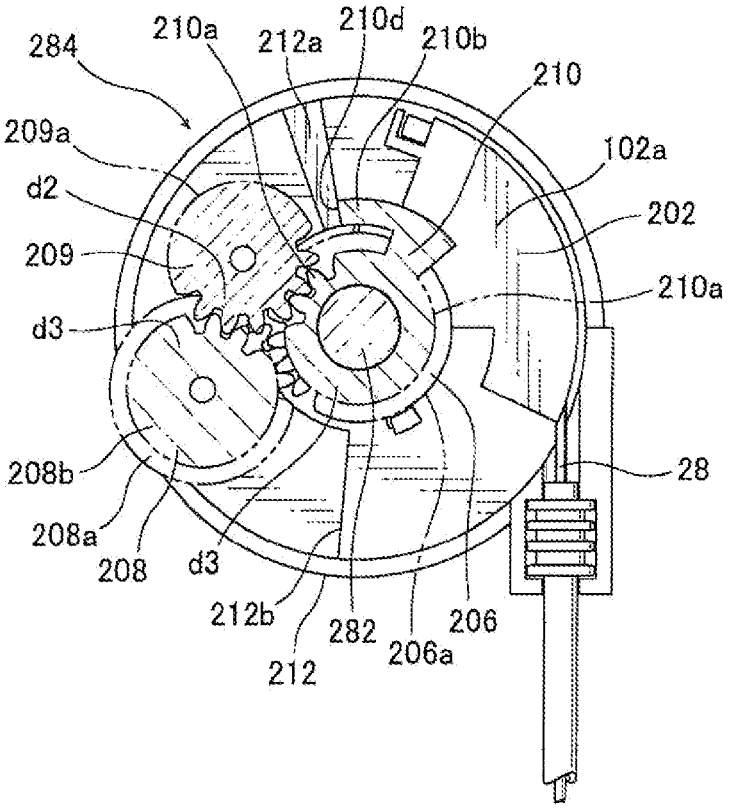
Figure 41:
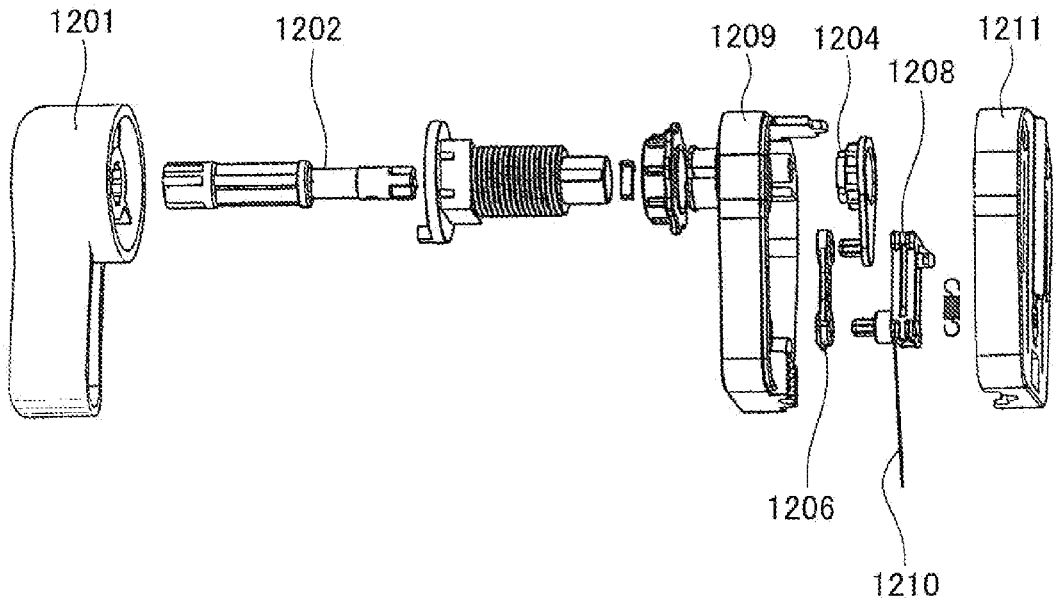
FIG. 41 is an exploded perspective view of an operating device for flushing in the conventional water tank and FIG. 42 is a perspective view of part of the operating device for flushing in the conventional water tank.
Figure 42:
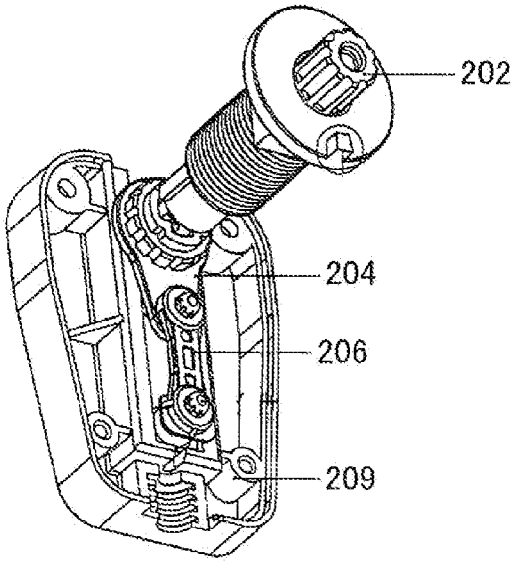

When the user wishes to begin the manual flushing operation in the small-scale flushing mode in the stand-by state as shown in FIG. 37 (*a*), the user rotates (pushes) the grip 26*a* of the operating handle 226 from its stand-by position backwardly of the toilet main unit 2. When the operating handle 226 is rotated in the reverse direction of rotation d2, the rotating shaft 282 connected to the operating handle 226 is also rotated in the reverse direction of rotation d2. As shown in FIG. 38 (*b*), when the rotating shaft 282 is rotated in the reverse direction d2, the first engagement part 283 of the rotating shaft 282 is engaged by the second rotary gear member receiving part 206*b* of the second rotary gear member 206 such that the rotating shaft 282 and the second rotary gear member 206 co-operates such that they rotate in the reverse direction of rotation d2. As can be seen in FIGS. 39 (*a*) and 39 (*b*), The third toothed part 208*a* of the third rotary gear member 208 meshing with the second toothed part 206*a* of the second rotary gear member 206 is rotated in the direction of rotation d3 opposite to that of the second toothed part 206*a*. As can be seen in FIGS. 40 (*a*) and 40 (*b*), the third toothed part 208*a* of the third rotary gear member 208 and the fourth toothed part 208*b* co-operate to rotate in the same forward direction of rotation d3 and thus the fifth toothed part 209*a* engaging with the fourth toothed part 208*b* rotates in the direction of rotation d2 opposite to that of the fourth toothed part 208*b*. Further, as shown in FIG. 40 (*a*), the abutment member gear portion 210*a* of the rotary abutment member 210 meshing with the fifth toothed part 209*a* of the fifth rotary gear member 209 is rotated in the direction of rotation d3 opposite to that of the fifth toothed part 209*a*. As can be seen FIGS. 38 (*a*) and 38 (*b*), when the rotary abutment member 210 rotates in the forward direction of the rotation d3, the first abutment 210*c* of the rotary abutment member 210 is engaged by the rotary wind-up member receiving part 202*d* of the rotary abutment member 210 such that the rotary abutment member 210 rotates in the forward direction of rotation together with the rotary wind-up member 202.

Therefore, while the rotating shaft 282 rotates in the reverse direction of rotation d2, the rotary wind-up member 202 is rotated in the forward direction of rotation d3 (=dco) due to the fact that the direction of rotation thereof is changed by the second rotary gear member 206, third rotary gear member 208, the fifth rotary gear member 209 and rotary abutment member 210. In such a manner, in the small-scale flushing mode, the direction of rotation of the rotary abutment member 210 and rotary wind-up member 202 can correspond to that of the large-scale flushing mode by using the different number of gears for transmitting the rotation.

In such a manner, the rotary wind-up member 102 is adapted to wind up the operating wire 28 always in the same and common reverse direction of rotation (wind-up direction) Dco, dco independently of the direction of rotation of the operating handle 226.

As can be seen in FIG. 38 (*b*), when the rotating shaft 282 is rotated in the reverse of rotation, the first engagement part 283 of the rotating shaft 282 does not engage the rotary wind-up member receiving member 202*d* of the rotary wind-up member 202, but rotates in the reverse direction (idles). As shown in FIG. 38 (*b*), therefore, the rotary wind-up member 202 is not configured to rotate due to the fact that the rotary wind-up member receiving part 202*d* is directly acted on by the rotating shaft 282. However, the second rotary wind-up member 202 is configured to be indirectly rotated through the second rotary gear member 206, the third rotary gear member 208, the fifth rotary gear member 209 and the rotary abutment member 210.

As the rotary wind-up member 202 is rotated in the forward direction of rotation d3 (=dco), the pulley part 102*a* is upwardly rotated to wind up the operating wire 28 mounted on the mounting part 102*c*. The drive unit end 28*a* of the operating wire 28 is pulled up along the groove portion 102*f* in the outer periphery of the pulley part 102*a*. As a result, the valve body 56 mechanically connected to the flush valve end 28*b* of the operating wire 28 is upwardly pulled to drain the flush water reservoir tank 18.

As shown in FIG. 40 (*b*), the rotation of the pulley part 102*a* is limited and stopped by engagement of the second limiting part 210*d* of the rotary abutment member 210 with the first stop 212*a*. In other words, the pulley part 102*a* is rotated to the second angle of rotation A2 corresponding to the second range of rotation as shown in FIG. 40 (*a*), and the amount of pull up of the operating wire 28 determined by the angle of rotation of the pulley part 102*a* is set relatively small. The second angle of rotation A2 is set to be smaller than the first angle of rotation A1. Therefore, the valve body 56 of the water discharge valve device 24 can be moved to a relatively low position h2. As a result, the small-scale flushing mode will be performed in which the amount of flush water supplied to the toilet bowl from the flush water reservoir tank 18 is relatively decreased.

When the user releases the operating handle 226 to return it to its initial stand-by position, the rotary wind-up member 202 is rotated to return to the initial stand-by position under the action of the return spring 104. When the rotary wind-up member 202 is returned to its initial stand-by position to close the water discharge port 46 through the valve body 56 connected to the operating wire 28, the drainage in the water discharge valve device 24 is completed. Subsequently, a predetermined water feed is performed to fill the flush water reservoir tank 18 to the full water-level WL. In such a manner, each of the toothed parts in the drive unit 284 is also returned to its initial stand-by state before the operating handle 226 is actuated.

In the operating device 230 of the flush water tank assembly according to the second embodiment of the present invention, the user can selectively rotates the operating handle 226 in the forward or reverse direction of rotation to select either one of the large-scale and small-scale flushing modes. The rotary direction changing mechanism 296 can change the direction of rotation transmitted from the rotating shaft 282 to the rotary wind-up mechanism 294 into the same direction of rotation (Dco, dco) even if the rotating shaft 282 is rotated in either one of the forward and reverse directions of rotation.

Therefore, any variation in the amount of wind-up of the operating wire 28 in the direction of rotation of the rotary wind-up mechanism 294 can be reduced to operate the valve body 56 so that the appropriate amount of flush water can be delivered to the toilet bowl.

Also, it is only necessary for the user to selectively actuate the operating handle 226 either in the forward or reverse direction of rotation in order that the limiting mechanism 298 can control the angle of rotation of the rotary wind-up mechanism 294 such that the angle of rotation A1 in the rotary wind-up mechanism 294 when the direction of rotation of the rotating shaft 282 is in either one of the forward and reverse directions of rotation is smaller than the angle of rotation of the rotary wind-up mechanism 294 when the direction of rotation of the rotating shaft 282 is in the other of the reverse and forward directions of rotation. Thus, the amount of wind-up of the operating wire 28 around the rotary wind-up mechanism 294 can be changed appropriately. Accordingly, the user can simply and easily choose the direction of rotation of the operating handle 226 to choose the large-scale or small-scale flushing modes such that the valve body 56 can be moved appropriately to provide an appropriate amount of flush water to the toilet bowl. Consequently, the ease-to-use can be improved.

Further, in the operating device 230 of the flush water tank assembly according to the second embodiment of the present invention, the use can operate the operating handle 226 to rotate it in the forward or inverse direction of rotation and select the large-scale or small-scale flushing mode. The rotary direction changing mechanism 296 of the drive unit 284 can change the direction of rotation transmitted from the rotating shaft 282 to the rotary wind-up mechanism 294 into the same direction of rotation (Dco, dco) even if the direction of rotation of the rotating shaft 282 is in either one of the forward and reverse directions of rotation.

In other words, when the direction of rotation of the rotating shaft 282 is either one of the forward and reverse directions of rotation, the first rotary gear member 202 is rotated together with the rotating shaft 282 in the same direction. In this manner, the rotary wind-up member 202 can wind up the operating wire 28 by rotating in the same direction as that of the rotating shaft 282.

On the other hand, when the rotating shaft 282 is rotated in the other of the forward and reverse directions of rotation, the second rotary gear member 206 is rotated together with the rotating shaft 282 in the same direction. The second toothed part 206*a* of the second rotary gear member 206 is engaged and rotated by the third toothed part 208*a* of the third rotary gear member 208 which is rotated by the second rotary gear member 206 in the direction opposite to that of the second rotary gear member 206. The third and fourth toothed parts 208*a* and 208*b* co-operate to rotate in the same direction. The fourth toothed part 208*b* of the third rotary gear member 208 is engaged and rotated by the fifth toothed part 209*a* of the fifth rotary gear member 209 which is rotated in the direction opposite to that of the third rotary gear member 208. Next, the fifth toothed part 209*a* of the fifth rotary gear member 209 is engaged and rotated by the abutment member gear portion 210*a* of the rotary abutment member 210 which is rotated in the direction opposite to that of the fifth rotary gear member 209 independently of the rotating shaft 282. The first abutment 210*c* of the rotary abutment member 210 is engaged by the rotary wind-up member receiving portion 202*d* of the rotary wind-up member 202 to rotate the rotary wind-up member 202 in the same direction as the direction of rotation of the rotary abutment member 210. Consequently, the rotary wind-up member 202 will be rotated in the direction opposite to the direction of rotation of the rotating shaft 282. In this manner, the rotary wind-up member 202 can wind up the operating wire 28 as the rotary wind-up member 102 is rotated in the direction opposite to the direction of rotation of the rotating shaft 282.

Accordingly, when the rotating shaft 282 is rotated in the forward direction, the rotary direction changing mechanism 296 can change the direction of rotation transmitted from the rotating shaft 282 to the rotary wind-up member 202 so that the rotary wind-up member 202 can be rotated in the same direction of rotation, even when the rotating shaft 282 is rotated in either one of the forward and reverse directions of rotation. By using such a relatively simple structure, the direction of rotation of the rotary wind-up member 202 can remain unchanged.

Accordingly, even though the user operates the operating handle 226 in either one of the forward and reverse directions of rotation, which can appropriately actuate the valve body 56, the rotary wind-up member 202 can wind up appropriately the operating wire 28 in its own direction of rotation.

Further, in the operating device 230 of the flush water tank assembly according to the second embodiment of the present invention, when the rotating shaft 282 is rotated in either one of the forward or reverse directions of rotation, the first engagement part 283 of the rotating shaft 282 is engaged by the rotary wind-up member receiving part 202*d* to rotate the rotary wind-up member 202. When the rotary wind-up member 202 is rotated to the first angle of rotation A1, the first limiting part 202*e* is engaged by the first stop 212*a* of the cover member 212 to limit the range of rotation in which the rotary wind-up member 202 winds up the operating wire 28 to the first range of rotation.

If the rotating shaft 282 is rotated in the other of the forward and reverse directions of rotation, the second rotary gear member 206 is rotated together with the rotating shaft 282. The second toothed part 206*a* of the second rotary gear member 206 is engaged and rotated by the third toothed part 208*a* of the third rotary gear member 208. The third and fourth toothed parts 208*a* and 208*b* co-operate to rotate in the same direction. The fourth toothed part 208*b* of the third rotary gear member 208 is engaged and rotated by the fifth toothed part 209*a* of the fifth rotary gear member 209. Next, the fifth toothed part 209*a* is engaged and rotated by the abutment member gear portion 210*a* of the rotary abutment member 210 which is rotated in the direction opposite to that of the fifth rotary gear member 209 independently of the rotating shaft 282. The first abutment 210*c* of the rotary abutment member 210 is engaged by the rotary wind-up member receiving portion 202*d* of the rotary wind-up member 202 to rotate the rotary wind-up member 202 in the same direction as the direction of rotation of the rotary abutment member 210. When the rotary abutment member 210 and rotary wind-up member 202 are rotated to the second angle of rotation A2, the second limiting part 210*d* of the rotary abutment member 210 is engaged by the first stop 212*a* of the cover member 212 to limit the range of rotation in which the rotary wind-up member 202 winds up the operating wire 28 to the second range of rotation which is smaller than the first range of rotation.

Accordingly, it is only necessary for the user to selectively actuate the operating handle 226 in either one of the forward and reverse directions of rotation in order that the limiting mechanism 298 can control the angle of rotation A2 of the rotary wind-up member 202 when the rotating shaft 282 is rotated in either one of the forward and reverse directions of rotation is smaller than the angle of rotation A1 of the rotary wind-up member 202 when the rotating shaft 282 is rotated in the other of the reverse and forward directions of rotation. Thus, the amount of wind-up of the operating wire 28 around the rotary wind-up member 202 can be changed appropriately. Accordingly, the user can simply and easily choose the direction of rotation of the operating handle 226 to choose the large-scale or small-scale flushing modes. Consequently, the usability can be improved.

Further, in the operating device 230 of the flush water tank assembly according to the second embodiment of the present invention, the whole drive unit can be made in a compact configuration since the shaft on which the rotary wind-up member 202 rotates is common with the rotating shaft 282.

What is claimed is:

1. An operating device for a flush water tank assembly adapted to actuate a discharge valve disposed in a flush water tank so as to initiate delivery of flush water to a toilet main unit, the operating device comprising:

an operating part for allowing user to select one of one direction and opposite direction of rotating operations, thereby selecting corresponding one of large-scale and small-scale flushing modes;

a rotating shaft adapted to rotate either one of the one direction and opposite direction of rotation by rotating operation of the operating part;

a connecting member connected to the discharge valve and adapted to open or close the discharge valve to switch an amount of the flush water delivered to the toilet main unit between an amount of the flush water in the large-scale flushing mode and an amount of the flush water in the small-scale flushing mode; and a drive unit pulling up the connecting member in response to the rotation of the rotating shaft; the drive unit comprising:

a rotary wind-up mechanism having a radius of rotation greater than that of the rotating shaft and adapted to wind up the connecting member along the direction of rotation thereof;

a rotary direction changing mechanism changing the direction of rotation transmitted from the rotating shaft to the rotational wind-up mechanism so that the direction of rotation of the rotational wind-up mechanism is in a predetermined same direction of rotation both when a direction of rotation of the rotating shaft is the one direction of rotation and when a direction of rotation of the rotating shaft is the opposite direction of rotation; and a limiting mechanism limiting an angle of rotation of the rotary wind-up mechanism such that the angle of rotation of the rotary wind-up mechanism when a direction of rotation of the rotating shaft is one of the one and opposite directions of rotation is smaller than that of the rotary wind-up mechanism when a direction of rotation of the rotating shaft is the other of the opposite and one directions of rotation.

2. The operating device for the flush water tank assembly according to claim 1, wherein the drive unit also comprises:

a first rotary gear member incorporated into the rotary direction changing mechanism and connected to the rotating shaft such that the first rotary gear member rotates together with the rotating shaft when a direction of rotation of the rotating shaft is either one of the one and opposite directions of rotation, the first rotary gear member including first toothed part having external teeth thereon;

a rotary wind-up member incorporated into the rotary wind-up mechanism, the rotary direction changing mechanism, and the limiting mechanism, the rotary wind-up member forming external teeth on a part of the circumference thereof to engage the first toothed part, and having a wind-up member gear portion rotatable about a wind-up member shaft and, a mounting part mounting the connecting member along the outer periphery thereof; and a receiving part receiving a force rotating the receiving part in outside of the wind-up member shaft, the rotary wind-up member being adapted to wind up the connecting member along its own direction of rotation;

a second rotary gear member incorporated into the rotary direction changing mechanism and connected to the rotating shaft such that the second rotary gear member rotates together with the rotating shaft when a direction of rotation of the rotating shaft is the other of the opposite and one directions of rotation, the second rotary gear member including second toothed part having external teeth thereon;

a third rotary gear member incorporated into the rotary direction changing mechanism and adapted to be rotated about a third rotary gear member shaft, the third rotary gear member including a third toothed part having external teeth formed thereon to engage the second toothed part; and a rotary abutment member incorporated into the rotary wind-up mechanism, the rotary direction changing mechanism, and the limiting mechanism and adapted to be rotated about the wind-up member shaft, the rotary abutment member including a first abutment part adapted to engage the receiving part of the rotary wind-up member in such a manner to rotate the rotary wind-up member in the same direction of rotation as the direction of rotation thereof and an abutment member gear portion having external teeth formed thereon to engage the third toothed part of the third rotary gear member.

3. The operating device for the flush water tank assembly according to claim 2, wherein the drive unit also comprises:

a case member incorporated into the limiting mechanism and provided with a stop;

the rotary wind-up member including a first limiting part adapted to engage the stop of the case member when the first limiting part rotates to a first angle of rotation thereof, the engagement of the first limiting part with the stop being adapted to limit a range of rotation within which the rotary wind-up member can wind up the connecting member along its own direction of rotation to a first range of rotation;

the rotary abutment member including a second limiting part adapted to engage the stop of the case member when the rotary abutment member rotates to a second angle of rotation thereof which is smaller than the first angle of rotation of the rotary wind-up member, the engagement of the second limiting part with the stop causing a range of rotation within which the rotary wind-up member can be rotated to be limited to a second range of rotation which is narrower than the first range of rotation.

4. The operating device for the flush water tank assembly according to claim 1, wherein the drive unit further comprises a speed increasing mechanism increasing the angle of rotation of the rotary wind-up mechanism relative to the angle of rotation of the rotating shaft.

5. The operating device for the flush water tank assembly according to claim 4, wherein the shaft of rotation on which the rotary wind-up mechanism rotates is separate from the rotating shaft.

6. The operating device for the flush water tank assembly according to claim 1, wherein the drive unit further comprises a speed decreasing mechanism decreasing the angle of rotation of the rotary wind-up mechanism relative to the angle of rotation of the rotating shaft.

7. The operating device for the flush water tank assembly according to claim 6, wherein the shaft of rotation on which the rotary wind-up mechanism rotates is separate from the rotating shaft.

8. The operating device for the flush water tank assembly according to claim 1, wherein the drive unit further comprises:

a rotary wind-up member incorporated into the rotary wind-up mechanism, the rotary direction changing mechanism, and the limiting mechanism and connected to the rotating shaft such that the rotary wind-up member rotates together with a direction of rotation of the rotating shaft when the rotating shaft is either one of the one and opposite directions, the rotary wind-up member including a mounting part mounting the connecting member along the outer periphery thereof and a receiving part receiving a force rotating the receiving part in outside of the rotating shaft, the rotary wind-up member being adapted to wind up the connecting member along its own direction of rotation;

a second rotary gear member incorporated into the rotary direction changing mechanism and connected to the rotating shaft such that the second rotary gear member rotates together with the rotating shaft when a direction of rotation of the rotating shaft is rotated in the other of the one and opposite directions, the second rotary gear member including second toothed part having external teeth thereon;

a third rotary gear member incorporated into the rotary direction changing mechanism and adapted to be rotated about a third rotary gear member shaft, the third rotary gear member including a third toothed part having external teeth formed thereon and a fourth toothed part arranged to rotate together with the third toothed part and having external teeth formed thereon which are axially offset from the third toothed part, the third toothed part meshing with the second toothed part of the second rotary gear member, and the third and fourth toothed parts adapted to be rotated about a shaft of the third rotary gear member;

a fifth rotary gear member incorporated into the rotary direction changing mechanism and adapted to be rotated about a fifth rotary gear member shaft, the fifth rotary gear member including a fifth toothed part having external teeth formed thereon to engage the fourth toothed part; and a rotary abutment member incorporated into the rotary direction changing mechanism and the limiting mechanism and arranged to be rotated independently of the rotation of the rotating shaft, the rotary abutment member including a first abutment part adapted to abut the receiving part of the rotary wind-up member to rotate the rotary wind-up member in the same direction of rotation as the direction of rotation thereof and an abutment member gear portion having external teeth formed thereon to engage the fifth toothed part of the fifth rotary gear member.

9. The operating device for the flush water tank assembly according to claim 8, wherein the drive unit further comprises:

a case member incorporated into the limiting mechanism and provided with a stop;

the rotary wind-up member including a first limiting part adapted to engage the stop of the case member when the first limiting part rotates to a first angle of rotation thereof, the engagement of the first limiting part with the stop being adapted to limit a range of rotation within which the rotary wind-up member can wind up the connecting member along its own direction of rotation to a first range of rotation;

the rotary abutment member including a second limiting part adapted to engage the stop of the case member when the rotary abutment member rotates to a second angle of rotation thereof which is smaller than the first angle of rotation of the rotary wind-up member, the engagement of the second limiting part with the stop causing a range of rotation within which the rotary wind-up member can be rotated to be limited to a second range of rotation which is smaller than the first range of rotation.

10. The operating device for the flush water tank assembly according to claim 8, wherein the drive unit further comprises a speed increasing mechanism increasing the angle of rotation of the rotary wind-up mechanism relative to the angle of rotation of the rotating shaft.

11. The operating device for the flush water tank assembly according to claim 10, wherein the shaft of rotation on which the rotary wind-up mechanism rotates is common with the rotating shaft.

12. The operating device for the flush water tank assembly according to claim 8, wherein the drive unit further comprises a speed decreasing mechanism decreasing the angle of rotation of the rotary wind-up mechanism relative to the angle of rotation of the rotating shaft.

13. The operating device for the flush water tank assembly according to claim 12, wherein the shaft of rotation on which the rotary wind-up mechanism rotates is common with the rotating shaft.

14. The operating device for the flush water tank assembly according to claim 1, wherein the drive unit further comprises a spring mechanism for returning the rotary wind-up mechanism to a predetermined stand-by position.

15. A flush water tank assembly including an operating device according to claim 1.

16. A flush toilet equipped with a flush water tank assembly according to claim 15.

* * * * *